US009874036B2

(12) United States Patent
Sun

(10) Patent No.: US 9,874,036 B2
(45) Date of Patent: Jan. 23, 2018

(54) PREFABRICATED, DECONSTRUCTABLE, MULTISTORY BUILDING CONSTRUCTION

(71) Applicant: CANNON DESIGN PRODUCTS GROUP, LLC, St. Louis, MO (US)

(72) Inventor: Ruofei Sun, Chesterfield, MO (US)

(73) Assignee: Cannon Design Products Group, LLC, St. Louis, MO (US)

( * ) Notice: Subject to any disclaimer, the term of this patent is extended or adjusted under 35 U.S.C. 154(b) by 0 days.

(21) Appl. No.: 15/149,325

(22) Filed: May 9, 2016

(65) Prior Publication Data

US 2017/0022726 A1 Jan. 26, 2017

Related U.S. Application Data

(60) Provisional application No. 62/158,712, filed on May 8, 2015.

(51) Int. Cl.

| | |
|---|---|
| ***E04B 1/20*** | (2006.01) |
| ***E04H 1/04*** | (2006.01) |
| ***E04B 1/24*** | (2006.01) |

(52) U.S. Cl.

CPC ..... *E04H 1/04* (2013.01); *E04B 1/2403* (2013.01); *E04B 2001/2406* (2013.01); *E04B 2001/246* (2013.01); *E04B 2001/2418* (2013.01); *E04B 2001/2454* (2013.01); *E04B 2001/2484* (2013.01)

(58) Field of Classification Search

CPC ..... E04F 15/02458; E04F 15/02452; E04B 5/43; E04B 5/023

See application file for complete search history.

(56) References Cited

U.S. PATENT DOCUMENTS

| | | | | |
|---|---|---|---|---|
| 3,216,157 | A | 11/1965 | Pinter | |
| 3,316,680 | A * | 5/1967 | Chrastek | E04F 15/02458 52/126.6 |
| 3,511,001 | A | 5/1970 | Morgan, Jr. | |
| 3,590,538 | A | 7/1971 | Holt et al. | |
| 3,600,863 | A | 8/1971 | Nachtsheim et al. | |
| 3,775,928 | A | 12/1973 | Dawson et al. | |
| 4,127,971 | A | 12/1978 | Rojo, Jr. | |
| 4,231,199 | A | 11/1980 | Gomze et al. | |

(Continued)

FOREIGN PATENT DOCUMENTS

| | | |
|---|---|---|
| JP | H01102105 | 4/1989 |
| JP | H10299225 | 11/1998 |

(Continued)

*Primary Examiner* — Gisele D Ford

(74) *Attorney, Agent, or Firm* — Senniger Powers LLP

(57) ABSTRACT

A kit and method for constructing a building. The kit includes premanufactured support members configured to be assembled together into a framework for supporting a floor. The framework can be a grade level framework or above grade framework. Premanufactured floor deck planks can include leveling assemblies for leveling the planks on the framework and/or clamping assemblies for securing the planks to the framework. Filler material can be inserted into the gaps between the floor planks and frame members to provide further support. The framework can include an arrangement of trusses and connection assemblies for providing two-way support to floor deck planks.

14 Claims, 64 Drawing Sheets

(56) References Cited

U.S. PATENT DOCUMENTS 4,619,090 A * 10/1986 McManus ..... E04B 2/92 52/235
4,637,181 A * 1/1987 Cohen ..... E04F 15/02452 52/126.5
4,972,537 A * 11/1990 Slaw, Sr. ..... E01D 19/125 14/73
4,982,538 A 1/1991 Horstketter
4,991,248 A * 2/1991 Allen ..... E01D 19/125 14/73
4,996,804 A 3/1991 Naka et al.
5,242,249 A 9/1993 Grayson
5,311,629 A * 5/1994 Smith ..... E01D 22/00 14/73.1
5,617,599 A 4/1997 Smith
5,826,290 A * 10/1998 Kokonis ..... E01D 19/125 14/73
5,881,527 A 3/1999 Haseotes
5,901,396 A * 5/1999 Ahlskog ..... E01D 19/125 14/77.1
6,317,915 B1 11/2001 Grearson
6,449,914 B1 9/2002 Horstketter et al.
6,574,818 B1 * 6/2003 Matiere ..... E01D 2/04 14/73
6,584,745 B1 7/2003 Johansson
6,672,019 B1 * 1/2004 Wenz ..... E01D 19/086 52/174
6,904,636 B2 6/2005 Hwang et al.
7,134,805 B2 11/2006 Yee
7,490,439 B2 2/2009 Teramura et al.
7,677,832 B2 3/2010 Yee
8,011,147 B2 9/2011 Hanlan
8,166,595 B2 * 5/2012 Bumen ..... B28B 23/024 14/73
8,341,902 B2 1/2013 Kusuma
8,359,797 B2 1/2013 Lee
8,370,983 B2 * 2/2013 Tokuno ..... E01D 2/02 14/74.5
8,596,012 B2 12/2013 Franchini
8,726,612 B2 * 5/2014 Lomske ..... E04F 15/02044 52/177
8,875,471 B2 11/2014 Siqueiros
9,003,720 B2 4/2015 Siqueiros
2002/0078638 A1 * 6/2002 Huang ..... E04B 5/10 52/126.6
2004/0074183 A1 * 4/2004 Schneider, III ..... E01D 19/125 52/334
2005/0011148 A1 1/2005 Hwang et al.
2008/0016805 A1 * 1/2008 Walter ..... E02D 35/00 52/263
2009/0282771 A1 * 11/2009 Gibson ..... E04F 15/02 52/592.1
2012/0131862 A1 * 5/2012 Hashimoto ..... E04F 15/02452 52/126.6
2014/0053475 A1 2/2014 Siqueiros
2014/0123576 A1 * 5/2014 Meyer ..... E04F 15/02452 52/126.6
2014/0186109 A1 * 7/2014 Wadsworth ..... E04F 15/02 403/404
2015/0059261 A1 3/2015 Siqueiros
2015/0167260 A1 6/2015 Siqueiros

FOREIGN PATENT DOCUMENTS

JP 2967876 10/1999
JP 2000045433 2/2000
JP 2005002606 1/2005
JP 2006124994 5/2006
KR 20020063401 8/2002
KR 100662015 12/2006

* cited by examiner

PREFABRICATED, DECONSTRUCTABLE, MULTISTORY BUILDING CONSTRUCTION

CROSS REFERENCE TO RELATED APPLICATIONS

The present application claims priority to U.S. Provisional Patent Application Ser. No. 62/158,712, entitled PREFABRICATED, DECONSTRUCTABLE, MULTISTORY BUILDING CONSTRUCTION, which was filed on May 8, 2015, which is hereby incorporated by reference in its entirety.

FIELD OF THE INVENTION

The present invention relates to the construction of buildings, more specifically to a kit that provides a structural framing system and associated construction methods.

BACKGROUND OF THE INVENTION

In current building construction, particularly in commercial and institutional multistory buildings, the most common structural systems are cast-in-place concrete and steel framing with composite decking. Precast planks have been used in structural systems with either cast-in-place concrete topping slabs or a wider cast-in-place concrete joint to encase the steel beam top flanges for a composite structure. See, for example, U.S. Pat. No. 5,704,181 for slab to beam connection.

For cast-in-place concrete structures, the superstructure construction starts with placement of rebar and formwork for columns and walls, then erection of shoring system, followed by installation of floor formwork, placement of floor deck reinforcement, and concrete pour and finish. In order to reduce formwork cost, after the floor structure gains adequate strength, the formwork is removed and lifted to the level above and the floor structure is re-shored. The construction process repeats at each floor. Cast-in-place concrete structure requires massive labor and longer construction duration on site for all the construction activities. For steel superstructure, construction starts with erecting steel framing, then installing composite steel decks, welding shear connectors, laying reinforcement, and pouring concrete. Each floor deck requires extended time of preparation before concrete pour and followed by curing times after concrete pour. Both structural systems require long construction duration in the field, as further delays to project schedule may occur due to weather conditions.

In current construction practice, concrete is the most common material for floor slab construction due to its durability, fire resistance, and low cost. When concrete is cast, it is in plastic form and flowable, which leads to the floor deck being relatively flat and level at the beginning. To reduce project cost, it is the conventional practice to construct composite deck without shoring. After the deck in one bay has been cast, the concrete poured in the adjacent bay will cause the previous bay to deflect due to newly added concrete weight. For shored decks, either composite deck or concrete deck, after shoring is removed, floor decks will deflect under their own weight. Both shored and un-shored cast-in-place floor deck construction therefore result in uncontrollable deflection and irregular cracks. Floor levelness and flatness are crucial factors in floor finishing cost. Where floor levelness or flatness do not meet certain requirements, the floor deck has to be either filled up or grinded down before installing floor finishing materials, therefore, resulting in additional project costs and construction time.

There are various factors that can cause random cracks in concrete. Random cracks are typically due to concrete shrinkage and deflection or uneven settlement of support. Without treatment, random cracks may cause damage to the floor finishes and lead to associated repair costs. Ideally, if the cracks are located in a controlled manner, control joints can be placed in the floor finish to accommodate crack location and mitigate repair costs.

Typical concrete material is a mixture of cementitious material, sand, aggregate, water and admixture chemicals. The cementitious materials, such as Portland cement, react with water through a hydration process to produce a synthetic rock of higher strength. The amount of water not participating in the hydration process gradually moves through concrete by diffusion. For concrete slab on grade construction, a vapor barrier is placed under the slab to prevent vapor transmission from soil below; in the meantime, it blocks the concrete moisture from diffusing. Water behaves similarly in composite deck construction. The metal deck also stops moisture from moving downward. Both vapor barrier and metal deck slow down the concrete drying process. It may take years for concrete to dry out and result in costly moisture damage to floor finishing materials.

According to the U.S. Green Building Council, buildings use 40% of raw materials globally or 3 billion tons annually. Typical building structure life span is 50 years. At end of the building life, the common practice is to demolish, not deconstruct, the building. EPA estimates 170 million tons of building related construction and demolition debris was generated in the U.S. in 2003. Cast-in-place concrete structure, steel framing structure and precast plank structure cannot be re-used, though to some extent their materials can be recycled. Recycling, in contrast to re-using, incurs a large amount of energy to, for example, process old steel as scrap to produce new steel shapes. Most of the $CO_2$ emission and energy consumption for building construction are from production of construction materials. To contribute to sustainability efforts, the construction industry should reduce raw material use, landfill, $CO_2$ emission and energy consumption.

At the present time, there have been no structural systems nor construction processes that can adjust the floor levelness and control floor flatness, prevent irregular concrete cracks, require no cast-in-place concrete for slab on grade and floor deck, effectively control concrete moisture, and be deconstructed for reuse.

SUMMARY OF THE INVENTION

To address the deficiencies of the current structural systems and associated construction processes, one object of the present invention is to create a new structural system that improves one or more of the speed, quality, economy and sustainability of multi-story building construction.

More specifically, one object of present invention is to provide a new structural system in which various structural components of a multistory building are pre-manufactured in a controlled environment, cast-in-place concrete construction on site is eliminated or reduced, construction time in the field is reduced, modern building finish requirements on moisture content are met, and flatness and levelness of slab on grade and floor deck are achieved for commercial and institutional buildings.

These and other objects are accomplished by a new structural system comprising two-way steel truss framing and two-way concrete planks. Steel trusses have a high stiffness to weight ratio. By using less steel, the two-way truss framing produces a stiffer support to the concrete plank slab. All steel trusses and concrete planks are pre-fabricated in planks protected from the weather. The manufacture process is precise for a tighter construction tolerance.

There are only four main steel member types and three concrete plank types to be manufactured for the building. Repetition makes fabrication and erection more productive. The fabrication can be automated in a production line. High productivity further reduces the production cost.

Flatness is a measure of local surface bumpiness. Cast-in-place concrete decking is difficult and costly to achieve the higher flatness requirements of typical commercial and institutional building projects. In contrast, with the present invention, planks are manufactured in plants, such that the flatness is easily achieved by casting the top of plank surface against a flat casting bed. The bottom surface of the plank is raised above the supporting structure and is filled with high strength grout; therefore, it is not required to be flat. This approach presents an organic way to achieve desired slab flatness.

Levelness is a measure of slab elevation difference in departure from design elevation. For steel structure, the standard practice is to use one-way slab, which means slab spanning in one direction. One-way slab tends to deflect more than two-way slab does, especially at the middle of a bay. Levelness is improved by using two-way concrete planks and an adjusting mechanism of comprising a coil insert embedded in the plank. Each column bay is divided into three segments in both directions. Plank elevation is adjustable at each truss, thus the slab is always level under structural self-weight.

Another object of present invention is to integrate HVAC systems into structure construction to make the integrated system easy to build and more economical. Running mechanical ductwork through the truss opening has been commonly used. However, the present invention standardizes the truss framing to make mechanical ductwork able to run at the middle span in both directions and pre-fabricates the main ductwork with the trusses to eliminate most of the field work.

A further object of present invention is to provide a structural system that can be deconstructed and reassembled with conventional construction techniques, thus reducing structural waste, reducing energy consumption, and reducing $CO_2$ emission for a more sustainable environment.

There can be bolted connections for all or many structural members above foundation, including slab on grade and floor deck. There is no cast-in-place concrete, nor welding. Where a surface is in contact with grout, it is greased or coated with form release agent for future deconstruction purposes. Depending on the escalation in construction material costs, it is possible that the value of the structure can be fully recovered when the building is deconstructed. The building owner can either reuse the structural members for a different site or sell them in the market place.

In one aspect, a method of constructing a multistory building comprises assembling preformed support members into a framework for supporting a floor of the multistory building that extends generally in a horizontal plane. Preformed floor deck planks are arranged side by side on the framework to form said floor and so that threaded rods mounted on the support members extend through slots defined in the side-by-side arrangement of floor deck planks. Clamping assemblies are threadably tightened onto the threaded rods to engage the floor deck planks and hold the floor deck planks in position relative to the framework.

In another aspect, a method of constructing a multistory building comprises arranging preformed floor deck planks side by side on a framework to form a floor in the multistory building. At least one of the preformed floor deck planks comprises a leveling assembly. The leveling assembly is adjusted to level a top surface of said at least one of the floor deck planks.

In another aspect, a kit for constructing a multistory building comprises preformed support members configured to be assembled into a framework for supporting a floor of the multistory building that extends generally in a horizontal plane. Threaded rods are mounted on the support members to extend in the assembled framework away from the support members transverse to the horizontal plane. Preformed floor deck planks are configured to be arranged side-by-side and mounted on the assembled framework to form said floor of the multistory building. The floor deck planks are configured to define slots for receiving the threaded rods therein when the floor deck planks are arranged to form said floor. Clamping assemblies are configured to be threadably tightened onto the threaded rods to engage the floor deck planks and thereby hold the floor deck planks in position relative to the assembled framework.

In another aspect, a preformed floor deck plank for forming a portion of a floor in a multistory building comprises a plank body having a top surface, a bottom surface, first and second sides, first and second ends, a thickness extending between the top and bottom surfaces, a width extending between the first and second sides, and a length extending between the first and second ends. The plank body is configured to be positioned generally in a horizontal plane and supported on an underlying support surface. A leveling assembly is operatively connected to the plank body. The leveling assembly includes an adjustment member. The leveling assembly is configured for selectively adjusting the position of the adjustment member along the thickness of the plank body to engage the support surface and thereby adjust a distance between the support surface and the bottom surface of the plank.

In another aspect, a kit for constructing a multistory building comprises preformed floor deck planks configured to be assembled side-by-side to form a floor of the multistory building extending generally in a horizontal plane. The floor deck planks each have a top surface, a bottom surface and a thickness extending between the top and bottom surfaces. At least one leveling assembly is operatively connected to one of the floor deck planks and configured to adjust a position of the top surface of said one of the floor deck planks relative to the horizontal plane when the floor deck planks are assembled as the floor. Spacers have a top surface, a bottom surface, and a thickness extending between the top and bottom surfaces. The spacers are configured to be arranged on a support surface so that the bottom surfaces thereof engage the support surface and the top surfaces thereof engage the bottom surfaces of the floor deck planks when assembled as the floor to thereby support the floor deck planks in spaced apart relationship with the support surface, at least partially define leveling channels between the floor deck planks and support surface, and contain filler material in the leveling channels for fixing the floor deck planks in position after said at least one of the floor deck planks is positioned by the leveling assembly.

Other aspects and features will be apparent and/or pointed out hereinafter.

BRIEF DESCRIPTION OF THE FIGURES

Corresponding reference characters indicate corresponding parts throughout the drawings.

DETAILED DESCRIPTION OF PREFERRED EMBODIMENTS OF THE INVENTION

As explained below, the present disclosure relates to a kit for constructing a multistory building from preformed components and a method of constructing a multistory building. The kit can include a structural framing system, which comprises steel trusses (broadly, support members) and column connection assemblies, and precast concrete planks (broadly, deck planks). In one embodiment suitably configured to allow passage of mechanical ductwork through the framing, steel trusses are arranged to form nine squares in each of one or more column bays to provide two-way support to the concrete planks. As explained below the deck planks can be manufactured with built-in leveling mechanisms (broadly, leveling assemblies) that enable the deck planks to be installed in a level and flat manner, eliminating common floor levelness and flatness issues due to deflection and/or construction workmanship issues affecting the decking. Threaded rods and steel channel washers (broadly, clamping assemblies) are utilized to hold the precast concrete planks in place during assembly, and high strength grout is used to permanently secure the planks in place on the substructure. The same precast concrete planks are also used for slab on grade construction and above grad construction. All structural members, including the floor planks, are connected with bolts in the field, which allows the multistory building structure to be deconstructed and reused for new building constructions. The structural materials' life cycle therefore extends well beyond the life cycle of the structure itself. Bolt connection also makes construction automation easily achievable.

Figure 1:
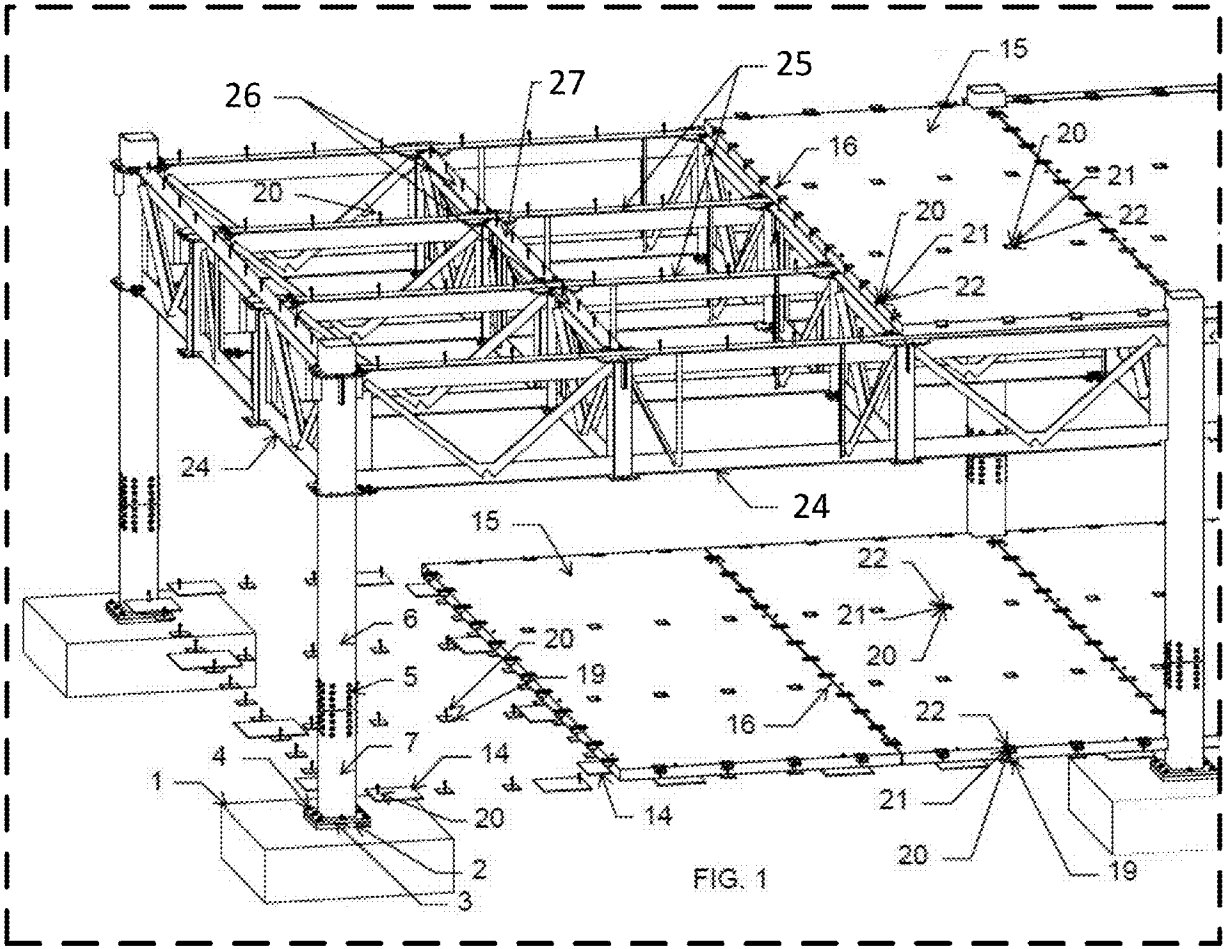
FIG. 1 is a partial perspective view of a structural system of a two-level structure illustrating the structural components and their relationship.
Figure 61:
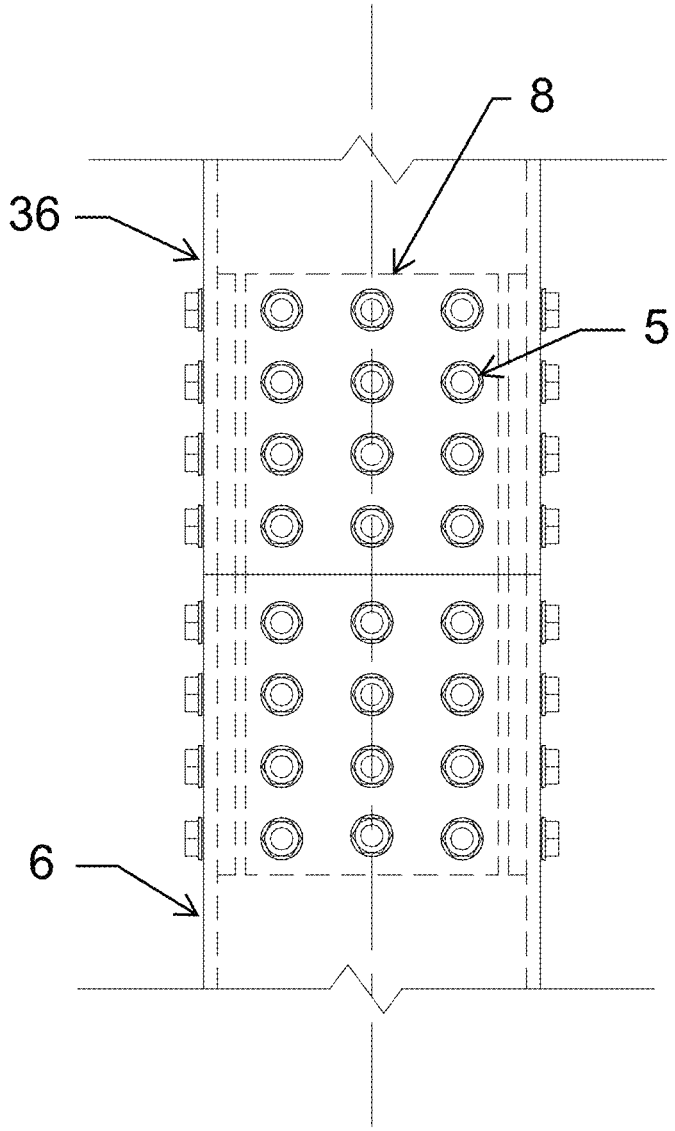
FIG. 61 is an elevation view of column splice detail.

A kit for constructing a multistory building may include one or more preformed support members that are configured to be assembled into a framework for supporting a floor of the mulitstory building and/or a roof of the multistory building that extends in a horizontal plane. As will be apparent, various types of support members may be used without departing from the scope of the invention to support a floor at grade and/or a floor or roof at a height that is spaced apart from grade. FIG. 1 provides an overview of a structural system (e.g., a multistory building comprising a framework and floor deck planks mounted on the framework), including a slab on grade level and an elevated level for illustration purposes. For simplicity, columns are cut above the second floor in FIG. 1. Depending on the number of floors of a specific project, this structural system (broadly, kit) is suitable for constructing multistory buildings by extending columns to roof elevation with column splice connections as shown in FIG. 61. Floor framing above the second floor may be the same as the second floor framing.

In one or more embodiments, steel is used for support members such as columns, trusses, column base plates, slab on grade supporting plates, slab on grade connection plates, and other components of the kit such as column anchor bolts, precast plank connection threaded bolts, precast plank connection channel washers and covers, erection adjusting bolts and coil inserts, embedded plates, shear studs, and various connection plates and bolts. Under certain circumstances, the components may also be formed of materials such as fiberglass reinforced polymer, aluminum, wood, and other materials. In addition, this invention is not limited to the structural component shapes or truss configurations shown in the drawings. Instead, structural members of various shapes and sizes, including various trusses, beams, plate girders, and other types of structural members may be used without departing from the scope of the invention. Trusses also may be arranged differently in each column bay than shown in the drawings. Therefore, it will be understood that various configurations of structural members may be used without departing from the scope of the invention.

In one or more suitable embodiments, a kit includes a plurality of preformed deck planks (e.g., floor deck planks, roof deck planks) that are configured to be arranged side-by-side and mounted on support members assembled as a framework to form a floor or roof of the multistory building. The kit, in certain embodiments, uses solid reinforced precast concrete planks for slab on grade, elevated floor decks, and roof decks. Under certain circumstances, other materials, including but not limited to structural glasses, wood, metal, fiberglass reinforced polymer, and combinations thereof may also be used for slabs and decks within the scope of the invention. In addition, different types of decks, such as pre-stressed concrete planks, hollow core planks, waffle deck, steel composite deck, and other types of decks are also suitable for slab and deck construction within the scope of this invention. Therefore, this invention is not limited to solid concrete planks nor limited in plank size or shape.

The structural system or kit can comprise a plurality of columns supported on traditional foundation systems, a plurality of horizontal trusses, a plurality of planks, and associated connection components. Thus, it is understood that kits of the present invention may include a plurality of preformed support members configured to be assembled together to form a framework. In the illustrated embodiment, several different types of trusses are used in each column bay.

One suitable embodiment of a framework and suitable components therefor will now be briefly described. As indicated in FIG. 1, the framework includes girder trusses 24 connected to columns, divider trusses 25 that are identical to girder trusses except that they are connected to girder trusses (not the columns) at one-third points along the respective girder truss span, side filler trusses 26 that are connected to both girder trusses and divider trusses at one-third points along the respective girder truss and divider truss span, and center filler trusses 27 that are connected to divider trusses at the one-third points along the respective divider truss span. This truss arrangement creates a framework of nine squares in a column bay. As discussed in further detail below, each of the squares in the nine-square arrangement of trusses is configured to mount a plurality of deck planks that are arranged side-by-side on the square. Each square forms a four-sided support for deck planks that form a floor or roof deck (broadly, a floor) of the building. In structural terms, each square defined in the framework provides two-way slab support for the precast planks. Thus, when supported on the nine-square arrangement of trusses, the slabs are stiffer as compared with slabs of the same slab thickness that are supported on two ends only (e.g., one-way slab support). The increased slab stiffness decreases slab deflection under gravity load. Similarly, the slab on grade plank is also supported on four sides for uniform loading criteria in plank design.

Figure 2:
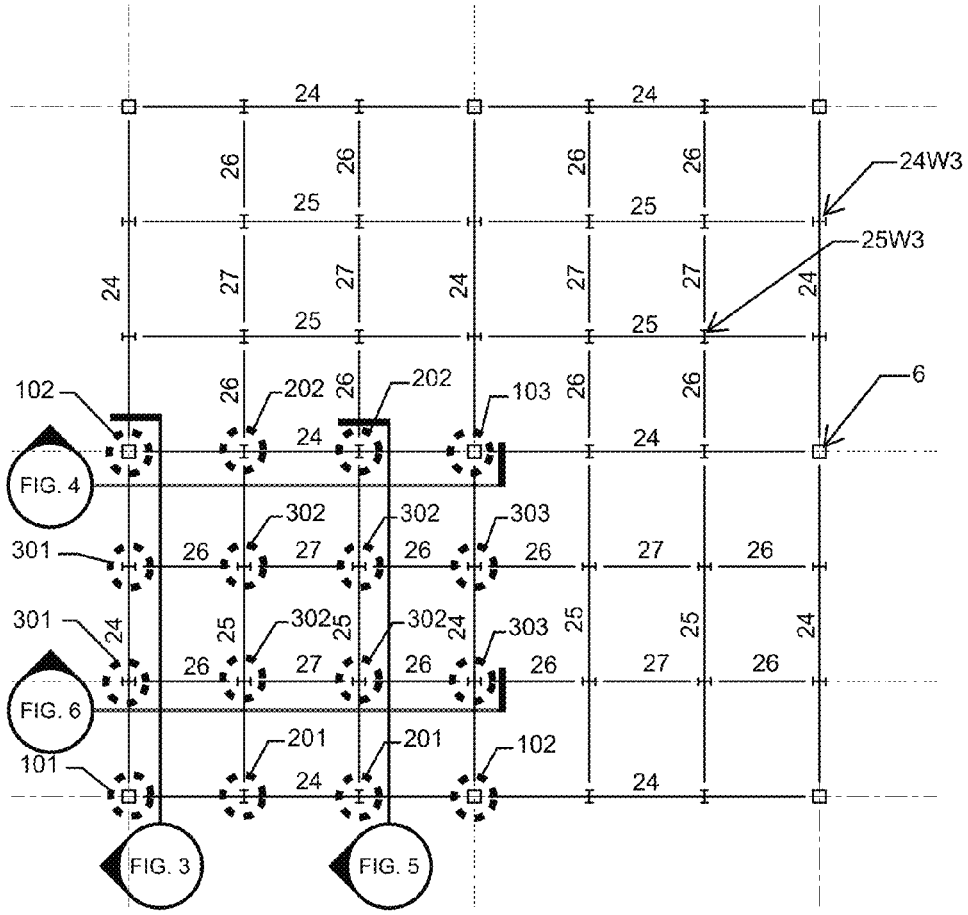
FIG. 2 is a diagrammatic plan view of a two-bay by two-bay framing plan illustrating the layout of plural columns, plural girder trusses, plural divider trusses, plural side filler trusses, and plural center filler trusses.

FIG. 2 is a diagrammatic plan view of a two-bay by two-bay framing plan illustrating the structural layout of one suitable embodiment the invention. Many of the accompanying drawings refer to components of the multistory building construction kit as arranged in the structural layout of FIG. 2. It will be understood that a building may include a framework of support members that is arranged differently without departing from the scope of the invention.

Preformed or onsite assembled connection assemblies 101, 102, 103, 201, 202, 301, 302, 303 may be used to connect the various support members to form the framework. FIG. 2 illustrates girder trusses 24, divider trusses 25, side filler trusses 26, and center filler trusses 27 assembled together using respective connection assemblies 101, 102, 103, 201, 202, 301, 302, 303. In one or more embodiments of a method of constructing a multistory building, after columns 6 are in place, the support members used to form an above grade framework are erected in the following sequence: girder trusses 24 first, then divider trusses 25, followed by filler trusses 26, and lastly floor planks 15. Column connection assemblies 101, 102 and 103 are configured to connect the girder trusses 24 to columns 6. Divider truss connection assemblies 201 and 202 are configured to connect divider trusses 25 to girder trusses 24. Filler truss connection assemblies 301, 302 and 303 are configured to connect the side filler trusses 26 to the girder trusses 24 and divider trusses 25. In one method of constructing the building, the column connection assemblies 101, 102, and 103 are installed before the divider truss connection assemblies 201, 202, and the divider truss connection assemblies 201, 202 are installed before the filler truss connection assemblies 301, 302. As shown in FIG. 2, the orientation of trusses 25, 26 and 27 is flexible. Reference numbers 24W3 and 25W3 generally denote truss web members which are support members that interconnect trusses between the columns 6. For simplicity, only one column 6 and one of each truss web member 24W3, 25W3 are indicated in FIG. 2.

Figure 3:
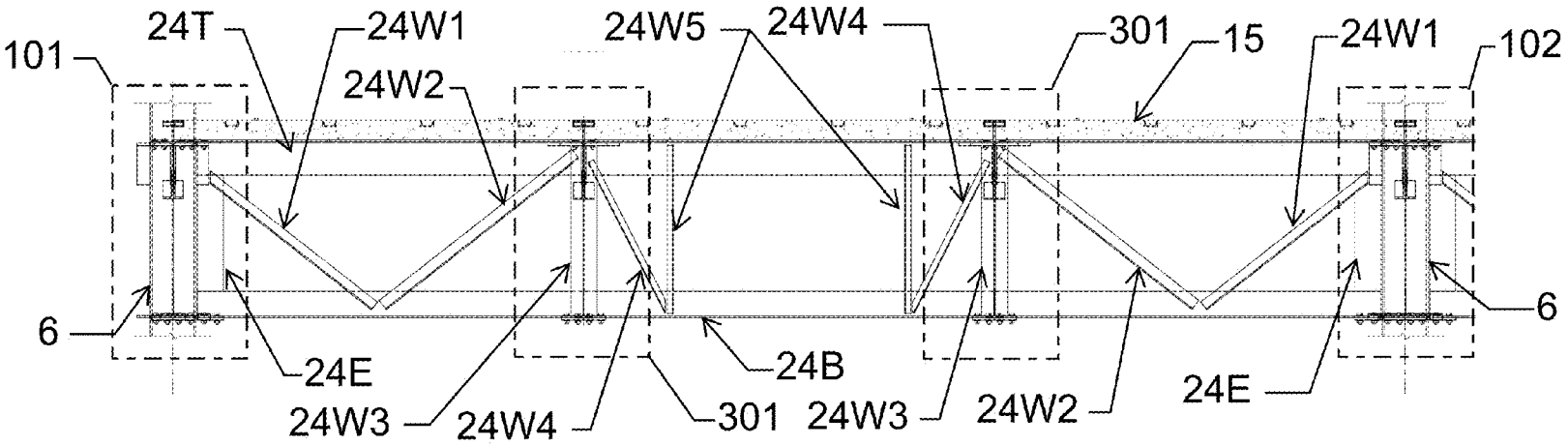
FIG. 3 is an elevation view of structural framing along an exterior column line.

FIG. 3 is an elevation view of floor framing between two exterior columns 6 (i.e., columns 6 which are located on the outside of the framework as shown in FIG. 2) constructed using one embodiment of a building construction kit and according to one embodiment of a building construction method of the present invention. More specifically, FIG. 2 provides an overview of a girder truss 24, an end column connection assembly 101 at one end exterior column 6 (e.g., a corner column as shown in FIG. 2), middle column connection assembly 102 at middle column (e.g., a middle exterior column as shown in FIG. 2), and filler truss connection assemblies 301 connected to the girder truss at one-third points along the girder truss span. As discussed below, the exterior corner column connection assembly 101 is illustrated in detail in FIGS. 13 through 17. Similarly, the exterior middle column connection assembly 102 is illustrated in details in FIGS. 18 through 22, and the filler truss connection assembly 301 is illustrated in details in FIGS. 38 through 43. Girder truss 24 is symmetrical about a center line and comprises a top chord 24T, a bottom chord 24B, a vertical plate 24E at each end that connects the top and bottom chords together, and a series of web members 24W1, 24W2, 24W3, 24W4, 24W5. The vertical web members 24W3 divide the girder truss into three segments and serve as portions of the connecting assemblies for divider trusses 25 filler trusses 26, respectively, as discussed in further detail below. The diagonal web members 24W1 and 24W2 are respectively located at each end of the truss 24, and a pair of vertical web members 24W4 and 24W5 are located adjacent the middle segment of the truss. The orientation of the middle web members 24W4, 24W5 creates a prefabricated open space in the girder truss for mechanical ductwork to pass through without any obstructions.

Figure 4:
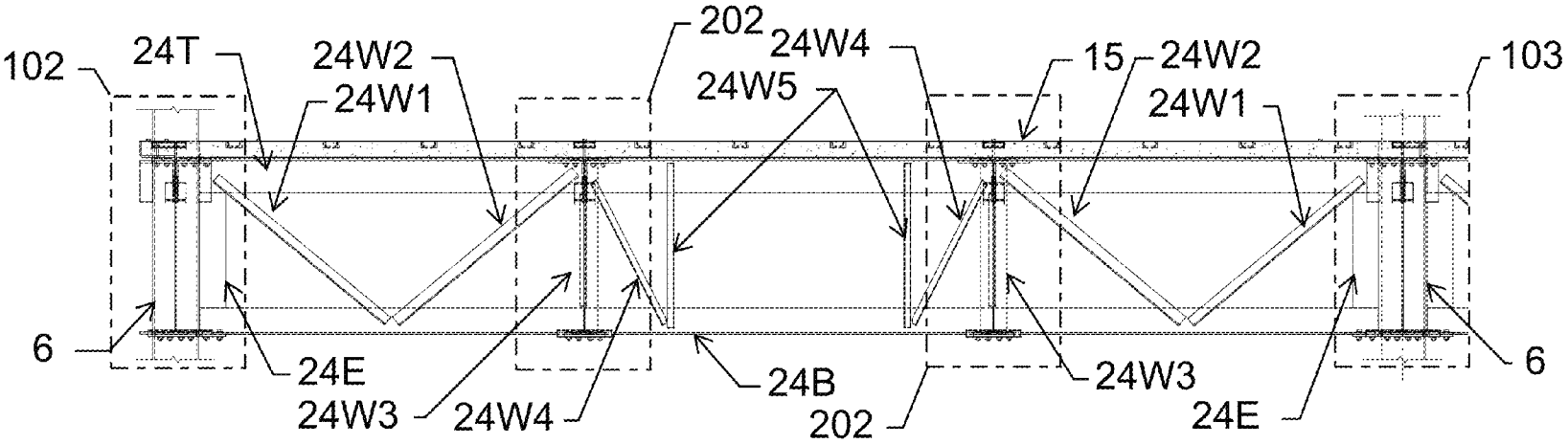
FIG. 4 is an elevation view of structural framing along an interior column line.

Similar to FIG. 3, FIG. 4 is an elevation view along another column line. It shows floor framing between a middle exterior column 6 and an interior column (e.g., a column 6 located in the interior of the framework as shown in FIG. 2). An exterior connection assembly 102 connects another girder truss 24 to the exterior column 6 and an interior connection assembly 130 connects the girder truss to the interior column. Divider trusses 25 and filler trusses 26 are connected to the girder truss 24 at one-third points along the girder truss span using the connection assemblies 202. Exterior connection assembly 102 of FIG. 4 is illustrated in detail in FIGS. 18 through 22. Interior connection assembly 103 of FIG. 4 is illustrated in detail in FIGS. 23 through 27, and connection assembly 202 is illustrated in detail in FIGS. 33 through 37.

Figure 5:
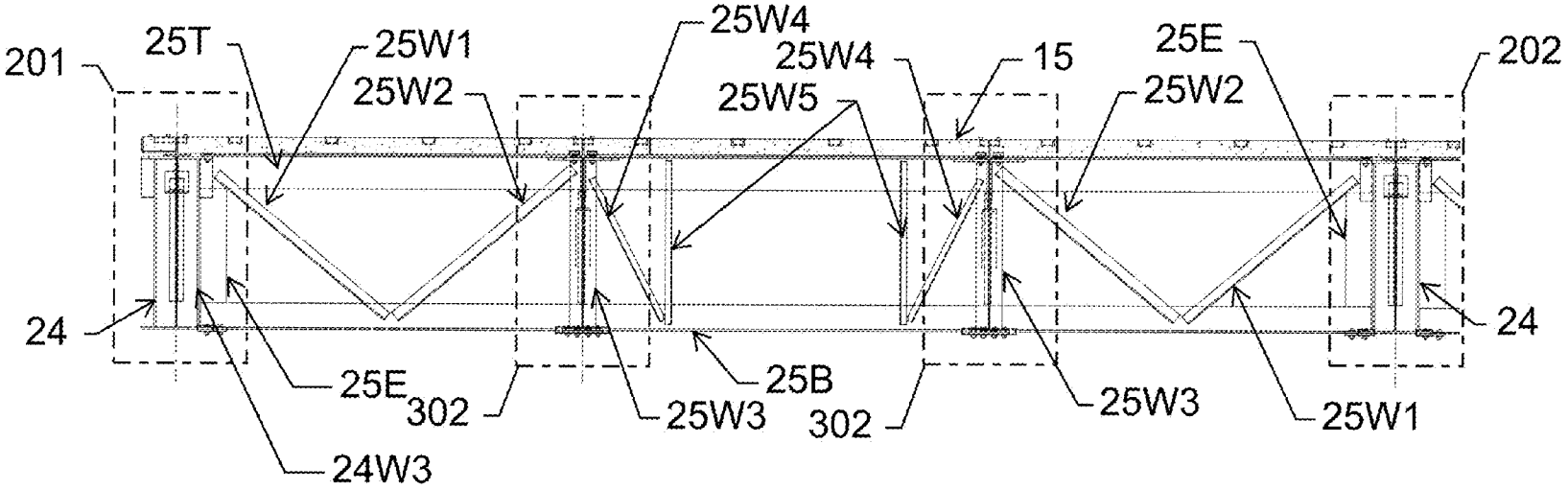
FIG. 5 is an elevation view of structural framing at one-third point of the structural bay parallel to divider trusses.

FIG. 5 illustrates a divider truss 25 and its connection to other internal trusses 26, 27 at one-third points along its length and, at its ends, to the exterior girder truss 24 and the interior girder truss. As stated above, truss 25 is identical to truss 24 except for its location. FIG. 5 provides an overview of a divider truss 25 and the connection assemblies 201, 202 that connect the divider truss to the exterior and interior girder trusses 24, respectively. Filler trusses 26, 27 are connected to the divider truss 25 at one-third points along the divider truss span at the connection assemblies generally indicated as 302. The exterior girder truss connection assembly 201 is illustrated in detail in FIGS. 28 through 32. The interior girder truss connection assembly 202 is illustrated in detail in FIGS. 33 through 37, and the divider truss-to-filler truss connection assembly 302 is illustrated in detail in FIGS. 44 through 48.

Figure 6:
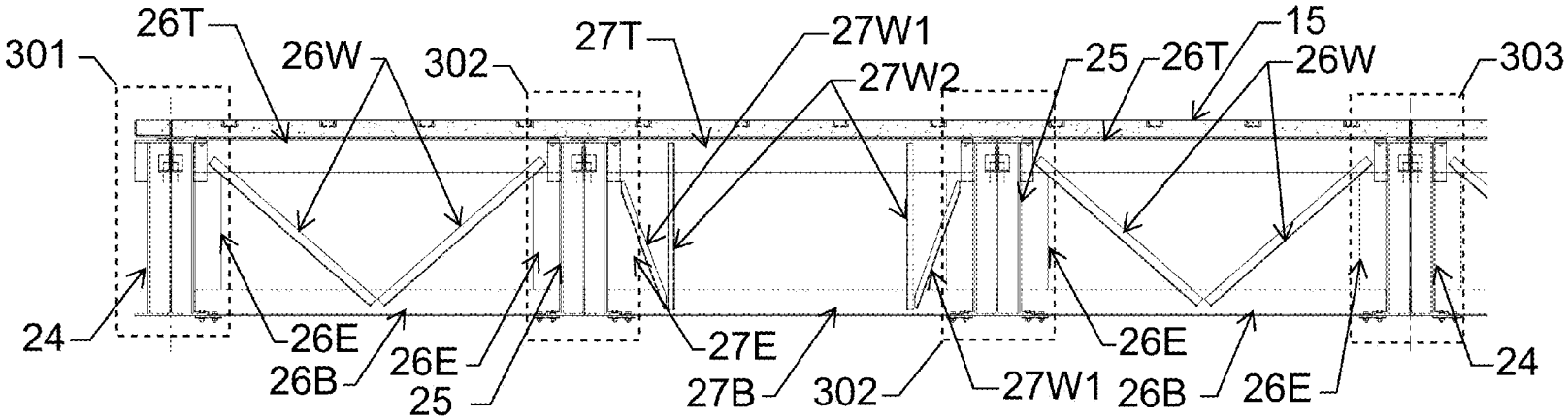
FIG. 6 is an elevation view of structural framing at one-third point of the structural bay parallel to filler trusses.

FIG. 6 is an elevation view of the filler trusses 26, 27 as mounted in the framework shown in FIG. 2. It provides an overview of the connection of the filler trusses 26, 27 to the other trusses 24, 25. Assembly 301 denotes the connection assembly used to connect a side filler truss to an exterior girder truss 24 running perpendicular to the page. The connection assembly 301 is illustrated in detail in FIGS. 38 through 43. Assembly 302 connects the exterior side filler truss 26, the adjacent center filler truss 27, and a divider truss 25 running perpendicular to the page and supporting respective ends of the filler trusses. The connection assembly 302 is illustrated in detail in FIGS. 44 through 48. Assembly 303 connects an interior girder truss 24 running perpendicular to the page to a side filler truss 26 on each side thereof. The connection assembly 303 is illustrated in detail in FIGS. 49 through 53.

Side filler truss 26 comprises of a top chord 26T, a bottom chord 26B, a pair of vertical plates 26E connecting the top chord 26T and the bottom chord 26B together at each end, and a pair of diagonal web members 26W. Comparing the side filler truss 26 with girder trusses 24, it can be seen that the filler truss 26 generally matches the construction of the end segments of girder truss 24 with two diagonal web members.

The center filler truss 27 comprises of a top chord 27T, a bottom chord 27B, a vertical plate 27E at each end of the truss, a pair of diagonal web member 27W1, and a pair of vertical web members 27W2. Thus, the configuration of the center filler truss 27 generally matches the middle segment of the girder truss 24, with the same opening at the center to allow mechanical ductwork to pass through. It shall be understood that the center filler trusses 27 can be connected to divider trusses 25 in the shop (e.g., during manufacturing). The mechanical, electrical, and plumbing systems can be pre-installed within the trusses and shipped to the project site together. Thus field installation complexity can be further reduced.

All the truss web members and connection plates may be shop welded to the truss top and bottom chords in this invention. However, weld connections can be replaced with bolt connections or other suitable connections.

Figure 7:
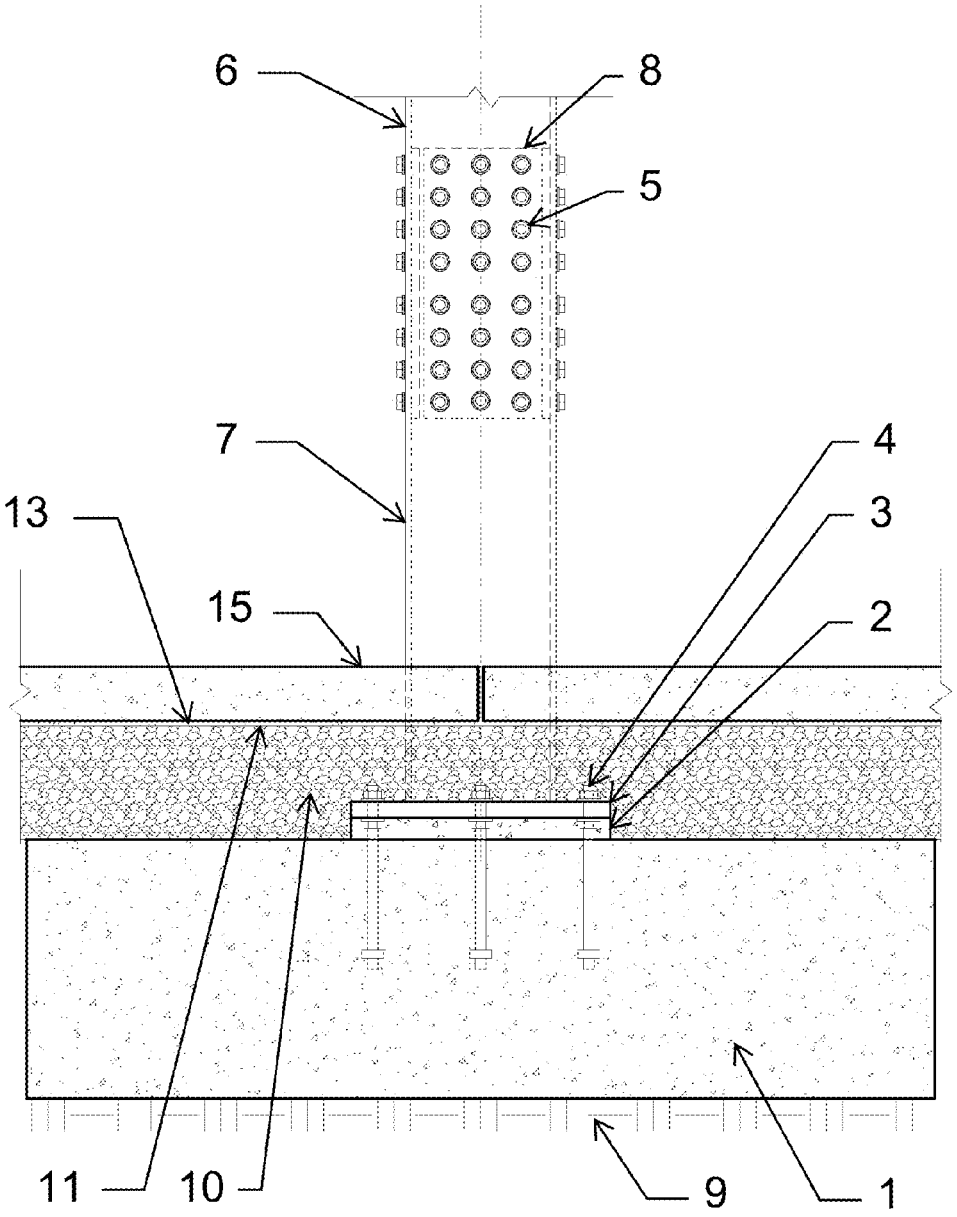
FIG. 7 is an elevation view of column base detail.
Figure 8:
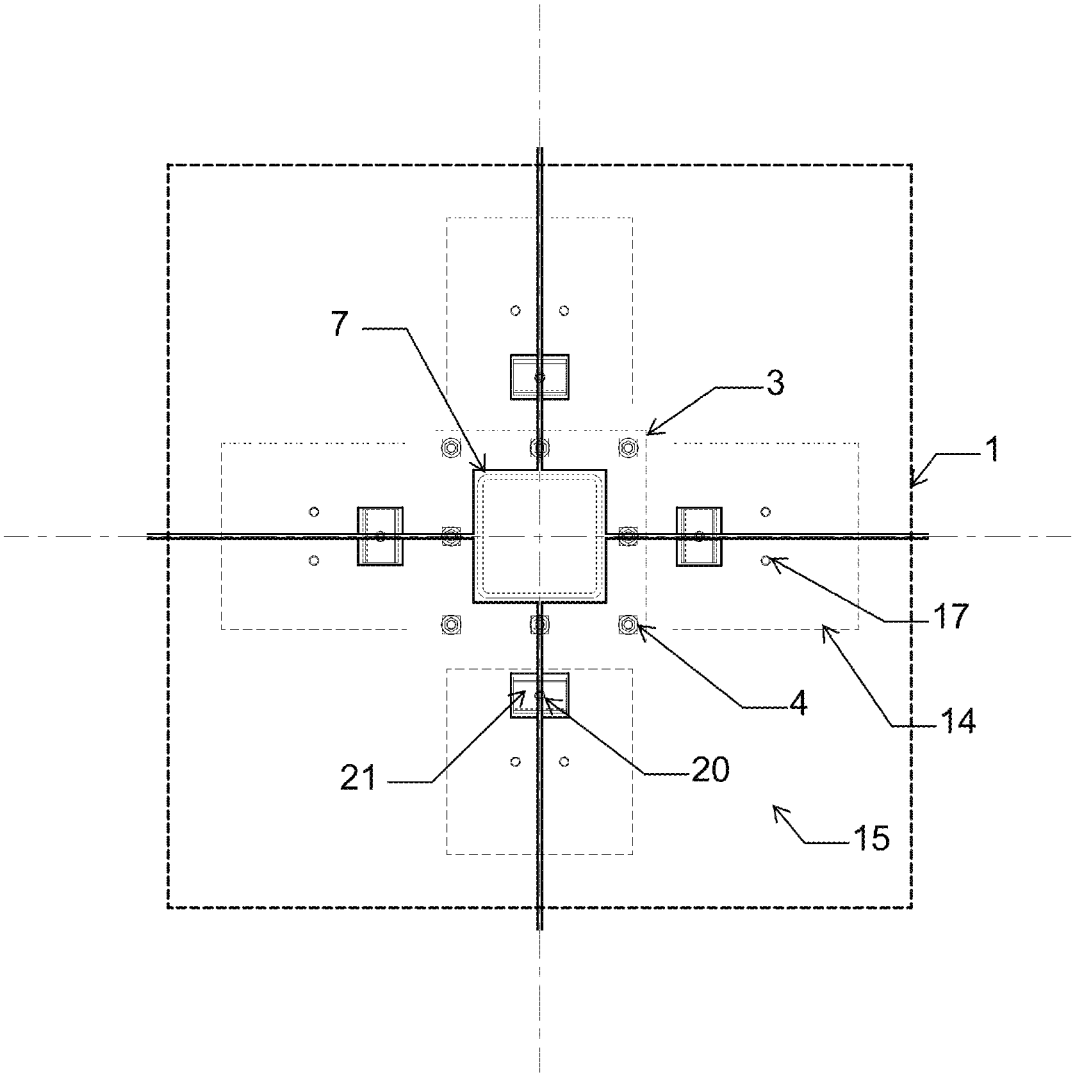
FIG. 8 is a plan view of column base detail.
Figure 62:
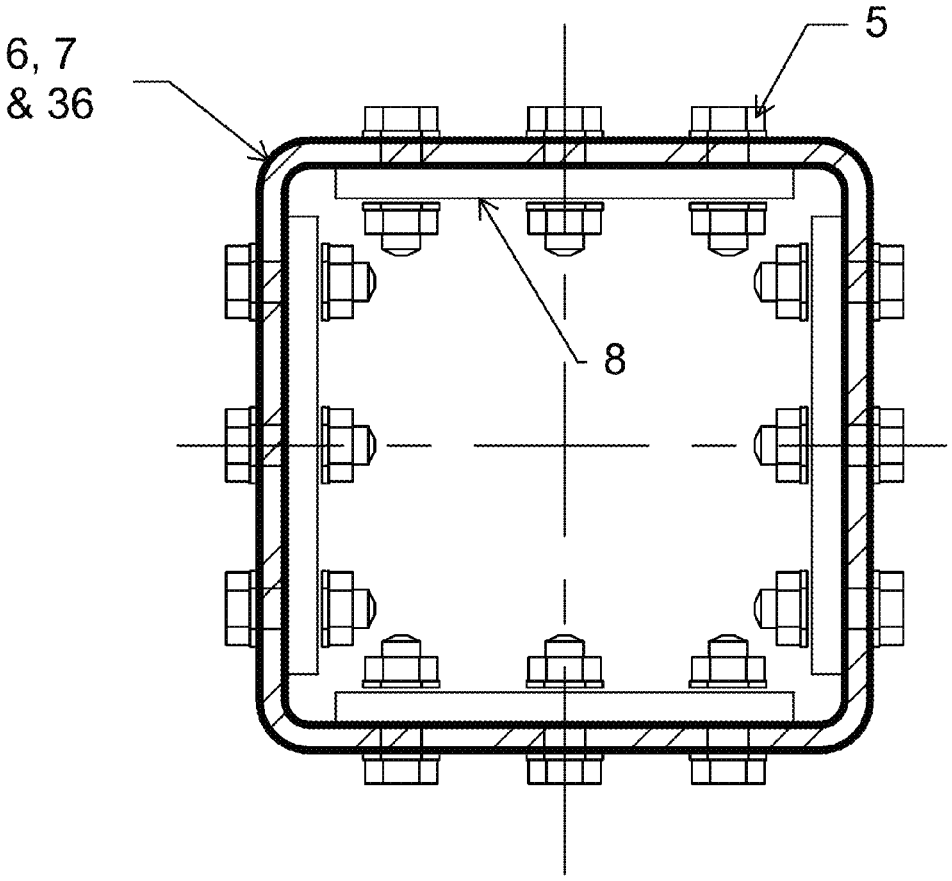
FIG. 62 is a plan view of column splice detail.

FIGS. 7 and 8 are a section and plan view, respectively, of a column base assembly. As shown in FIG. 7, load bearing material 9 is prepared for supporting a traditional foundation construction 1. In the illustrated embodiment, the foundation construction 1 is a spread footing construction, but different foundation constructions can be used without departing from the scope of the invention. Anchor bolts 4 are preset into foundation 1 before concrete is poured. A column base assembly comprising a base plate 3, a stub column 7, and connection plates 8 is preformed (e.g., prefabricated) in a shop by welding the stub column 7 to the base plate 3 and using the bolts 5 to connect the bottom half of plates 8 to the stub column 7. After the concrete of foundation 1 achieves certain strength (e.g., cures a certain amount), the column base assembly is placed and adjusted to plumb and level. High strength and non-shrink grout 2 is poured before anchor bolts 4 are tightened to the column base assembly. Then, the column 6 is erected onto the stub column 7 and connected to the connection plates 8 with bolts 5. FIG. 62 is a plan view of the column splice as seen in FIG. 7, and further illustrates the column splice connection of lower stub column 7 and upper column 6 with the plates 8 and the bolts 5.

Conventionally, concrete slab on grade construction involves cast-in-place concrete. In contrast, in one or more embodiments of the present invention, a slab on grade is constructed with precast planks 15 without cast-in-place concrete, similar to the construction of elevated slab floors discussed below. Referring to FIGS. 9A, 9B, 10 and 11, a method of constructing a grade level floor slab (e.g., a ground floor) in accordance with one embodiment of the present invention will now be briefly described. Although some details of the construction of the floor slabs 15 is provided in this section, further details about the slab 15 are discussed below in reference to their use in above-grade floor slabs. It will be understood that the grade level floor slabs can be the same or different than above grade floor slabs in various embodiments.

As explained below, the illustrated slab on grade floor is constructed by arranging preformed support members (e.g., plates 14, 19) into a framework that is supported on suitably prepared grade, arranging the preformed floor deck planks 15 side-by-side on the framework to form the ground floor, leveling the top surfaces of the floor deck planks, and securing the floor deck planks to the framework. In the illustrated embodiment, a plurality of plates 14 are positioned on prepared grade at selected positions in relation to the side-by-side arrangement of planks 15 that are to be positioned thereupon to form a portion of the framework and for operatively engaging leveling assemblies of the planks as discussed in further detail below. A plurality of plates 19, which support threaded rods 20, are positioned on prepared grade at selected positions in relation to the side-by-side arrangement of planks 15 that are to be positioned thereupon to form a portion of the framework and for operatively engaging clamping assemblies of the planks as discussed in further detail below.

Similar to traditional construction, slab on grade construction may begin with preparation of subgrade 9, for example leveling and properly compacting subgrade as required for the particular building. A granular drainage course 10 is likewise filled and compacted to the required thickness. Then, a vapor barrier 11 is placed on the drainage course 10 to block moisture movement to the slab surface, followed by placement of closed cell foam tape 12. In one or more embodiments, the strips of the tape 12 function as spacers configured to engage the bottom surfaces of the grade level floor deck planks 15 and to define clearance channels 13 between the bottom surfaces of the floor deck planks and the vapor barrier 11. The tape strips 12 or spacers can have a top surface, a bottom surface, and a thickness extending between the top and bottom surfaces. The spacers can be configured to be arranged on grade (broadly, a support surface) so that the bottom surfaces thereof engage grade and the top surfaces thereof engage the bottom surfaces of the floor deck planks 15 when assembled as a floor. As explained below, the tape strips 12, thereby (along with the plates 14, 19) support the floor deck planks in spaced apart relationship with grade, at least partially define leveling channels 13 between the floor deck planks and grade, and receive and contain filler material in the leveling channels for fixing the floor deck planks in the desired position after adjustment thereof.

As explained below, the planks can include clamping assemblies and leveling assemblies that define holes or slots in the planks at various locations. Suitably tape strips are arranged to define clearance channels 13 beneath the assembled planks in fluid communication with the holes and slots in the planks. At least some of the holes or slots may suitably be located adjacent the seams between the assembled floor deck planks 15. In the illustrated embodiment, the tape strips 12 are placed so that, when the floor deck planks 15 are arranged thereupon, adjacent tape strips are spaced apart on opposite sides of each of the seams between adjacent planks in the floor. Thus, the closed cell foam tape 12 defines the clearance channels 13 in substantial alignment with the seams between the adjacent planks 15 once the planks are properly positioned upon the plates 14, 19 as discussed below. As explained below, additional holes/slots may be formed in the planks 15 at centrally disposed locations thereupon, and additional clearance channels may defined by the tape strips 12 in operative alignment with such centrally disposed holes.

Filler material or grout may thus be inserted through the holes and slots in the planks 15 to fill the clearance channels 13 (and, optionally, the plank holes/slots) to maintain the planks 15 in the desired positions on grade as discussed in further detail below. The spacing of the strips of foam tape 12 is determined based on slab load and allowable soil bearing capacity (e.g., based on how much grout is required to securely support the planks 15 on grade). For example, if the slab load is heavy, a larger grouted area for load bearing is required, thus the strips of tape 12 that define a clearance gap should be spaced further apart from one another. In contrast, if the slab load is light, the tape strips 12 can be placed closer together.

Figure 9A:
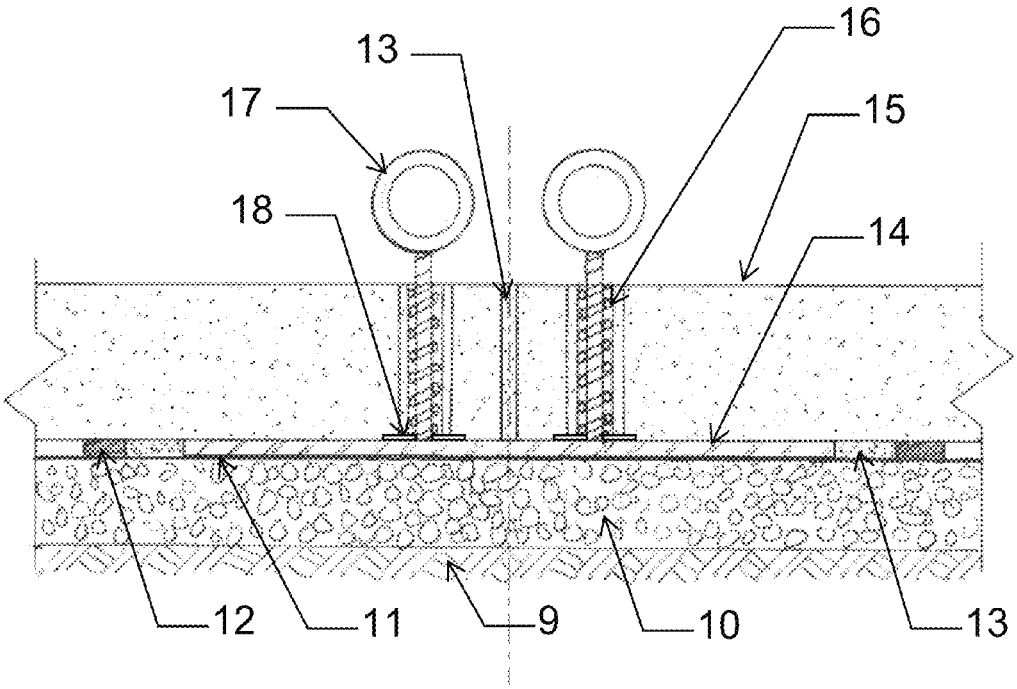
FIG. 9A is a section view of slab on grade plank adjusting mechanism detail. The bolts serve for lifting in transportation and erection, and for adjusting slab elevation and levelness in installation.
Figure 9B:
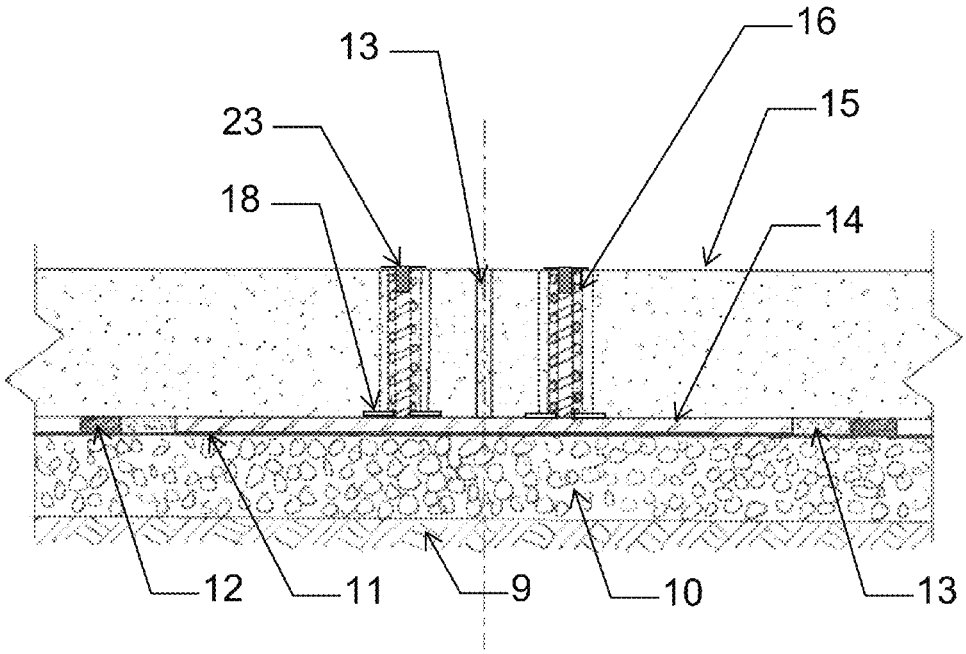
FIG. 9B is a section view of slab on grade plank after the removal of the adjusting bolts.

FIGS. 9A and 9B illustrate a grade level floor deck formed by planks 15 at plank adjusting bolt assemblies thereof (broadly, deck plank leveling assemblies). As explained in further detail below, each adjusting bolt assembly is operatively received in a respective leveling assembly hole extending through the thickness of the respective plank 15 and is configured to selectively adjust the position of the plank with respect to an underlying support surface (in this case, grade) to level a top surface of the respective plank. In the illustrated embodiment, the adjusting bolt assembly comprises a lifting and adjusting bolt 17 (broadly, an adjustment member), a coil insert 16 (broadly, a threaded insert), and a plate 18 embedded in the plank 15 at the bottom surface thereof and to which the coil insert 16 is welded to fix the coil insert to the plank body within the leveling assembly hole. The bolt 17 is threadably received in the insert 16. Underneath the bolt 17 is the steel plate 14, which is typically hot dip galvanized and sized in accordance with the allowable soil bearing pressure of the building project. Carrying at least a portion of the weight of the plank 15, the bolt 17 is placed on the plate 14. The plate 14 distributes load to the drainage course 10 and the subgrade 9. The plank 15 is adjusted up or down to the required elevation by screwing the bolt 17 clockwise or counter clockwise respectively through the coil insert 16.

It will be understood that each plank 15 can include one or more leveling assemblies positioned at spaced apart positions throughout the plank. For example, in one embodiment, the plank 15 includes at least a first leveling assembly positioned adjacent a first side of the plank body and a second leveling assembly positioned adjacent a second side of the plank body, such as a first plurality of leveling assemblies positioned in spaced apart relationship from one another along the length of the plank body adjacent the first side of the plank body and a second plurality of leveling assemblies positioned in spaced apart relationship from one another along the length of the plank body adjacent the second side of the plank body. It can be seen that each of the leveling assemblies of each of the planks can be selectively adjusted to level a top surface of the respective plank 15. More specifically, by threading an adjustment member (e.g., the bolt 17) through a threaded insert (e.g., the coil insert 16), each leveling assembly can be used to adjust the position of the adjustment member along the thickness of the respective floor deck plank 15. The adjustment member 17 engages the support plate 14 to adjust a position of the top and bottom surfaces of the plank 15 with respect to grade. The leveling assembly thereby adjusts a distance between grade (broadly, an underlying support surface) and the bottom surface of the plank 15. By adjusting all of the leveling assemblies in the side-by-side arrangement of floor deck planks 15, the leveling assemblies can adjust the top surfaces of the floor deck planks so that the each extend generally in the same level plane.

After one or more of the planks is properly leveled using the leveling assembly, it can be maintained in the proper position by filling the clearance channel 13 beneath, which is defined by the tape strips 12, with a filler material such as grout. For example, after the plank elevation is adjusted, flowable non-shrink grout is injected into the joint or seam between planks and flows into the clearance gap 13 between foam tape strips 12 under the planks 15. Once the grout 13 has hardened, it distributes the plank load to the soil below. The bolt 17 is no longer needed to bear the load of the plank 15. The bolt 17 may be selectively removable and is suitably removed after the grout has cured. After removal of the bolt 17, a plug 23 may be screwed into the coil insert 16 to cover the leveling assembly hole. Thus, in one or more embodiments, the adjustment member or bolt 17 is removed after the clearance channel 13 is filled with filler material.

Figure 10:
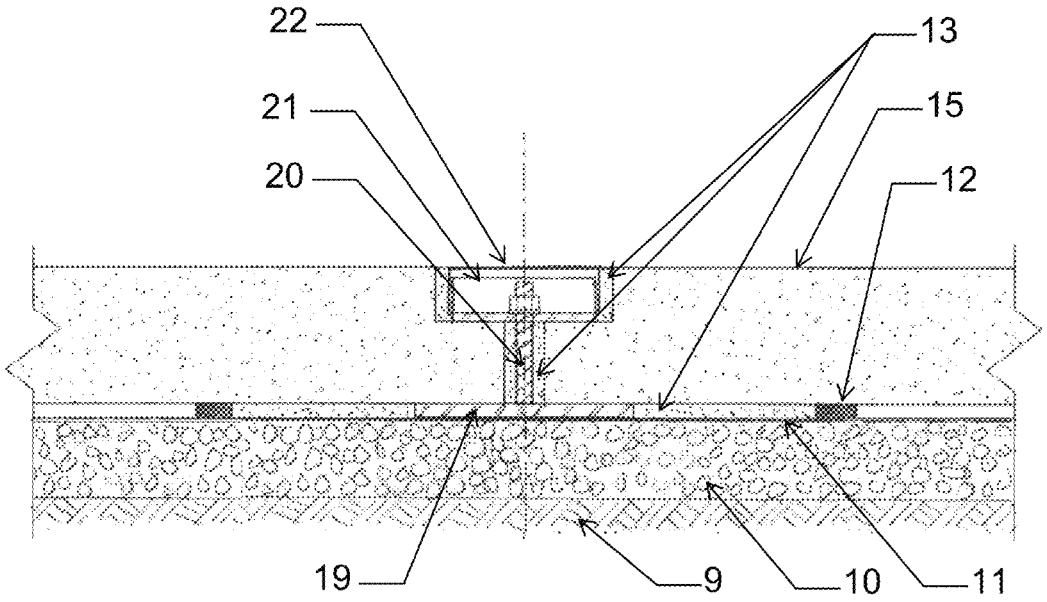
FIG. 10 is a section view of slab on grade construction at plank joint. The detail also applies to the recesses at one-third point of the plank long dimension where plank support is needed for a two-way slab condition.

FIG. 10 illustrates a plank joint connection assembly configured to secure adjacent deck planks 15 in a side-by-side arrangement on grade. The plank joint connection assembly includes a threaded rod 20 that is mounted on the support plate 19 and a clamping assembly configured for operative connection with the threaded rod. When the plates 14, 19 are assembled on grade to form the at-grade support framework, the threaded rods 20 extend away from the plates in a direction transverse to the horizontal plane of the floor. The floor deck planks 15 suitably define slots for receiving the threaded rods 20 therethrough, and the plates 19 are pre-positioned on grade in operative alignment with the slots in the side-by-side arrangement of floor deck planks. Suitably, some of the slots can be located at the seams between adjacent ones of the floor deck planks. Threaded rod receiving slots can also be formed centrally within individual ones of the floor deck planks 15. Suitably, the threaded rods 20 are welded to the plates 19 in the shop and laid at the desired locations on grade before plank erection.

The clamping assemblies are configured to be threadably tightened onto the threaded rods 20 to engage the floor deck planks 14 and thereby hold the floor deck planks in position on the steel plates 14, 19 (broadly, on the framework). In the illustrated embodiment, each clamping assembly comprises a nut and a washer 21. The nut is configured to be threadably tightened onto a respective threaded rod to thereby urge the washer 21 against a clamping surface of the floor deck planks adjacent the respective rod-receiving slot. In the illustrated embodiment, the washer 21 is channel washer, but other kinds of washers may also be used without departing from the scope of the invention. Suitably the clearance slot is countersunk to receive the channel washer 21 therein so that no portion thereof extends above the top surfaces of planks 15 when tightened against the planks. For example, as shown in the drawings, each clamping assembly slot can comprise a top portion that is wider than a lower portion thereof so that the slot defines an upwardly facing clamping surface for opposingly engaging the channel washer 21. Moreover, the threaded rods 20 and clamping assembly slots are suitably sized and arranged so that the free ends of the threaded rods are positioned beneath a floor deck plane defined by the top surfaces of the adjacent floor deck planks 15 mounted on the framework of plates 14, 19.

As discussed above, a clearance gap 13 defined by the closed cell tape 12 extends along the joint or seam between adjacent planks 15. After the plank 15 is leveled using the leveling assemblies and the steel channel washer 21 is tightened down against the threaded rod 20 to clamp adjacent planks in place, the seam between the adjacent planks can be filled with a filler material such as grout. In the illustrated embodiment, the clamping assembly slot is shaped and arranged to define a clearance gap about the threaded rod 20 received therein. The clearance gap and clearance channels 13 are in fluid communication with one another. Both are filled with the grout to prevent the floor deck planks 15 from shifting out of position. A sheet metal washer cap 22 covers the washer 21 to prevent grout from getting to the channel washer 21. Flowable non-shrink grout is injected into the joints or seams between planks into the clearance channels 13 between foam tape strips 12 under planks.

Thus, it can be seen that in one suitable method of assembling a slab-on-grade floor in a building, preformed support members such as the plates 14, 19 are positioned on grade to form a framework. Floor deck planks 15 are arranged side-by-side on the framework to form the floor and so that the threaded rods 20 mounted on the plates 19 extend through the clamping assembly slots in the side-by-side arrangement of floor deck planks. Suitably, the planks 15 are positioned so that the top surfaces thereof are generally level within the same plane and the bottom surfaces thereof are spaced apart from grade to define (along with the tape strips 12) the clearance channels 13. In one embodiment, the leveling assemblies are adjusted to level the top surfaces of each of the floor deck planks 15. After leveling, the channel washers 21 are clamped against the clamping surfaces of the floor deck planks 15 at the clamping assembly slots by threading the nuts onto the threaded rods 20. Suitably, the channel washers are positioned below the top surfaces of the floor deck planks. When the planks 15 are clamped in place, the clearance gaps between adjacent planks and between the planks and threaded rods are filled with filler grout, and the clearance channels 13 beneath the planks are likewise filled with filler grout to maintain the planks in the desired positions on grade.

Figure 11:
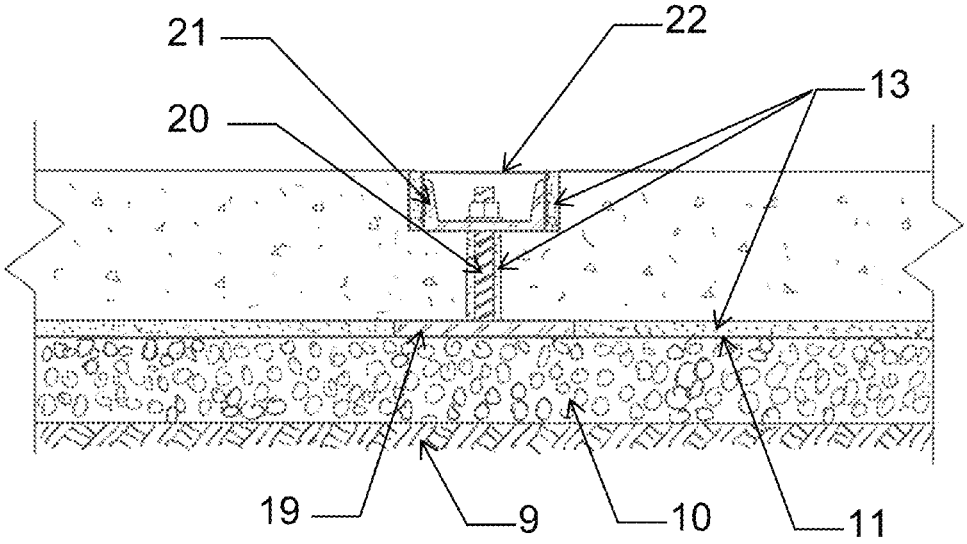
FIG. 11 is a section view of slab on grade construction at plank joint perpendicular to section in FIG. 10.

FIG. 11 is a section view perpendicular to the section in FIG. 10 and further illustrates the plank joint connection detail seen in FIG. 10.

Figure 12:
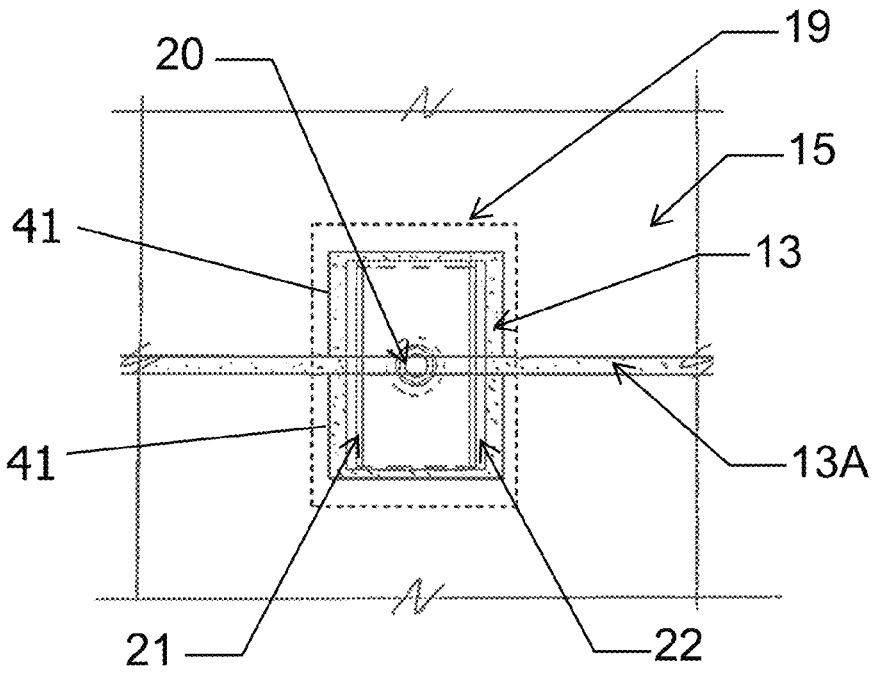
FIG. 12 is a plan view of slab on grade construction at plank joint.

FIG. 12 is a plan view of the plank joint connection seen in FIGS. 10 and 11. As shown in FIG. 1, partial recesses 41 are formed at spaced apart locations along the side edges of each of the planks 15 in the grade level floor. When the planks 15 are positioned in side-by-side engagement with one another, the partial recesses 41 of adjacent planks align to form clamping assembly slots sized for receiving the channel washers 21 therein. FIG. 12 shows a portion of two side-by-side planks 15 where respective partial recesses 41 are aligned. As shown in FIG. 1, partial recesses 41 are also formed at spaced apart locations along the ends of the planks 15 in the illustrated embodiment. If desired, planks 15 can be arranged end-to-end so that the partial recesses 41 of adjacent planks 15 align to form respective clamping assembly slots. In the illustrated embodiment, a plurality of centrally located clamping assembly slots are also formed in each plank 15 at spaced apart locations along the width of the plank at one-third points along the length of the plank.

Having described one suitable embodiment of a grade level slab construction, the discussion will now turn to a discussion of the construction of framing for floors that are spaced apart above grade (e.g., a superstructure construction). In one or more embodiments, a superstructure is erected on the columns 6. As seen in FIG. 7 and discussed above, each column 6 extends up from column stub 7 below. After the columns 6 in a column bay are erected, floor trusses can be subsequently erected at each frame assembly as described below.

Figure 13:
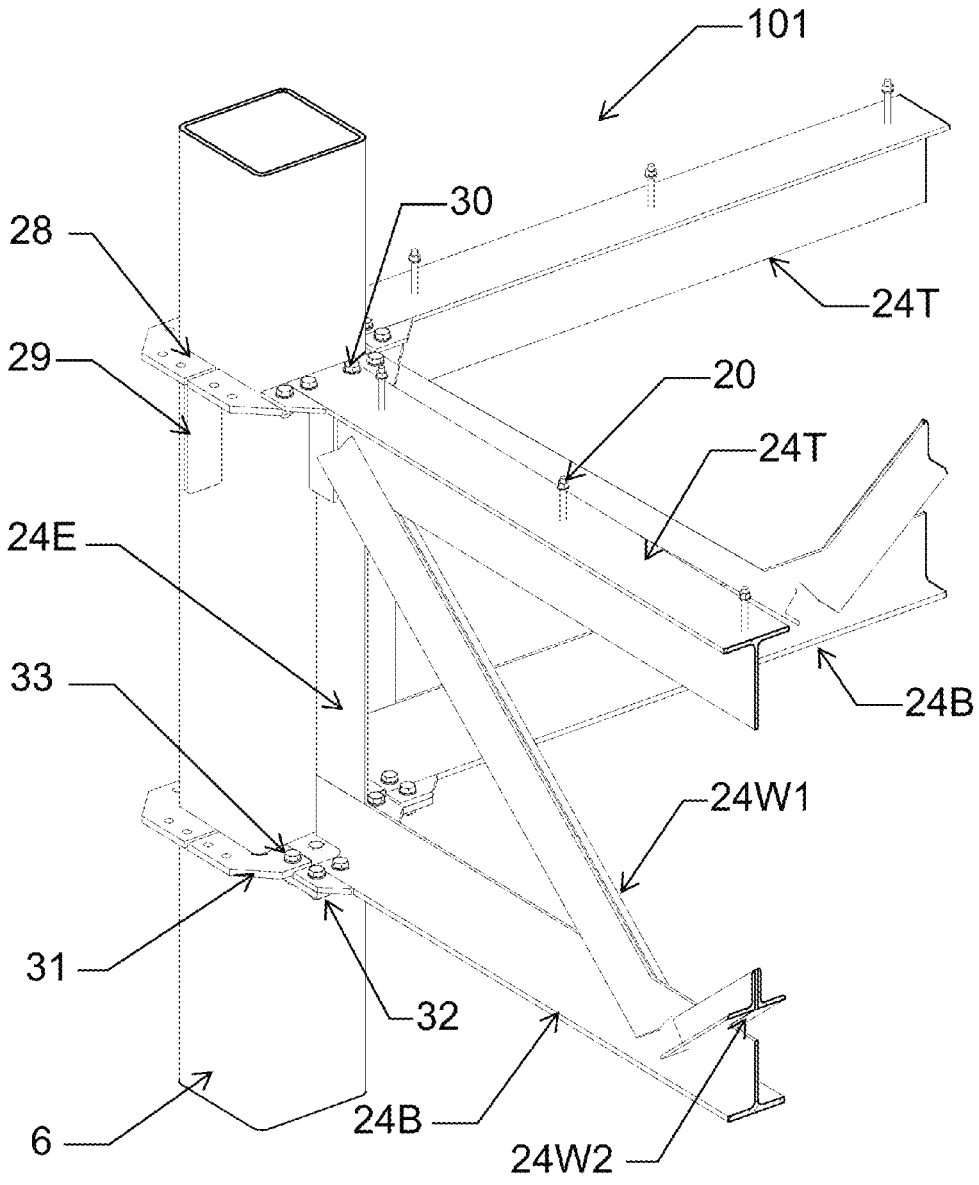
FIG. 13 is a perspective view above assembly 101 illustrating the corner column assembly in the present invention.
Figure 14:
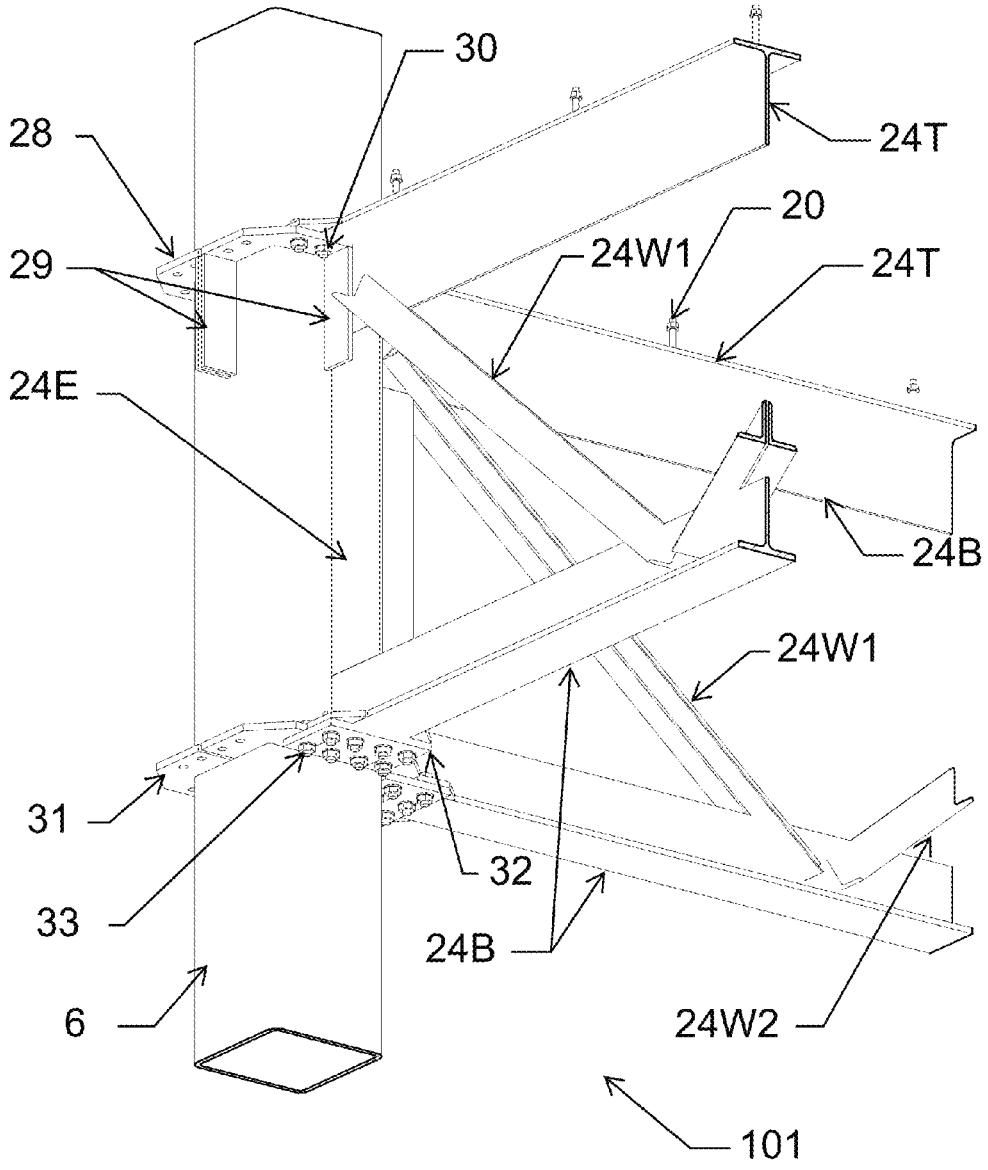
FIG. 14 is a perspective view below assembly 101, further illustrating the corner column assembly in the present invention.

FIG. 13 is a perspective view of the framing connection assembly 101 as noted in FIG. 2 and FIG. 3. FIG. 14 is a perspective view from the bottom of the same assembly 101. As seen in FIGS. 13 and 14, the assembly 101 is a corner column connection assembly for connecting two exterior girder trusses 24 to a corner column 6 at respective top chords 24T and bottom chords 24B. Threaded rods 20 are typically welded to the truss top chords 24T in the shop along the center line of the truss 24 at locations where the precast planks 15 will be connected to the trusses for a composite structure. As explained in further detail below, the same or similar planks 15 may be used to form both the second story floor discussed below and the grade-level floor discussed above. It will thus be appreciated that, like the plates 14, 19 and threaded rods 20 of the grade-level framework, the above grade framework comprises a plurality of support members (e.g., the trusses 24, 25, 26, 27) that are assembled together to form the above grade framework and on which threaded rods 20 are mounted for threadably engaging clamping assemblies for securing the floor planks 15 to the assembled framework.

Figure 15:
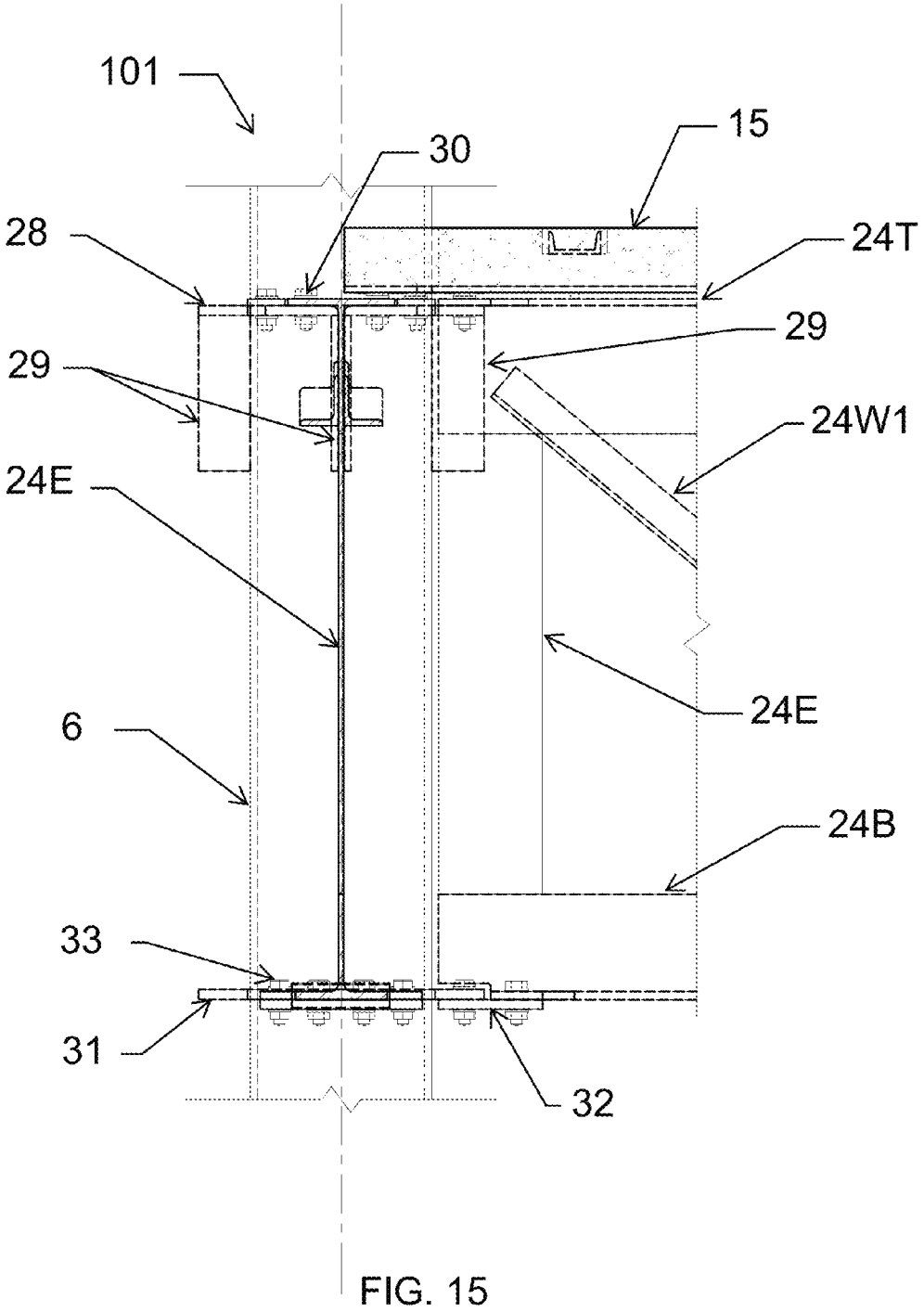
FIG. 15 is a section view of assembly 101.

FIG. 15 is a section view of the connection assembly 101. As seen in FIG. 15, the connection assembly 101 is a truss to column moment connection. The seated connection provides vertical support, and the top and bottom chords 24T, 24B are bolt connected to the column with plates 28, 31 and 32. Top chord bolts are noted as 30 and bottom chord bolts are noted as 33 throughout the figures.

Figure 16:
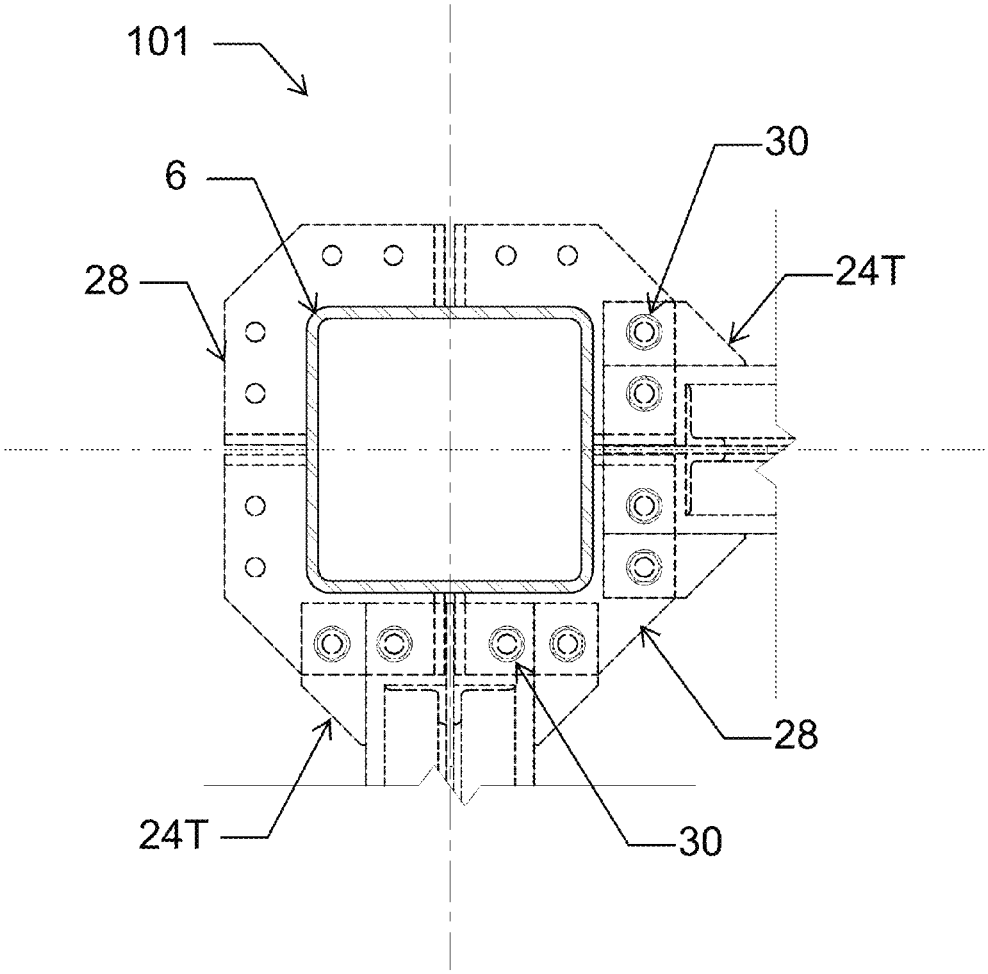
FIG. 16 is a plan view of truss top chord to column connection at assembly 101.
Figure 17:
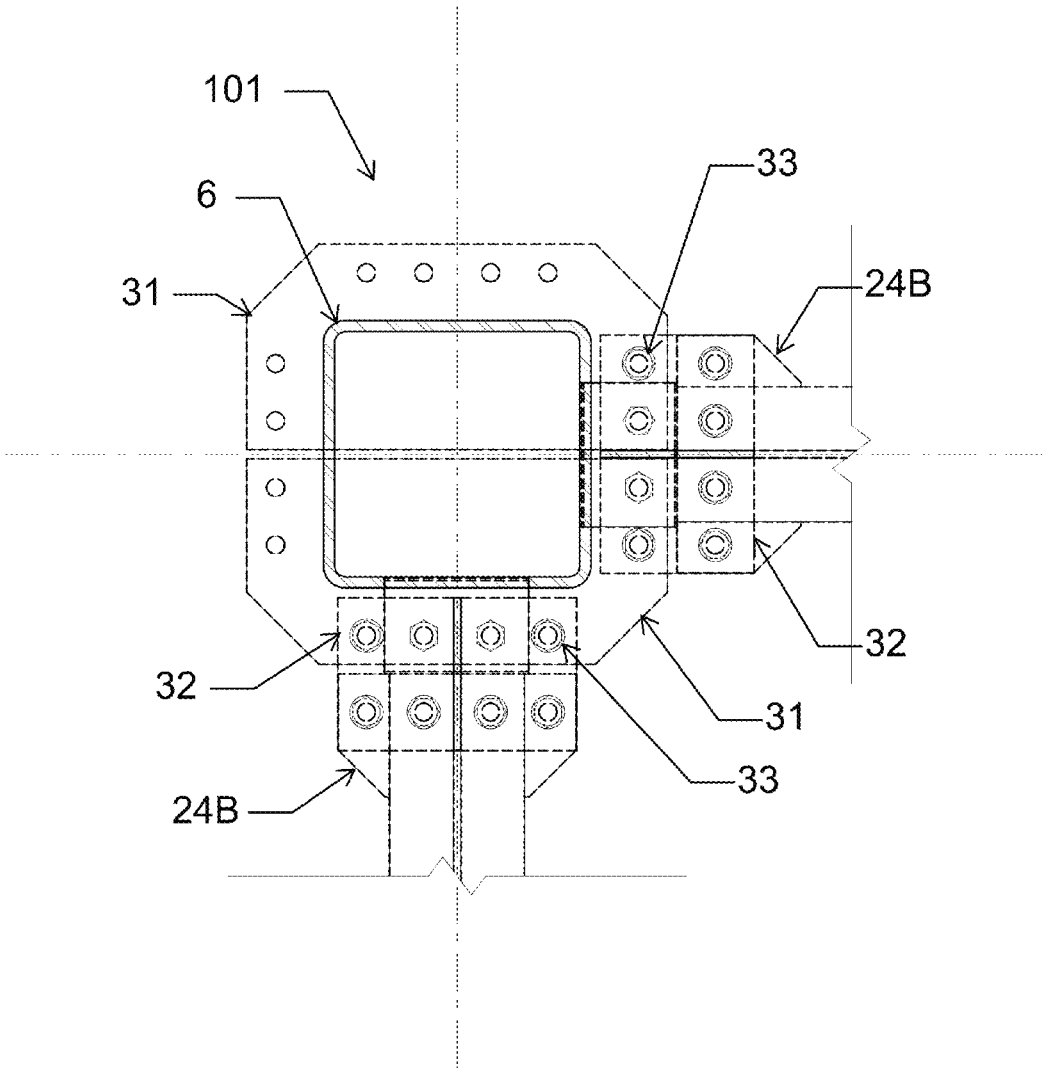
FIG. 17 is a plan view of truss bottom chord to column connection at assembly 101.

FIG. 16 and FIG. 17 are plan views of the exterior corner column connection assembly 101 at the top chord connection and at the bottom chord connection respectively. For a traditional stiffened seated connection, the seat plate is a continuous plate on the top with a single stiffener plate underneath. To both support gravity load and act as a moment connection for lateral force resistance, the illustrated connection assembly 101 is a split seated connection assembly. As seen in FIG. 16, a top ring plate around column 6 is cut into four plates 28 to create a split seat on each side of the column 6 with a slot between the stiffener plates 29. At the elevation of the bottom of the flange of the top girder truss chord 24T, the plate 28 is welded to the column 6 horizontally and supported at each side of the slot by the stiffener plate 29. Plate 29 is welded to column 6 vertically on the sides as well as to plate 28 horizontally on the top. All the pates may suitably be shop welded. A bottom ring plate shown in FIG. 17 is cut into two plates 31, as shown in FIG. 14, for fabrication purposes. Each plate 31 is suitably welded to the column 6 horizontally in the shop at an elevation matching the bottom chord 24B. Since the truss vertical load is supported by the split seated connection at the top chord 24T, only horizontal forces occur at the connection of the bottom chord 24B to the column 6. Plate 32, located under chord 24B and ring plate 31, connects the bottom cord 24B and the ring plate 31 together with bolts 33. To prevent trusses from being laterally twisted during the shipping and handling process, plate 24E is welded to the top chord 24T and the bottom chord 24B at both ends of truss 24. Additionally, a flange of the bottom chord 24B is coped to the width of plate 24E so the erection can work as intended. It is worthy to note that it is suitable to extend the stiffener plate 29 to plate 31 or have a row of bolts to connect to truss plate 24E vertically. It will be understood that a column connection assembly can have other configurations without departing from the scope of the invention.

During erection, truss 24 is placed by sliding the end of the truss down through the split seated connection. Thus the top chord 24T bears on ring plate 28 for vertical support, the crane can be released for next lift right away. With minimal adjustment for alignment, bolts 30 at the top chord 24T and bolts 33 at bottom chord 24B are installed. The erectors can then move on to next connection. Thus it can be seen that the connection assembly 101 simplifies the framing installation process, and the installation time can be shortened.

As seen in FIG. 16 and FIG. 17, outwardly facing connections at the two exterior faces of column 6 are left open. Such connections, which are unused for floor framing, may suitably be used for exterior wall construction. With panelized wall systems, wall panels can be properly supported on the seated connections at the truss top and bottom chord elevations. Thus, in one or more embodiments, the column connection assembly 101 can be used to connect various components of the building to the column.

Figure 18:
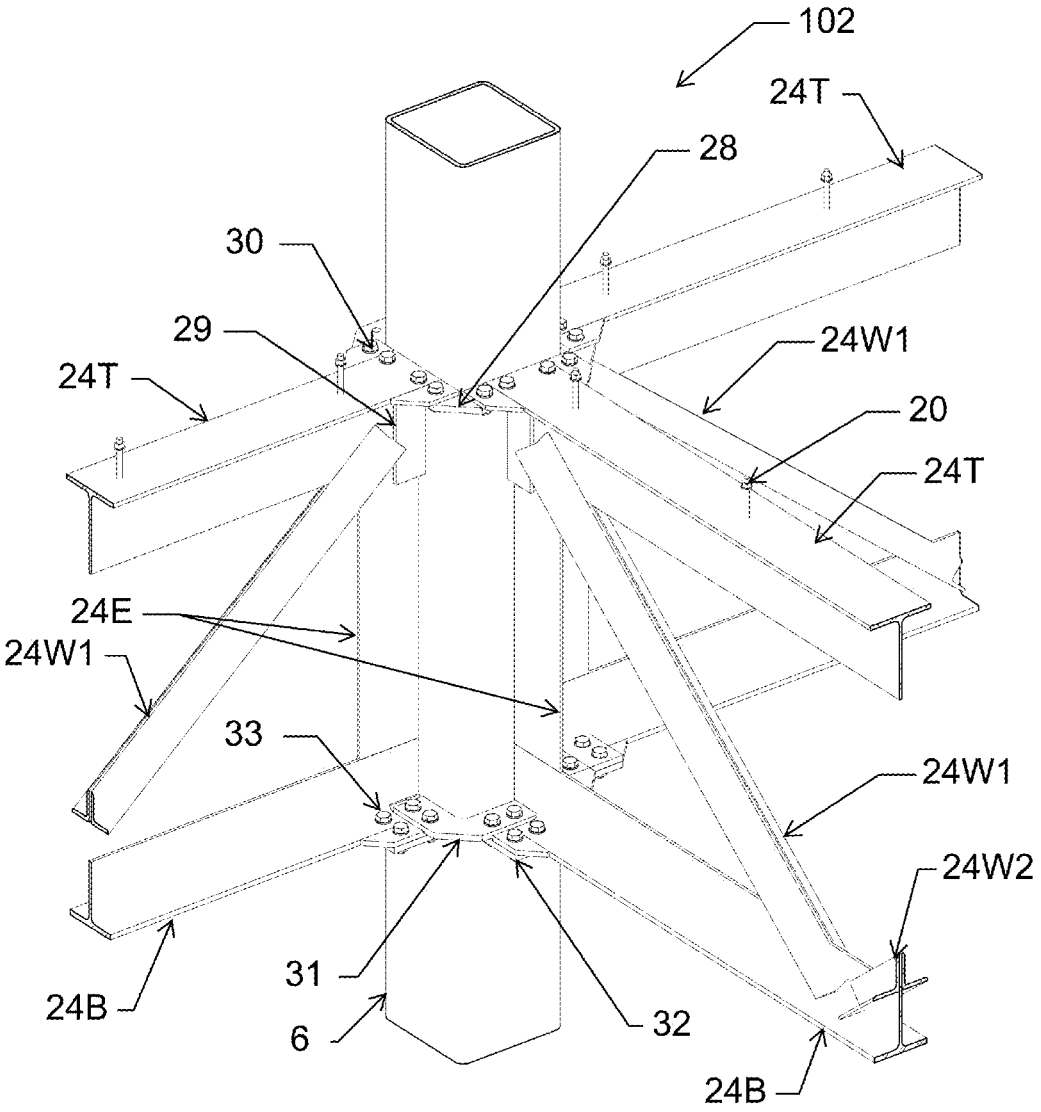
FIG. 18 is a perspective view above assembly 102 illustrating the exterior middle column assembly.
Figure 19:
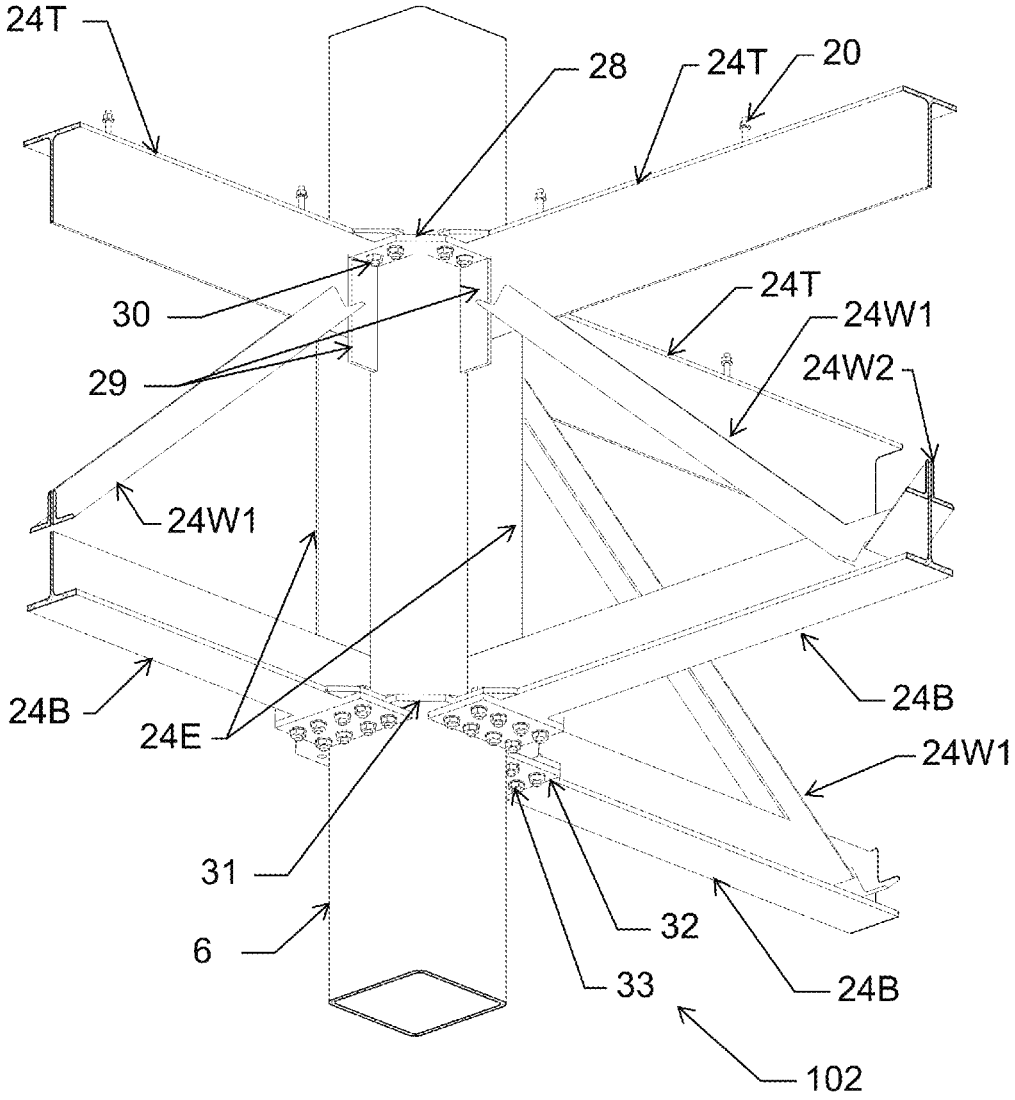
FIG. 19 is a perspective view below assembly 102, further illustrating the exterior middle column assembly.
Figure 20:
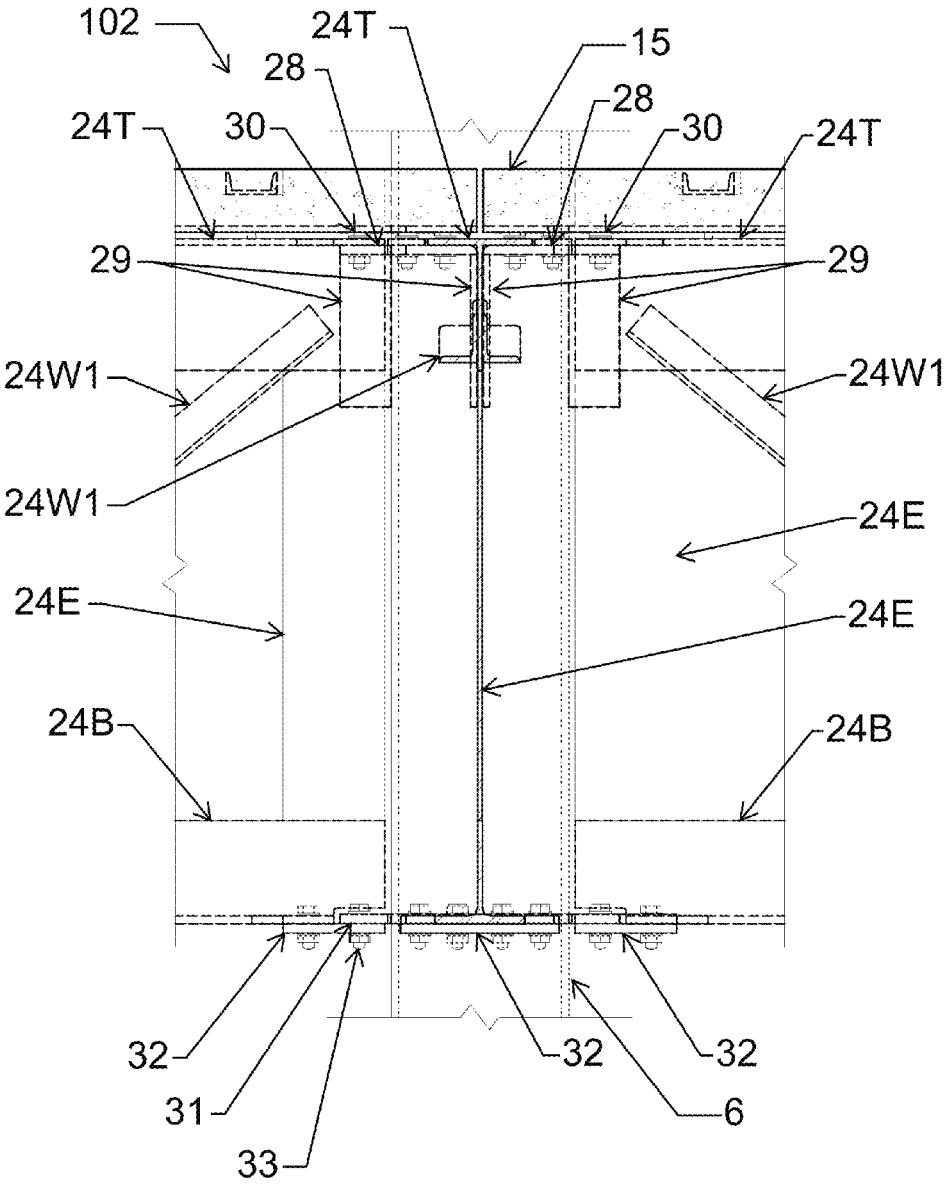
FIG. 20 is a section view of assembly 102.

FIGS. 18 and 19 are perspective views of the central exterior column connection assembly 102 as noted in FIG. 2 and FIG. 3. The assembly 102 is similar to assembly 101 except that assembly 102 is in the middle of the exterior framing, where three girder trusses 24 are connected to a column 6. FIG. 20 is a section view of assembly 102. Three trusses 24 are shown connecting to column 6 with the same split seated connection assembly described above in reference to the connection assembly 101.

Figure 21:
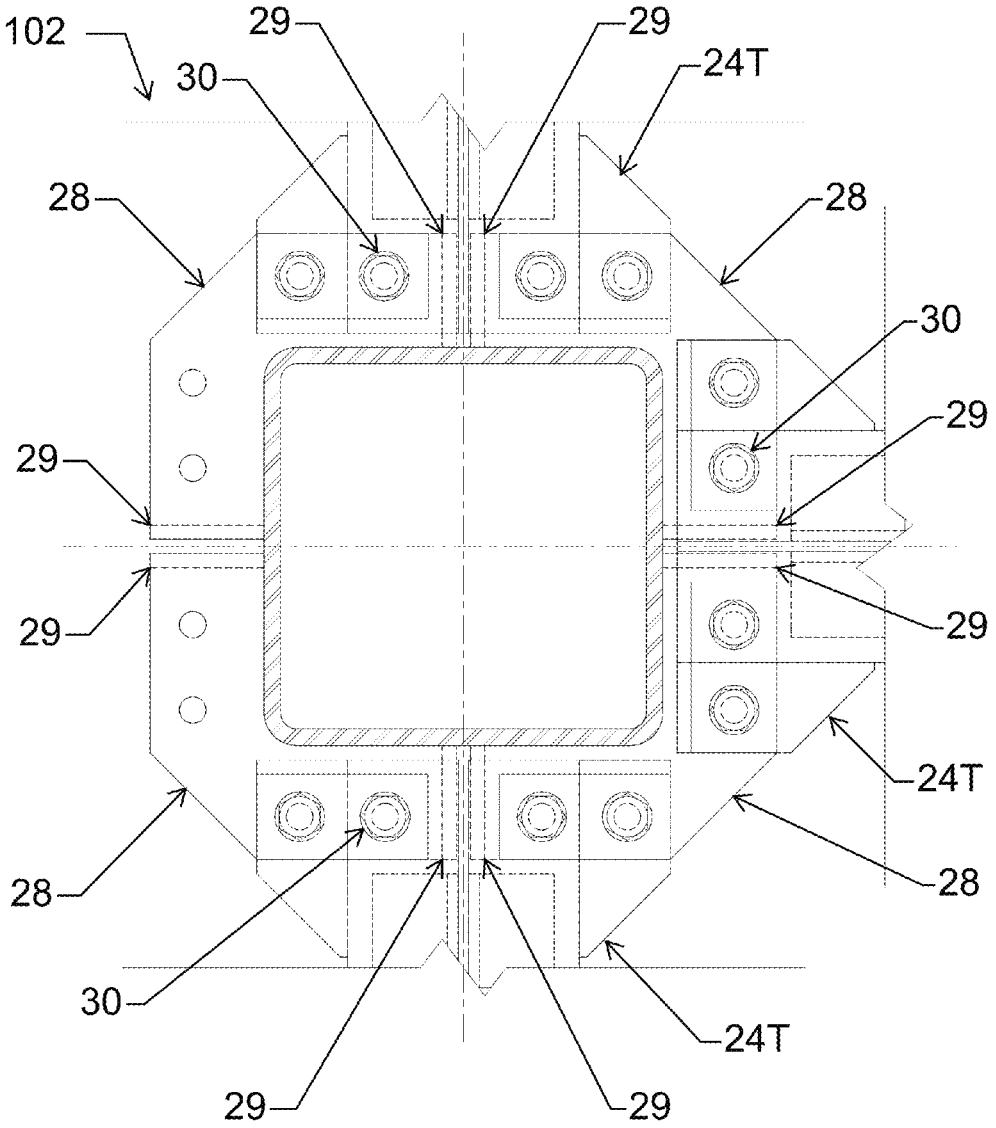
FIG. 21 is a plan view of truss top chord to column connection at assembly 102.

FIG. 21 is a plan view of assembly 102 illustrating the connections of the top chords 24T of each of the trusses 24 to the column 6 in detail. All three connections are identical in the illustrated embodiment. The girder truss-to-column connection uses four bolts 30 in one or more embodiments. Depending on project specific requirements, more or fewer bolts may be needed. Bolt size and number of bolts may vary without departing from the scope of the invention. Modification of the connection plate can be easily accommodated for a project specific need.

Figure 22:
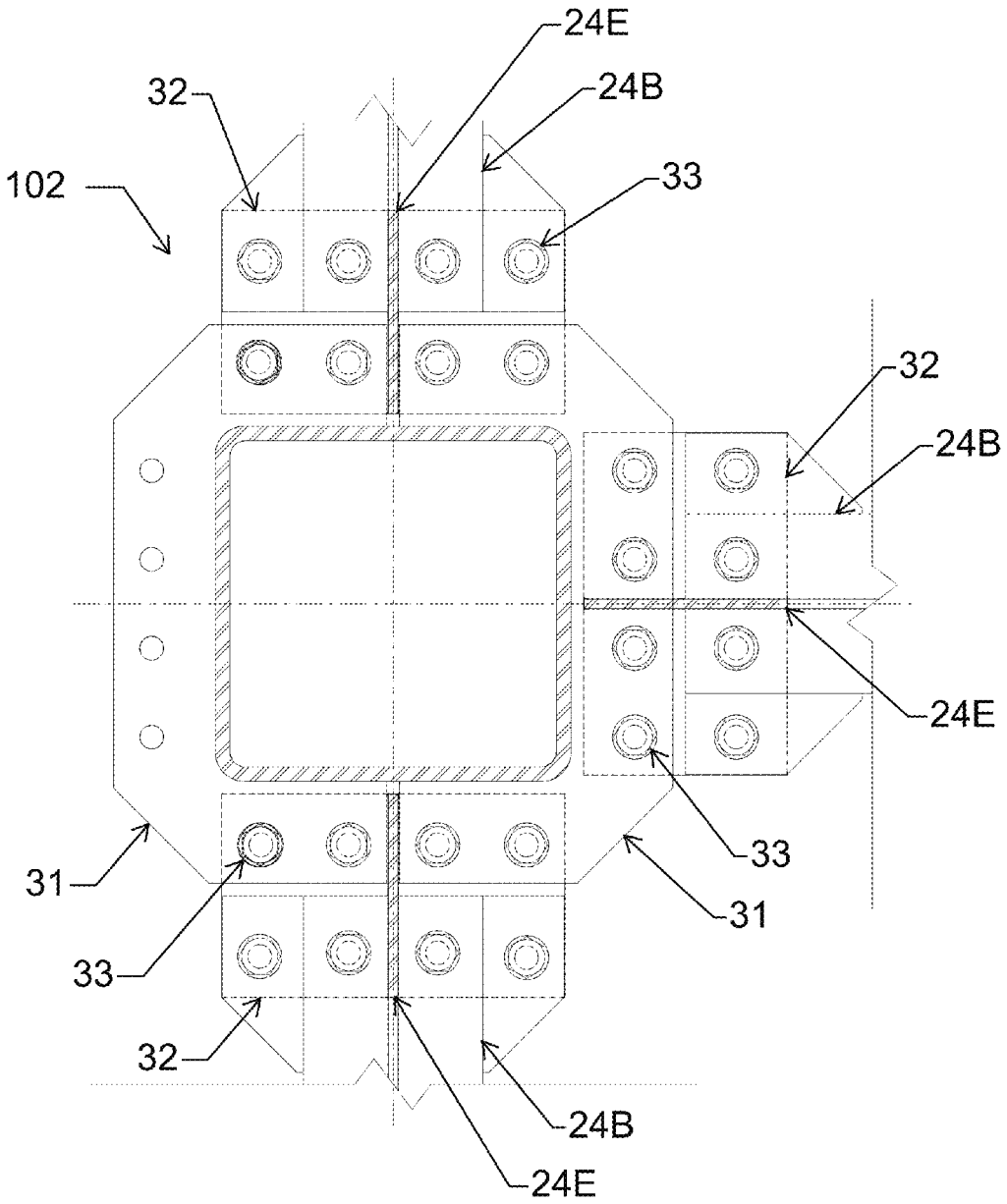
FIG. 22 is a plan view of truss bottom chord to column connection at assembly 102.

FIG. 22 is a plan view of assembly 102 illustrating the connections of the bottom chords 24B of each truss 24 to the column 6 in detail. A plate 32 is installed under each plate 31 and bottom chord 24B to receive a total of eight bolts 33, four on the truss side and four on the column side at each truss to column connection.

As discussed above for assembly 101, at the exterior face of column 6, the seated connection is not used for structural framing but may be used for exterior wall support.

Figure 23:
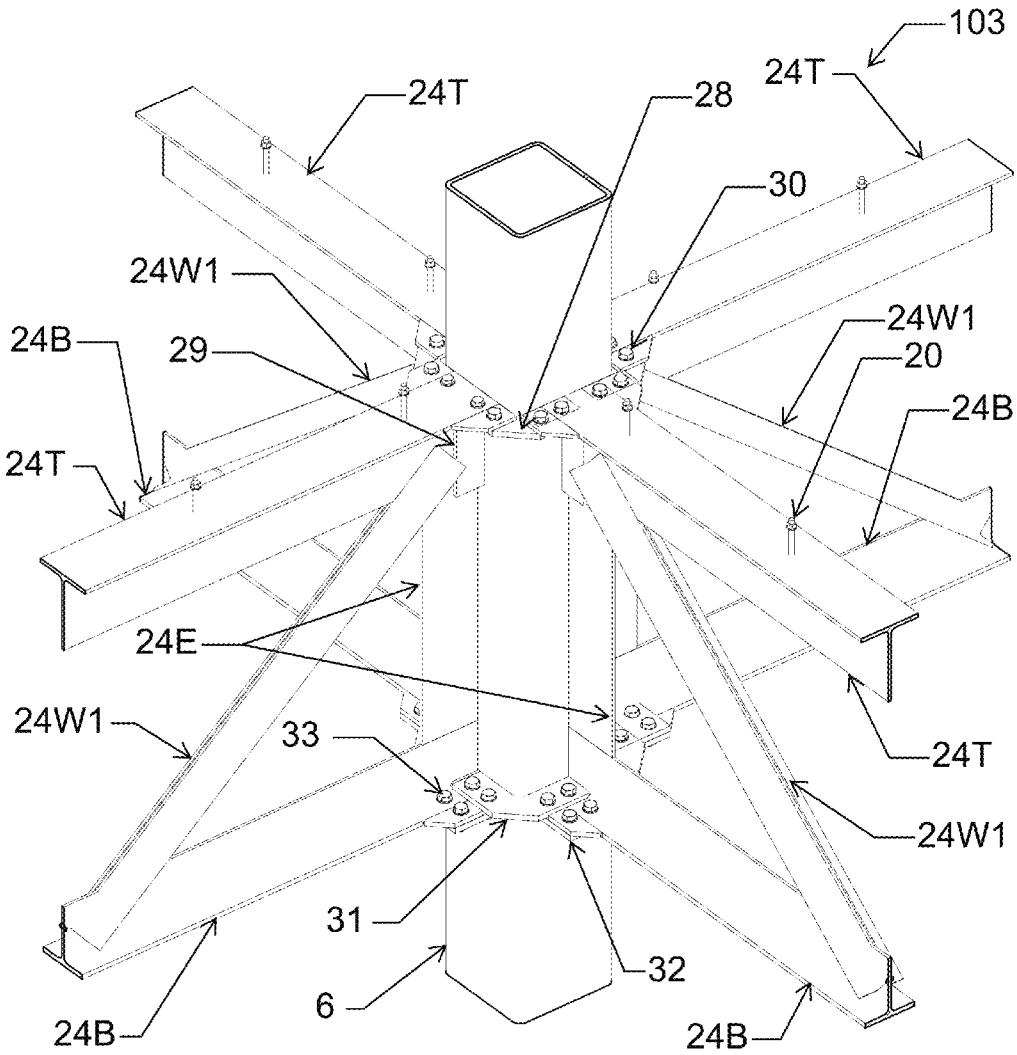
FIG. 23 is a perspective view above assembly 103 illustrating the interior column assembly.
Figure 24:
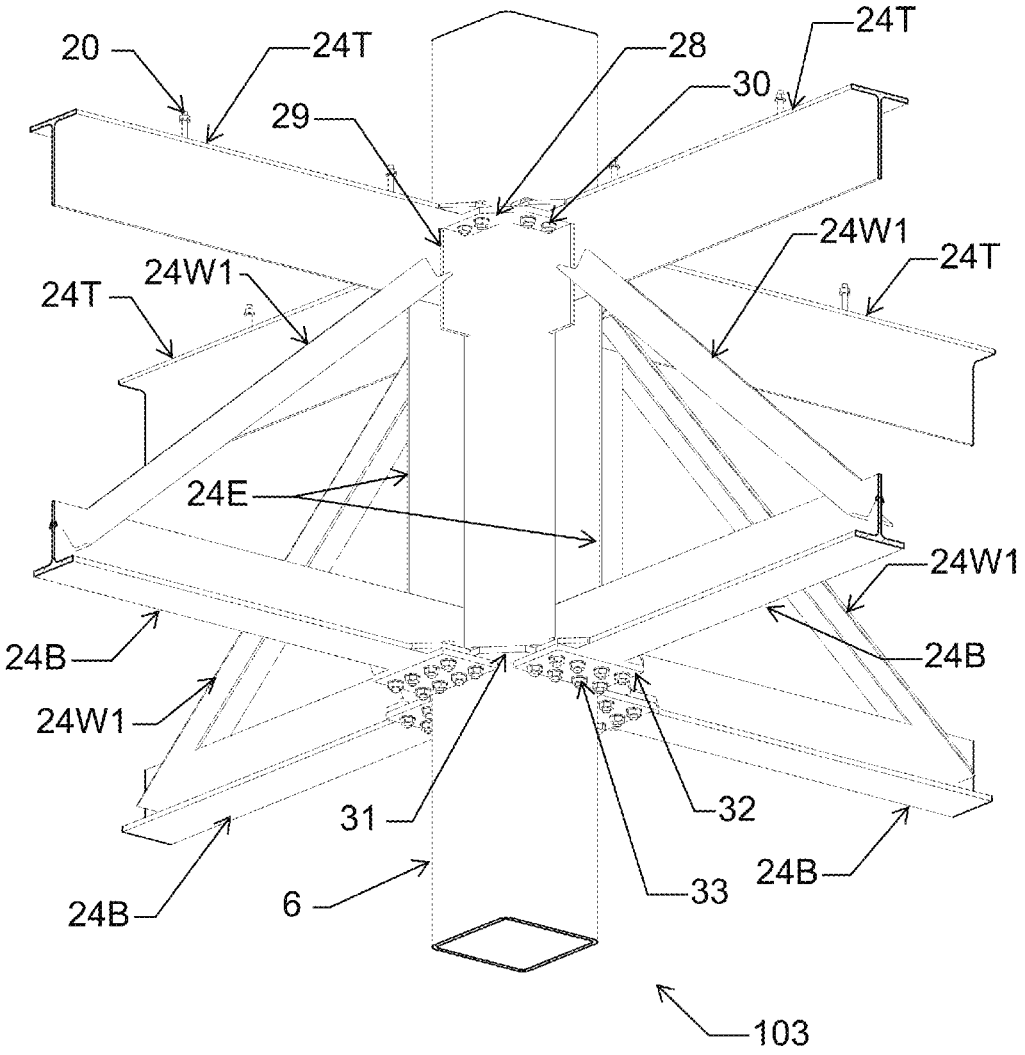
FIG. 24 is a perspective view below assembly 103, further illustrating the interior column assembly.

FIGS. 23 and 24 are perspective views of the interior column connection assembly 103 as noted in FIG. 2 and FIG. 4. It is similar to assembly 102 except that assembly 103 is at an interior column, where four girder trusses 24 are connected to the column 6.

Figure 25:
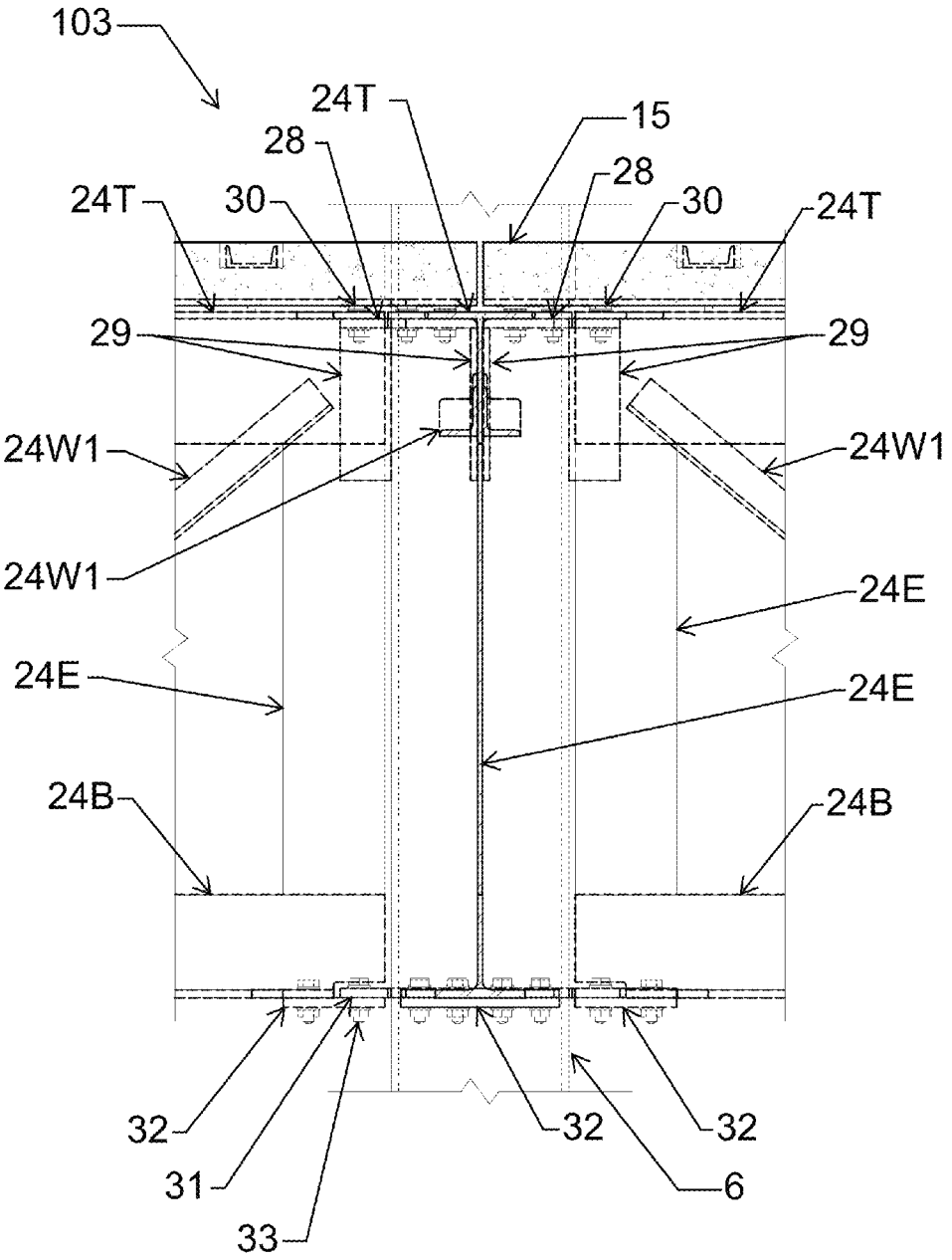
FIG. 25 is a section view of assembly 103.

FIG. 25 is a section view of assembly 103. Trusses 24 are shown connecting to column 6 with the split seated connection assembly.

Figure 26:
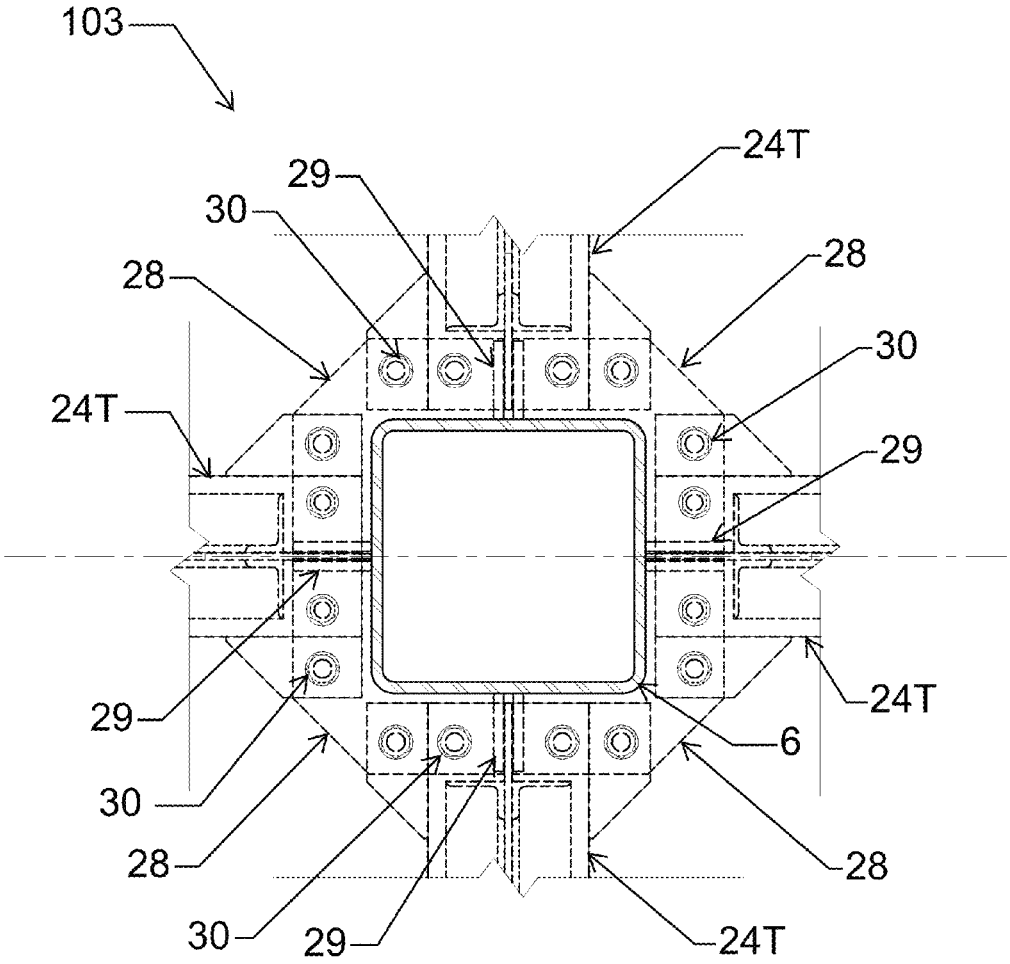
FIG. 26 is a plan view of truss top chord to column connection at assembly 103.

FIG. 26 is a plan view of assembly 103 illustrating the connections of the top chords 24T of trusses 24 to the column 6 in detail. Again, all four connections are identical. Four bolts 30 are used in each truss 24 to column connection. As discussed above, modification to the connection plate and number of bolts can be easily accommodated for specific needs of a project.

Figure 27:
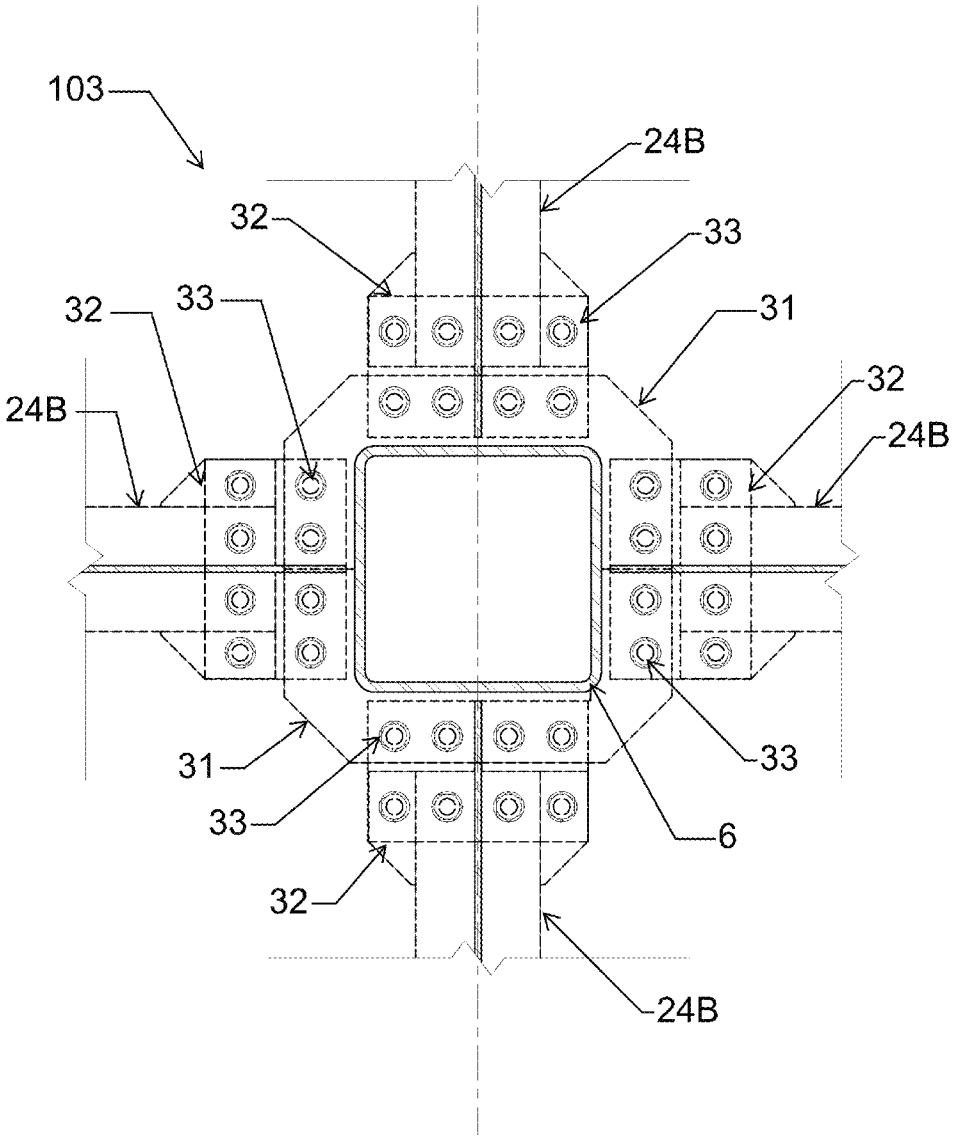
FIG. 27 is a plan view of truss bottom chord to column connection at assembly 103.

FIG. 27 is a plan view of assembly 103 illustrating the connections of the bottom chords of the trusses 24 to the column 6 in detail. Again, plate 32 is installed under plate 31 and bottom chord 24B to receive a total of eight bolts 33, four on the truss side and four on the column side at each truss to column connection.

As will be appreciated, the interior column connection assembly 103, the central exterior column connection assembly 102, and the corner exterior column connection assembly 101 have substantially identical constructions in the illustrated embodiment. This is thought to simplify manufacturing of the components of the kit for constructing the multistory building by using the same assembly in multiple ways and for multiple purposes.

Following the erection of the girder trusses 24 (i.e., after mounting the girder trusses on the column), divider trusses 25 are erected to divide the column bay into three rectangular areas. As discussed above with respect to the girder trusses 24, threaded rods 20 are shop welded to the top chords 25T of the divider trusses 25. Like the girder trusses 24, the divider trusses 25 form a portion of a second story framework for supporting the floor deck planks 15 of the second story, and the threaded rods 20 are shaped and arranged to be operatively received in clamping assembly slots when the floor deck planks are arranged side-by-side to form the second story floor.

Figure 28:
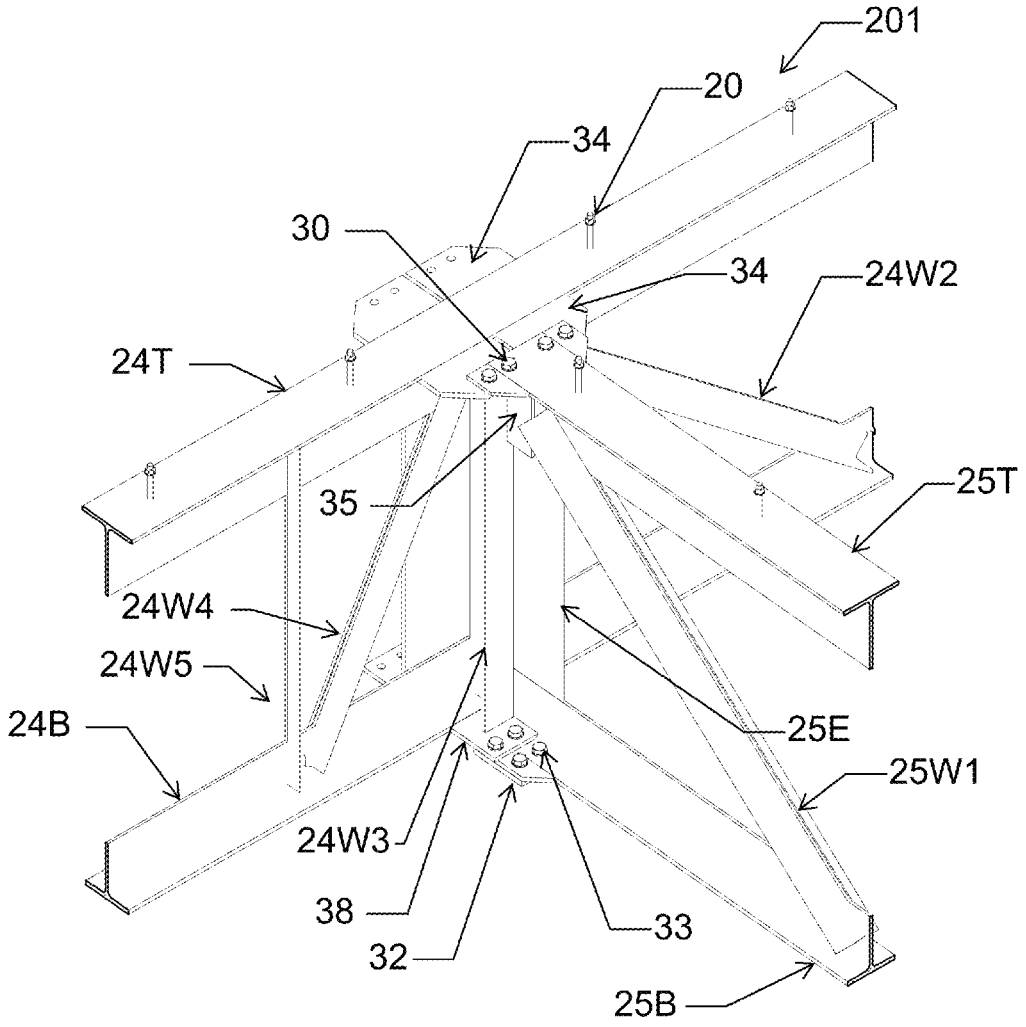
FIG. 28 is a perspective view above assembly 201 illustrating divider truss to exterior girder truss assembly.
Figure 29:
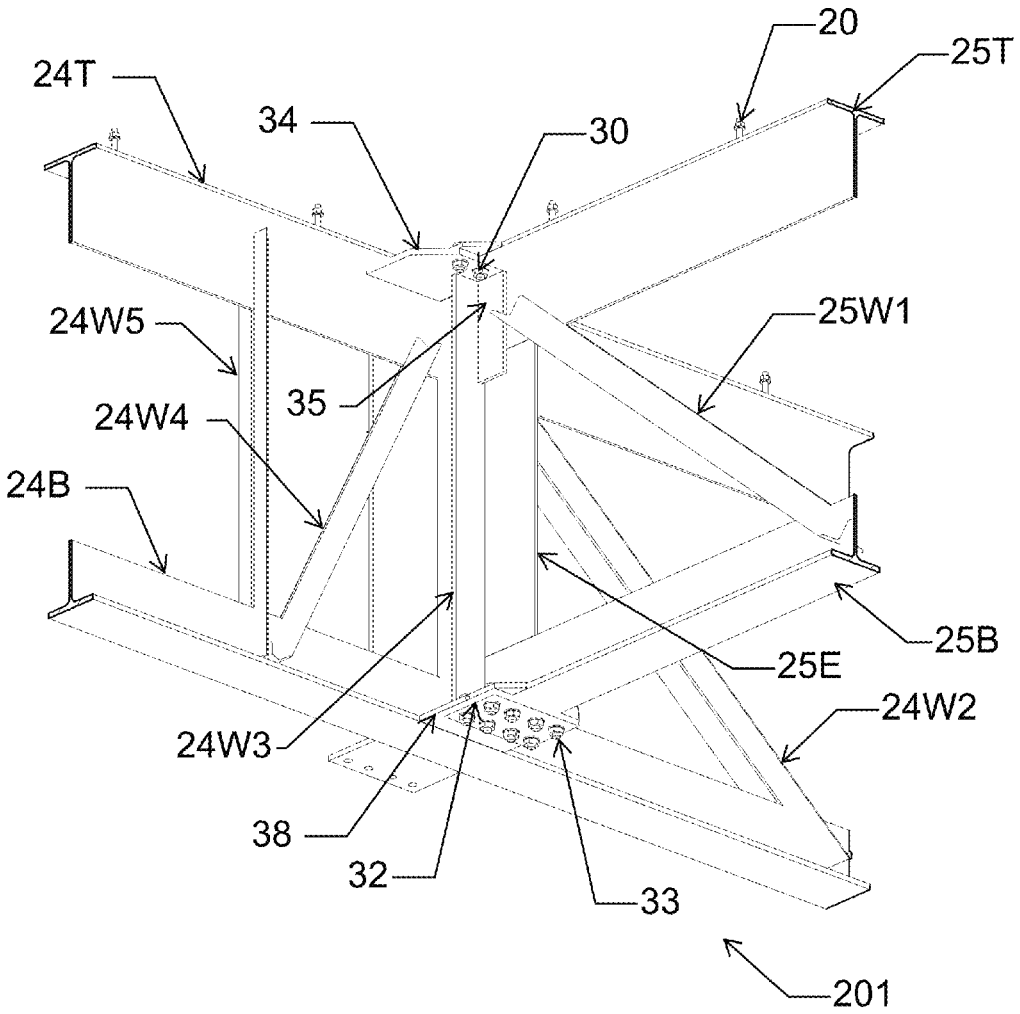
FIG. 29 is a perspective view below assembly 201, further illustrating divider truss to exterior girder truss assembly.

FIG. 28 is a perspective view from the top and FIG. 29 is a perspective view from the bottom of the divider truss connection assembly 201, which is noted in FIG. 2 and FIG. 5. The divider truss connection assemblies 201 are located at one-third points along the span of the respective girder trusses 24. As explained below, each divider truss connection assembly 201 connects a respective divider truss 25 to the respective girder truss 24.

In order to limit the number of different structural members and standardize the connection details for both truss to column connection and truss to truss connection, in the illustrated embodiment a web member 24W3 of the girder truss 24 located at the one-third points along the girder truss span has the same construction as at least a portion of one of the column connection assemblies 101, 102, 103. The web member 24W3 may have either two WT shapes or one wide flange shape. If a wide flange shape is selected for the web member 24W3, in order to extend the shape to the bottom of truss flanges, two slots need to be cut in the web of the wide flange, one at the top and one at the bottom. To standardize the connection detail, either WTs or wide flanges are chosen for all web members 24W3 in certain embodiments. The depth of connecting web 24W3 is preferably the same as column 6.

Figure 30:
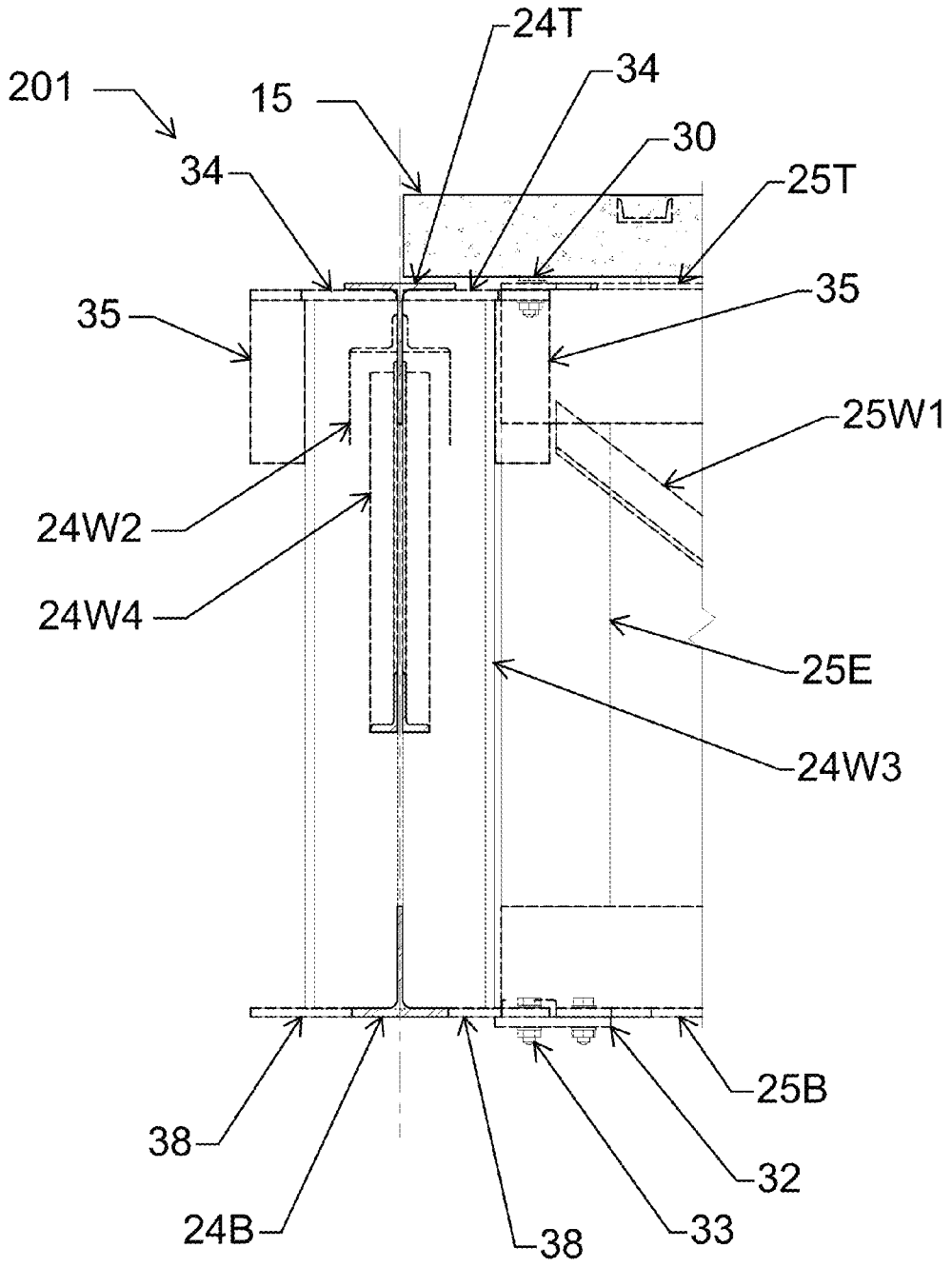
FIG. 30 is a section view of assembly 201.
Figure 31:
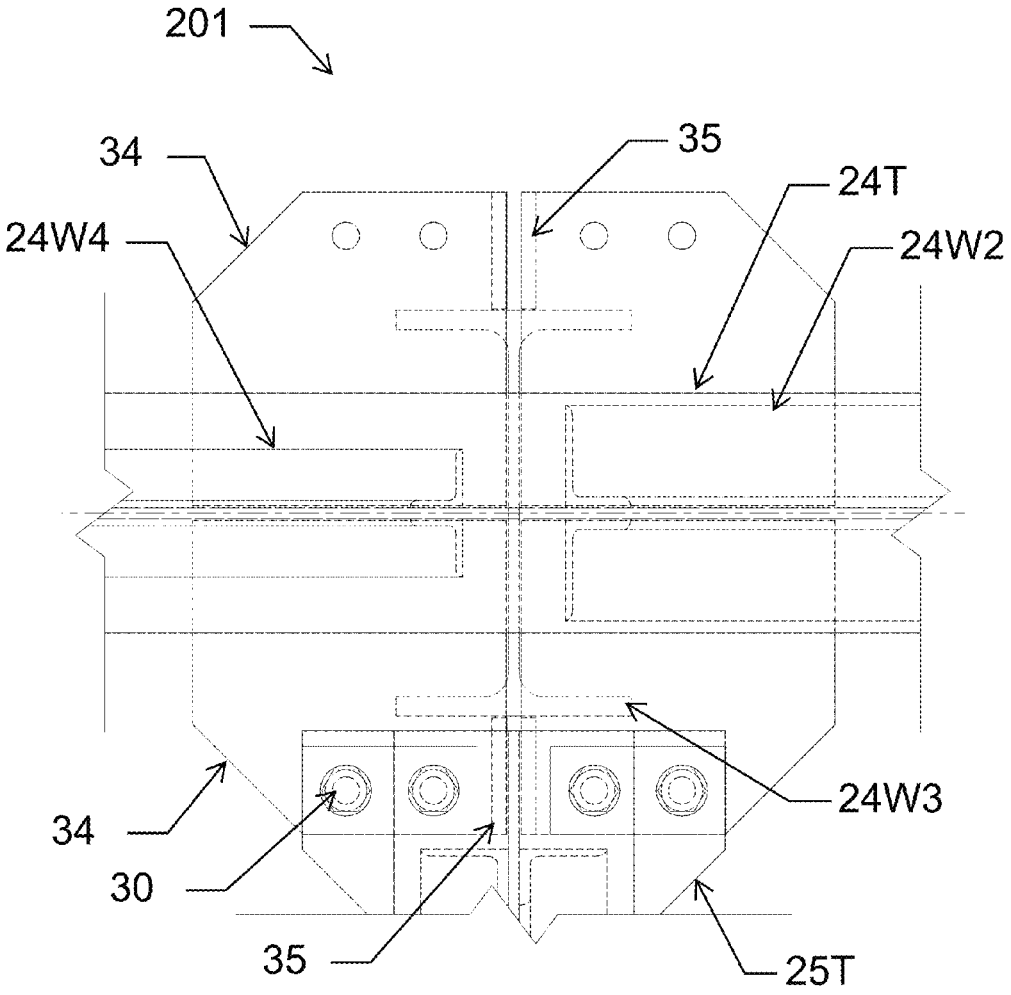
FIG. 31 is a plan view of divider truss top chord to girder truss top chord connection at assembly 201.
Figure 32:
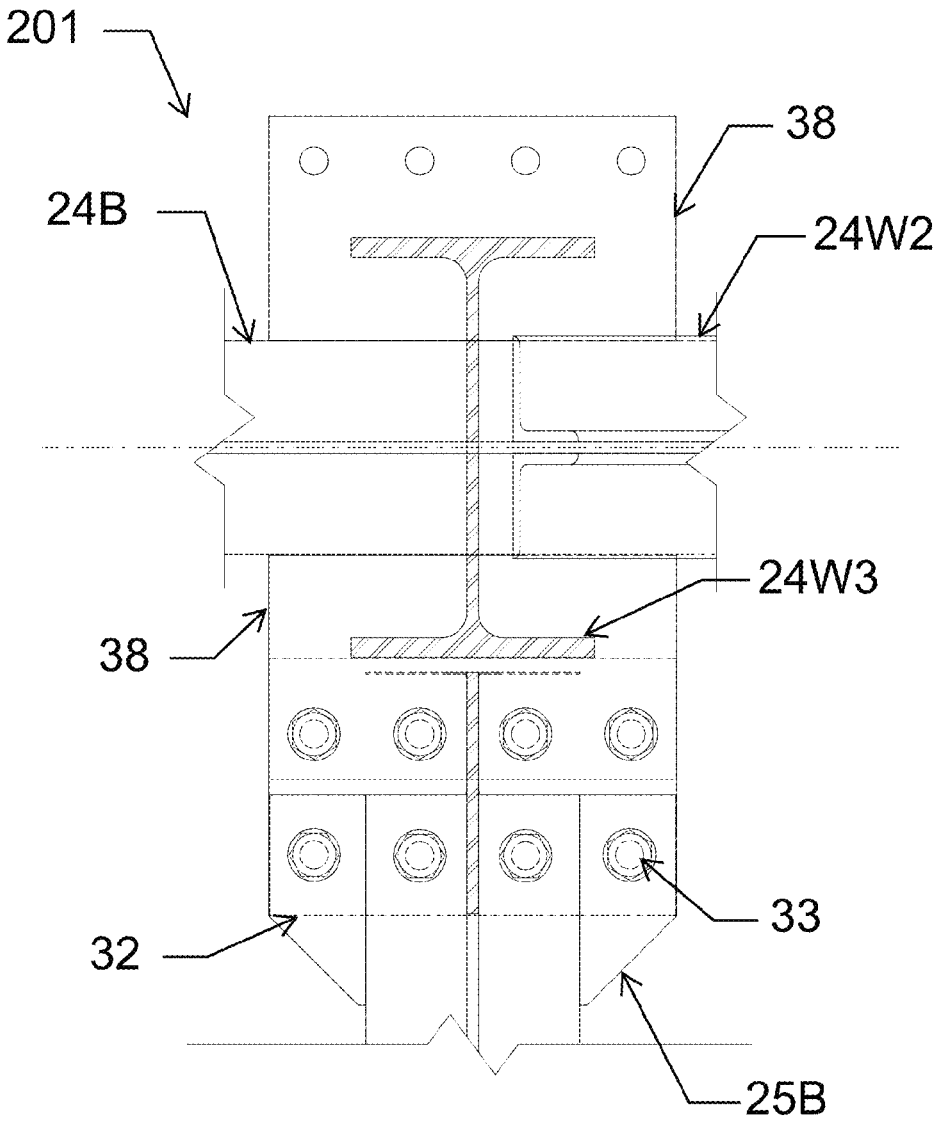
FIG. 32 is a plan view of divider truss bottom chord to girder truss bottom chord connection at assembly 201.

FIG. 30 is a section view of the divider truss connection assembly 201. FIGS. 31 and 32 are top chord and bottom chord plan views of the connection assembly 201 respectively. As seen in FIG. 30, a plate 34 is welded underneath the top flange of the girder truss chord 24T so that the flange of the top chord 25T of the divider truss 25 can be installed at the same elevation as the girder truss top chord 24T. Similar to the truss to column connection assemblies 101, 102, 103, for the truss to truss connection assembly 201, there is a slot in the middle of the plate 34, shown in FIG. 31, for a split seated connection at one-third points along the girder truss 24. A pair of stiffener plates 35, one on each side of the slot, are welded to bottom of plate 34 and to truss web member 24W3. Four bolts 30 are used at the connection. FIG. 32 illustrates the truss bottom chord connection. A plate 38 is welded to truss bottom chord 24B and web member 24W3. With a connection plate 32 and four bolts 33, truss bottom chords 24B and 25B can be easily connected in the field. Like truss 24, to make the connection work as intended for erection, the bottom chord 25B is coped and the plate 25E is welded to the top and bottom chords 25T and 25B at each truss end. It is also suitable to extend stiffener plate 35 to plate 38 or use a row of bolts to connect plate 35 to plate 25E vertically. It will be understood that the divider truss connection assembly could have different configurations without departing from the scope of the invention.

Figure 33:
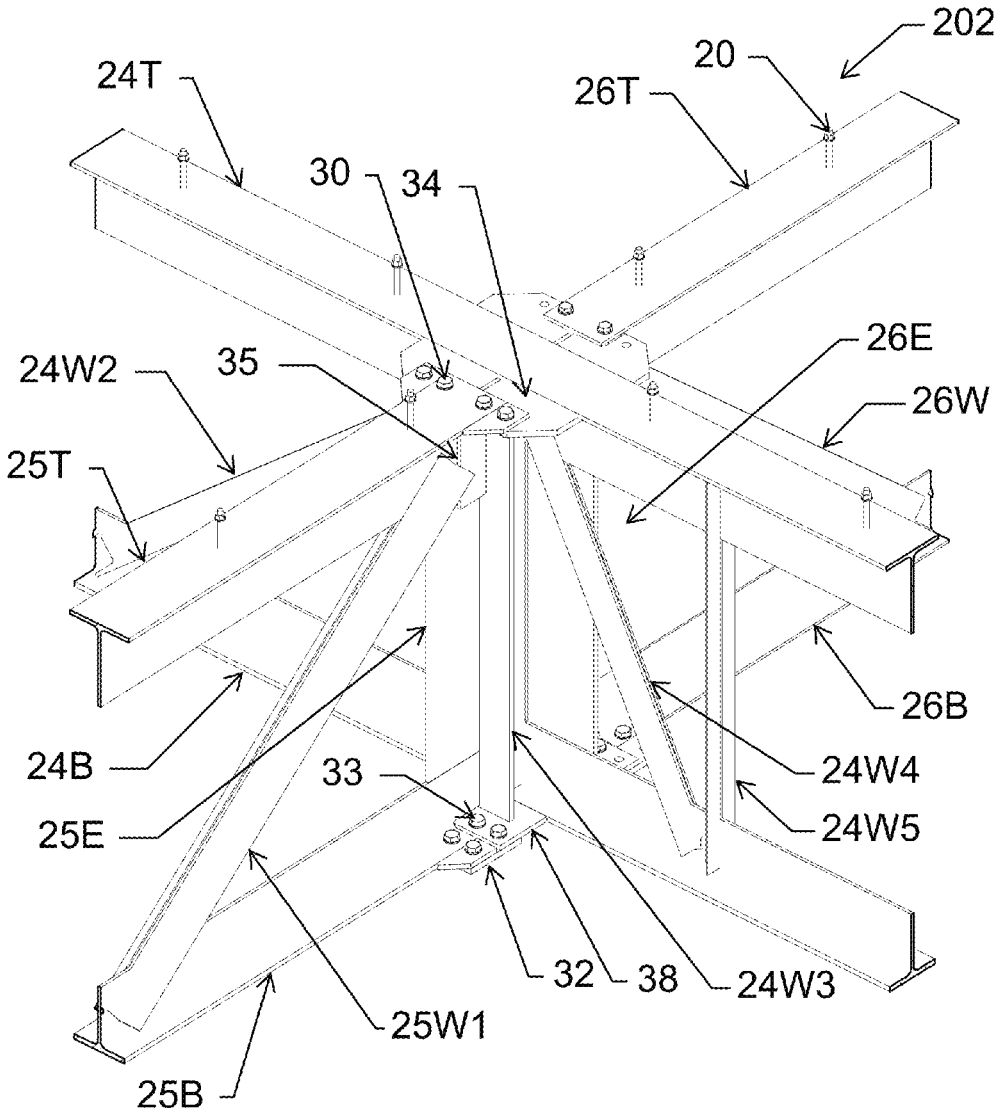
FIG. 33 is a perspective view above assembly 202 illustrating divider truss and filler truss to girder truss connection assembly.
Figure 34:
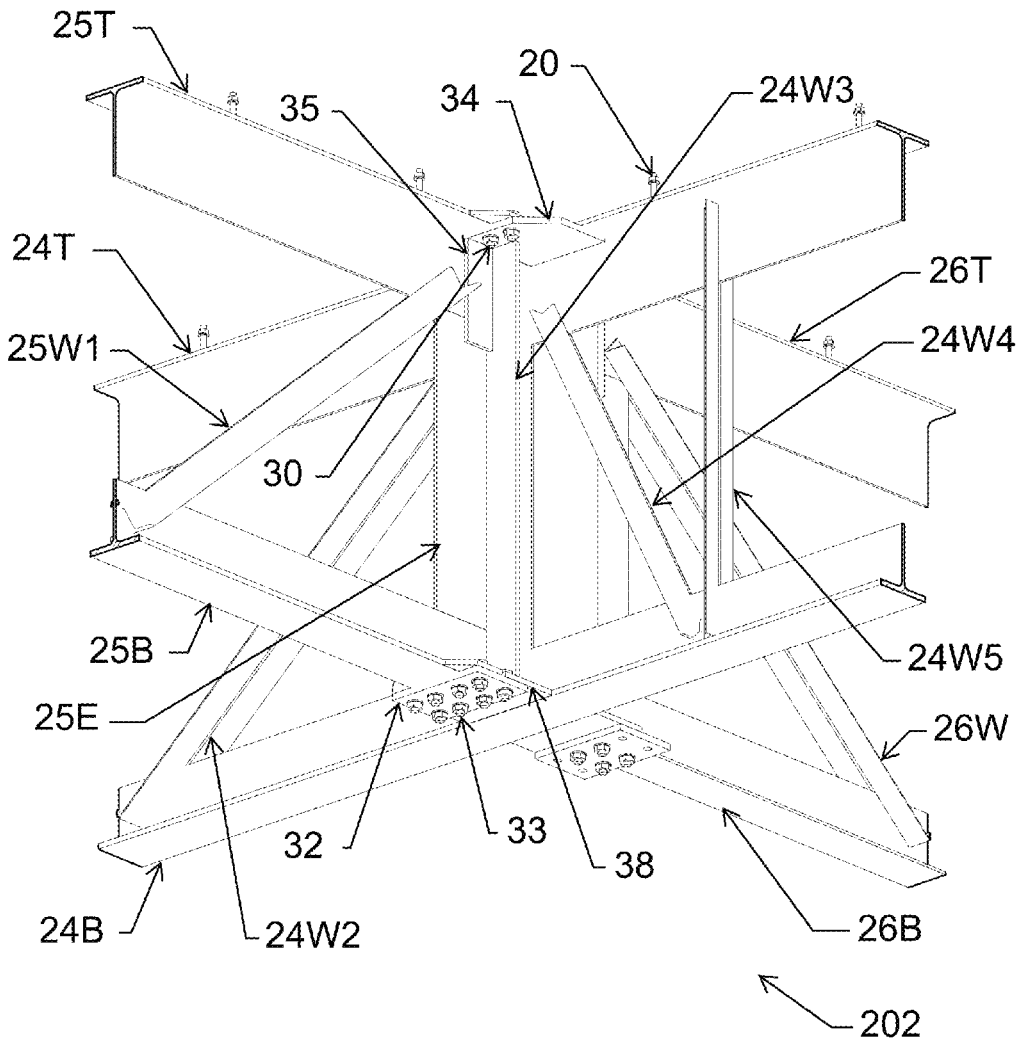
FIG. 34 is a perspective view below assembly 202, further illustrating divider truss and filler truss to girder truss connection assembly.

FIG. 33 is a perspective view from the top and FIG. 34 is a perspective view from the bottom of the divider truss connection assembly 202, which is noted in FIG. 2, FIG. 4, and FIG. 5. In the illustrated embodiment, each assembly 202 is located at a one-third point along the span of the respective girder truss 24, where the divider truss 25 is connected to girder truss 24 on one side and a side filler truss 26 is connected to the girder truss on the other side. The same truss to truss connection as described above with respect to assembly 201 applies to assembly 202.

Figure 35:
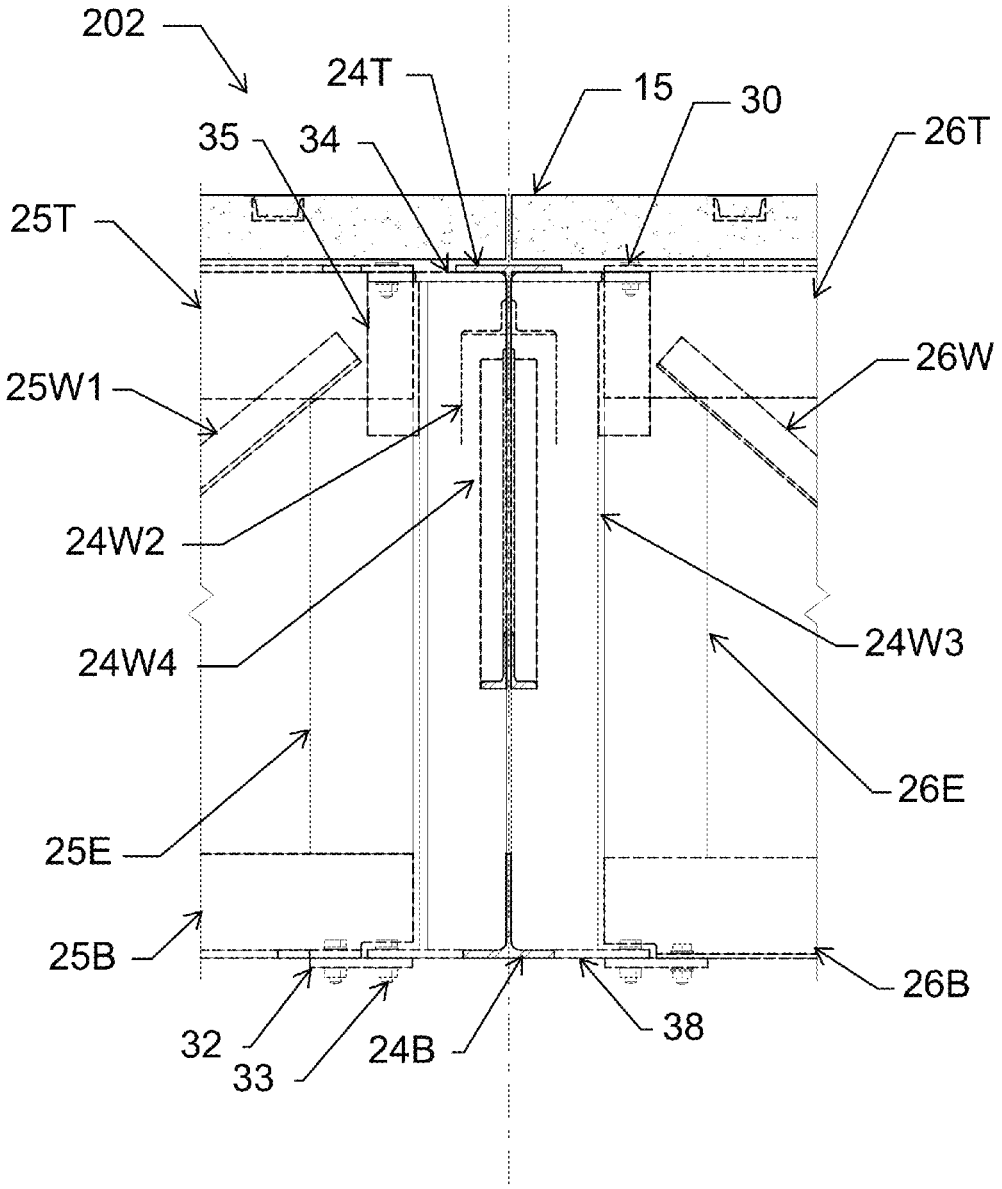
FIG. 35 is a section view of assembly 202.
Figure 36:
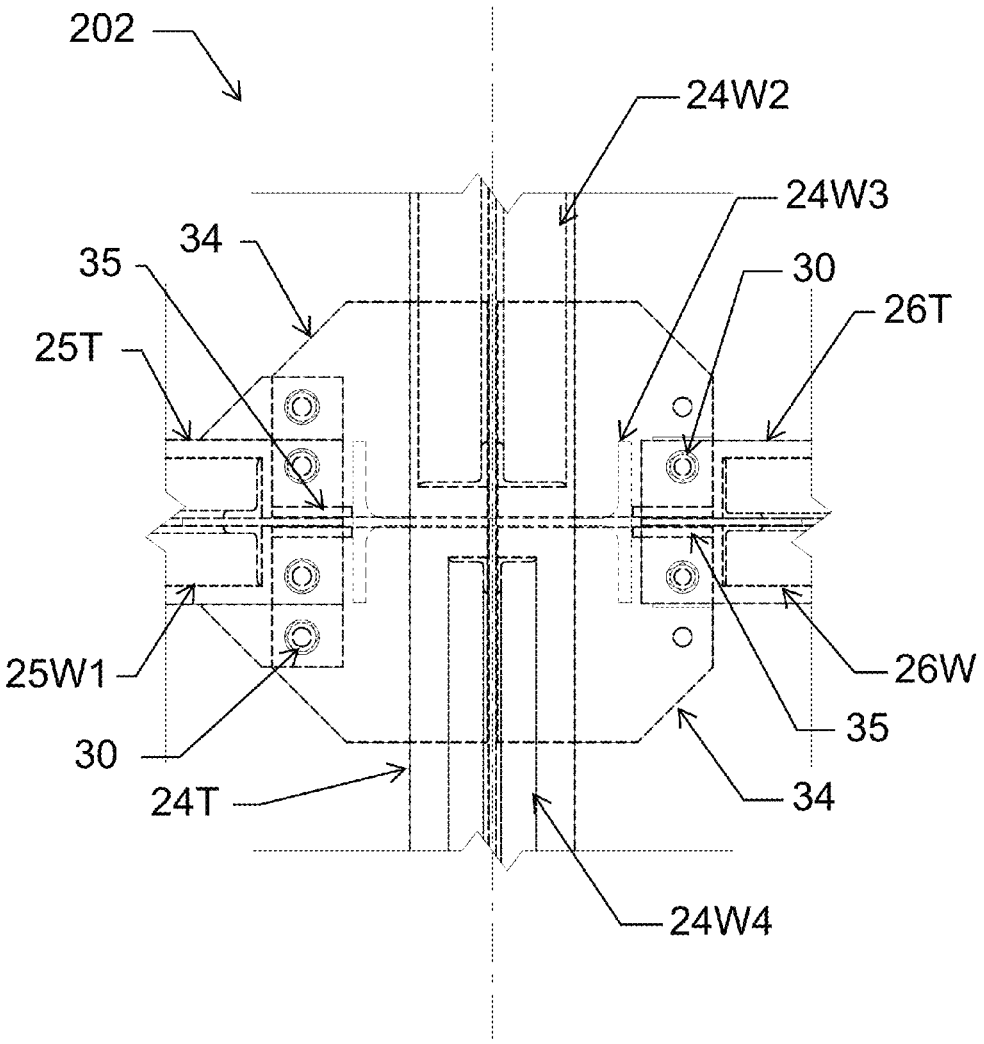
FIG. 36 is a plan view of divider truss and filler truss top chords to girder truss top chord connection at assembly 202.
Figure 37:
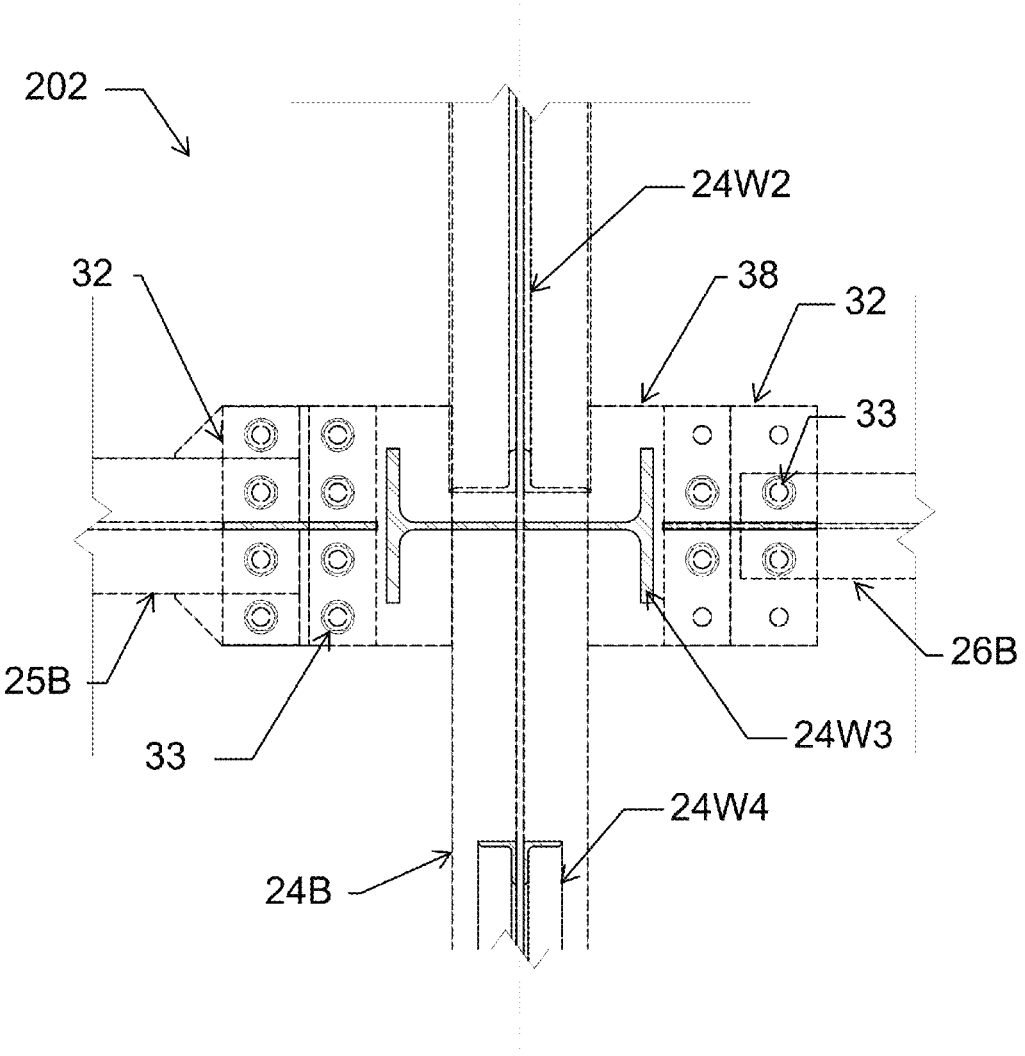
FIG. 37 is a plan view of divider truss and filler truss bottom chords to girder truss bottom chord connection at assembly 202.

FIG. 35 is a section view, and FIGS. 36 and 37 are top chord and bottom chord plan views of assembly 202. There is no difference in connections on either side of girder truss 24 except that four bolts in a row are used at the connection to the divider truss 25 and only two bolts in a row are used at the connection to the side filler truss 26 due to truss reaction differences. Divider truss 25 supports a larger floor tributary area, resulting a higher reaction force at end of truss, thus more connecting bolts are required. Side filler truss 26 supports a smaller floor tributary area. The reaction force is smaller, thus fewer connection bolts are needed.

Figure 38:
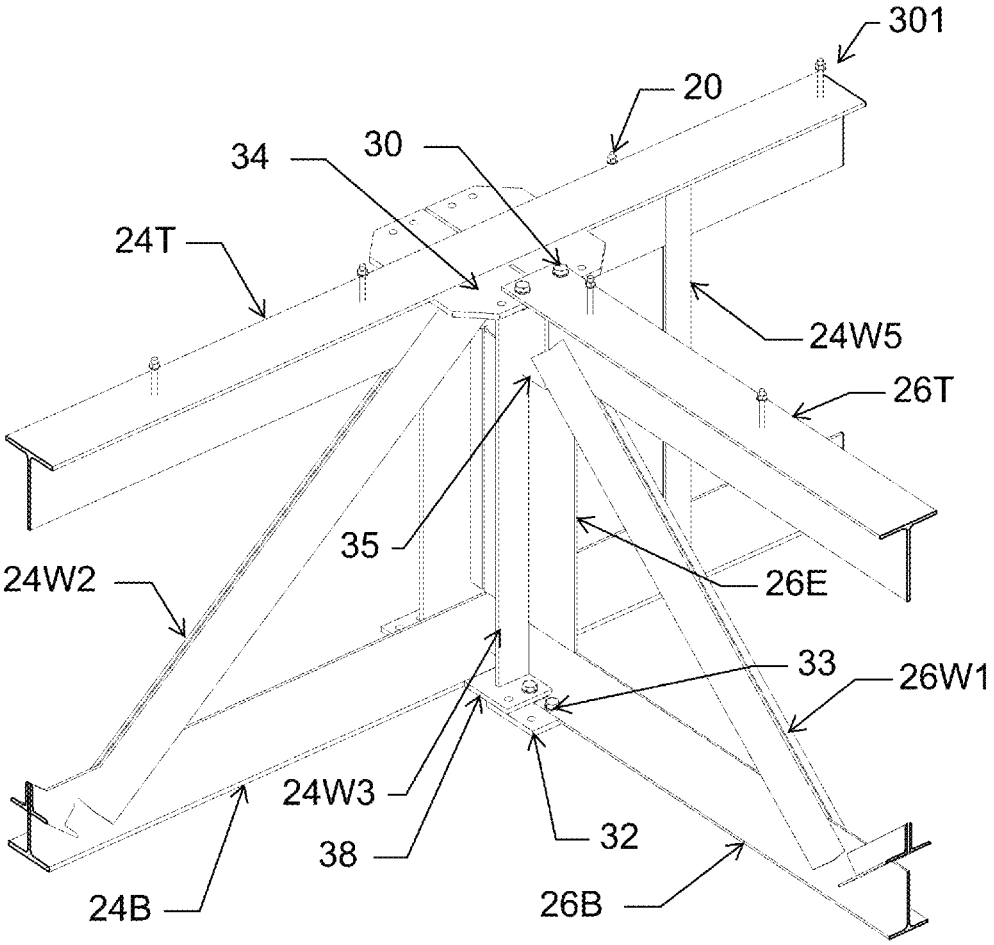
FIG. 38 is a perspective view above assembly 301 illustrating filler truss to exterior girder truss assembly.
Figure 39:
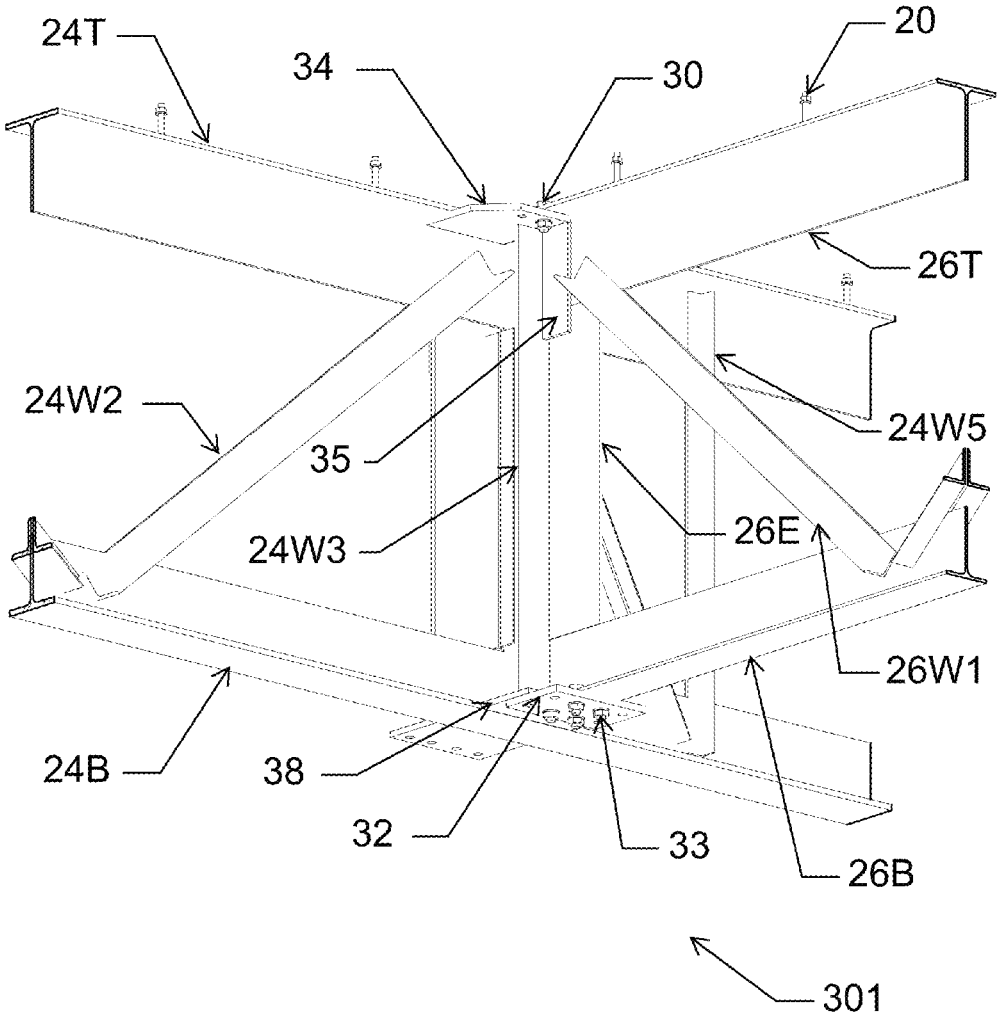
FIG. 39 is a perspective view below assembly 301, further illustrating filler truss to exterior girder truss assembly.

After the divider trusses 25 are in place (e.g., by connecting the divider trusses to the connection assemblies 201, 202), the next construction sequence is to erect all the filler trusses 26, 27. FIG. 38 and FIG. 39 are perspective views of a side filler truss connection assembly 301, which connects a side filler truss 26 to a girder truss 24. In the illustrated embodiment, the assembly is the same as assembly 201, as described in reference to FIGS. 28 and 29, except that there are only two connection bolts required on each side of this connection. Filler trusses further divide a column bay into nine equal squares for the two-way floor deck support.

Figure 40:
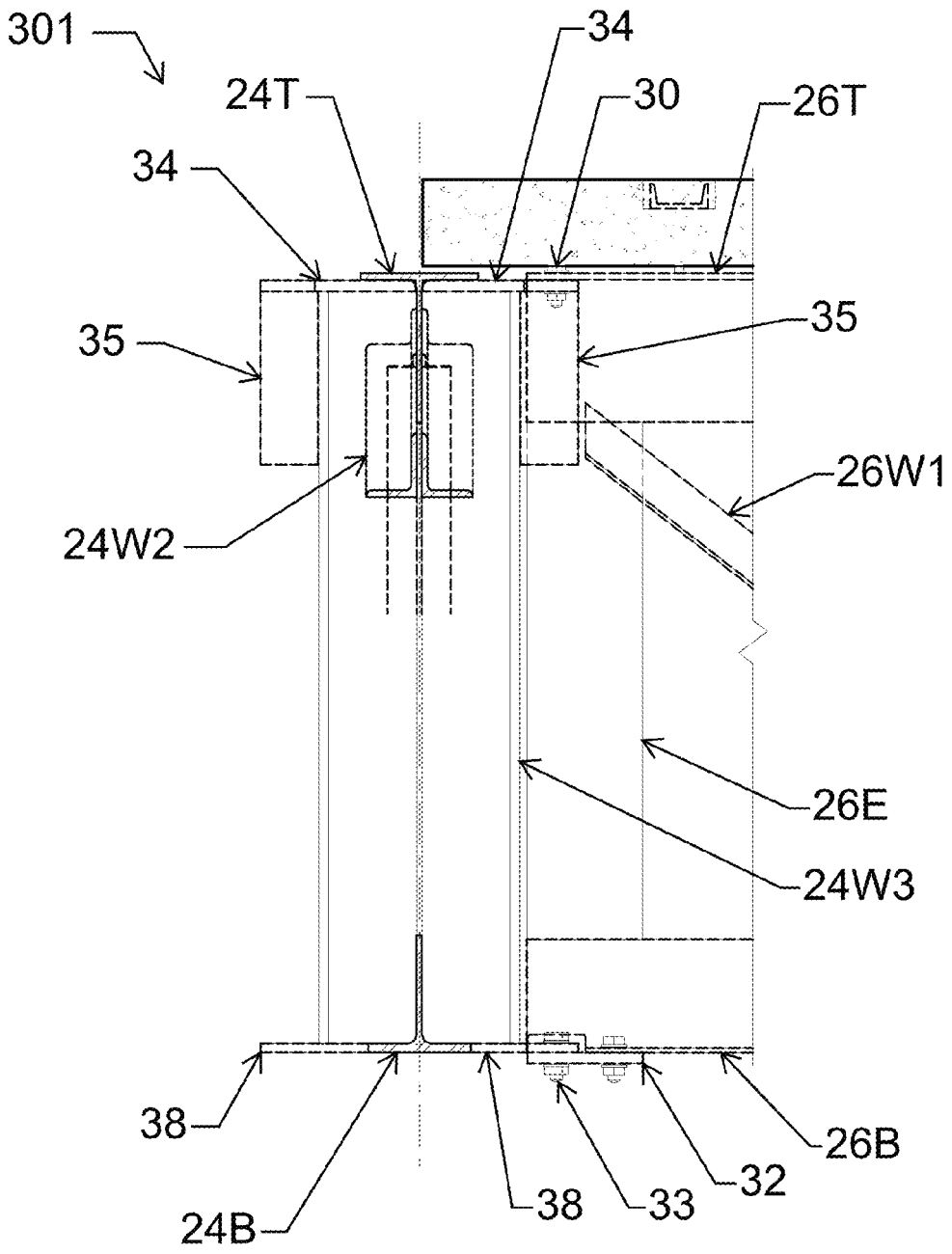
FIG. 40 is a section view of assembly 301.
Figure 41:
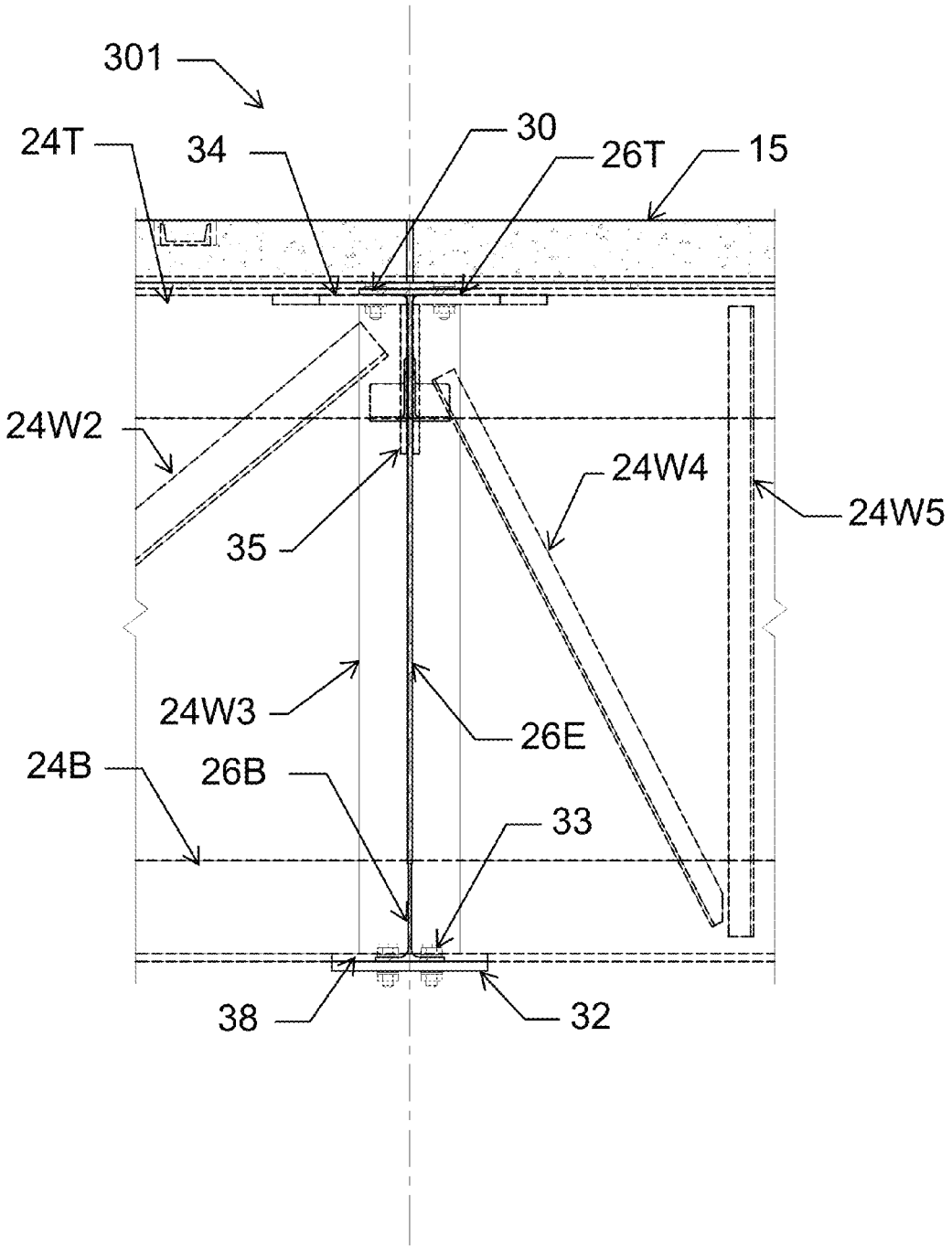
FIG. 41 is a section view of assembly 301 in the direction perpendicular to FIG. 20.

FIGS. 40 and 41 are section views of the side filler truss connection assembly 301. FIG. 40 is a view parallel to the filler truss 26, while FIG. 41 is a view perpendicular to the filler truss. As seen in FIG. 40, the assembly is identical to assembly 201, a plate 34 is welded to the bottom of the flange of the top girder truss chord 24T so that the flange of the top filler truss chord 26T can be erected at the same elevation.

Figure 42:
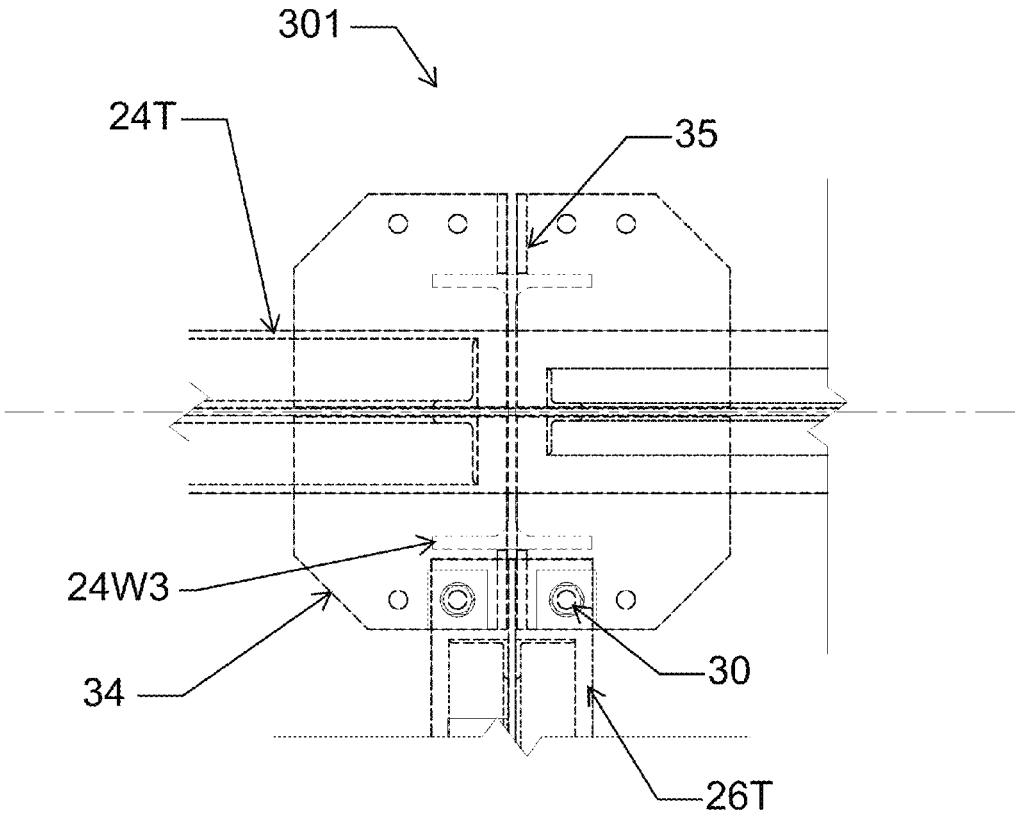
FIG. 42 is a plan view of filler truss top chord to girder truss top chord connection at assembly 301.
Figure 43:
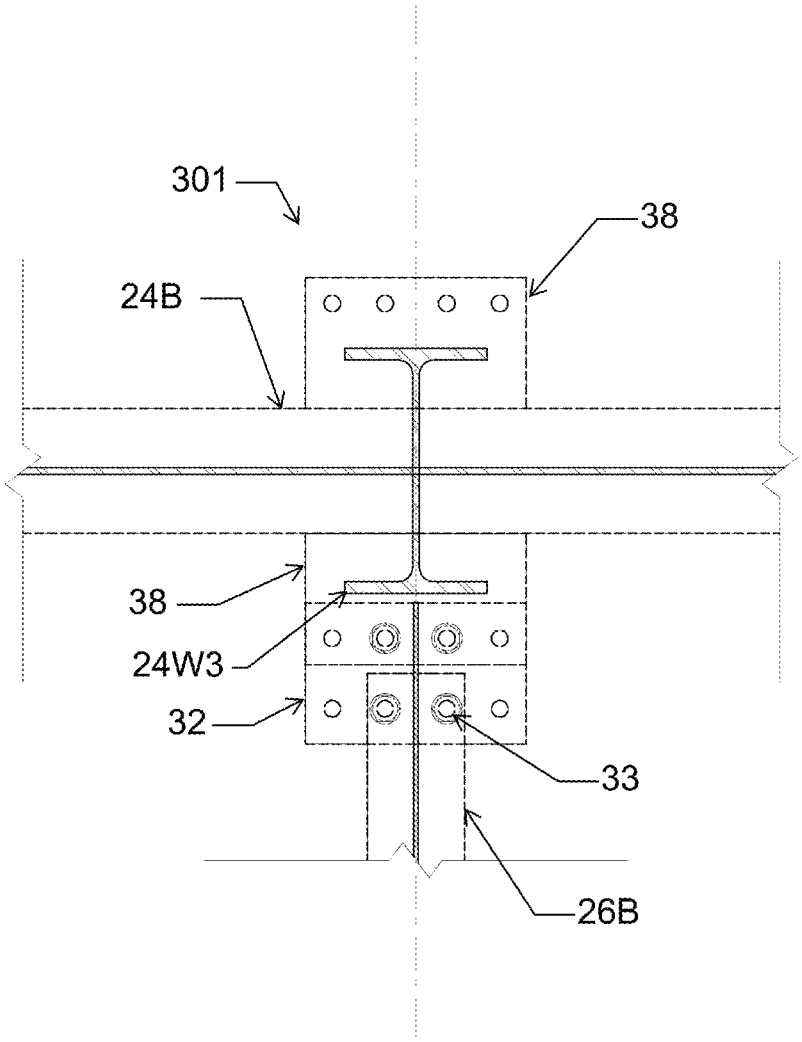
FIG. 43 is a plan view of filler truss bottom chord to girder truss bottom chord connection at assembly 301.

FIGS. 42 and 43 are top chord and bottom chord plan views of the assembly 301 respectively. Like the divider truss connection assembly 301, a slot is cut in the middle of plate 34, as seen in FIG. 42, for a split seated connection to each side filler truss 26 at a respective one-third point along the span of a girder truss 24. A pair of stiffener plates 35, one on each side of the slot, is welded to bottom of plate 34 and to truss web member 24W3. Two bolts 30 are used at the connection. FIG. 43 illustrates the truss bottom chord connection. The connection plates and bolts are the same as in assembly 201.

Each side filler truss 26 is erected by sliding through the split seated connection. After the top chord 26T bears on plate 34, the crane is released. After adjusting for alignment, bolts 30 are used to fasten the top chord 26T to the connection assembly 301 and bolts 33 are used to fasten the bottom chord 26B to the connection assembly to form the connection.

Due to light reaction force, two bolt holes on each row are unused at each connection. The connection plate 32 can be reduced to two bolt holes. However, for speed of erection, using the same number of bolt holes as in the other connection assemblies allows a single plate 32 to be used for each connection assembly.

Figure 44:
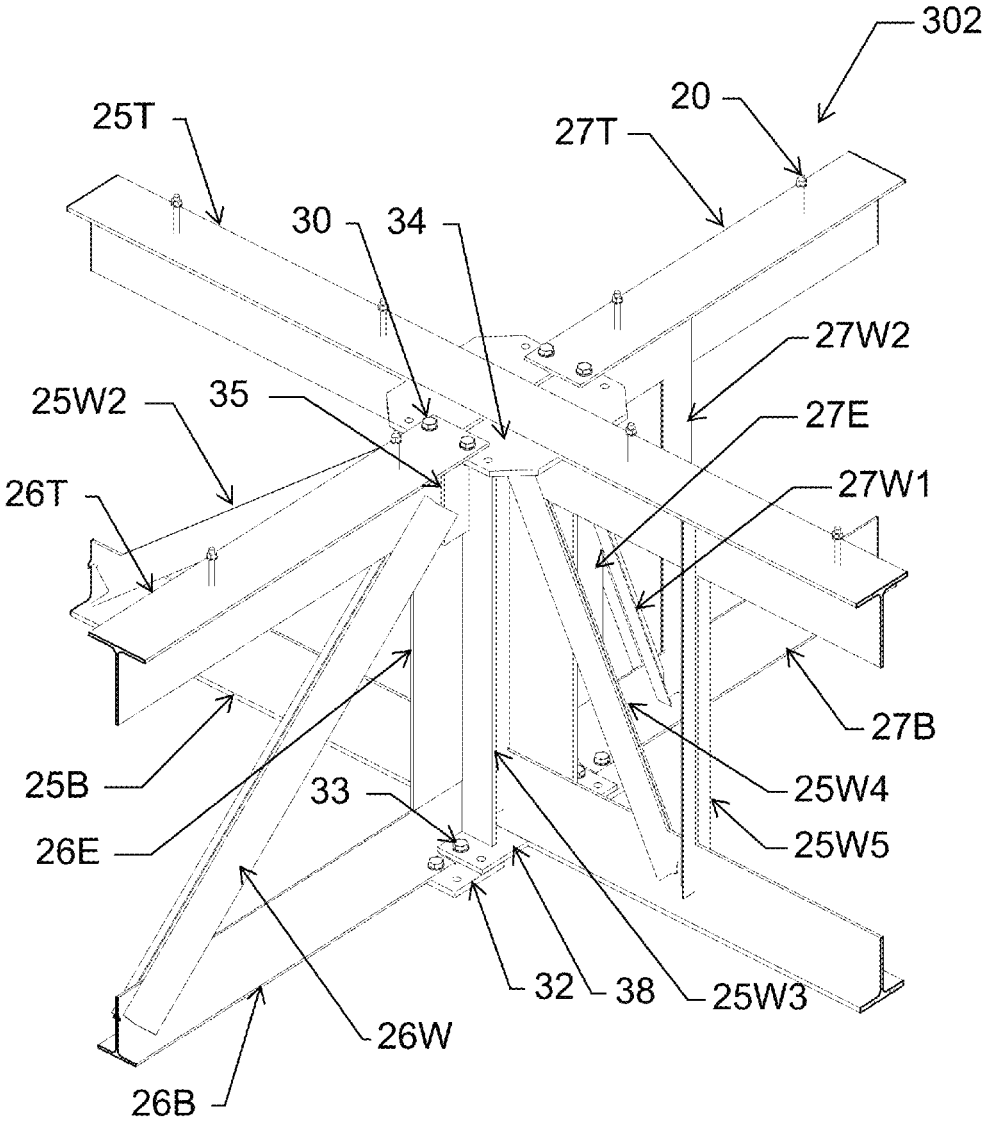
FIG. 44 is a perspective view above assembly 302 illustrating filler truss to divider truss connection assembly.
Figure 45:
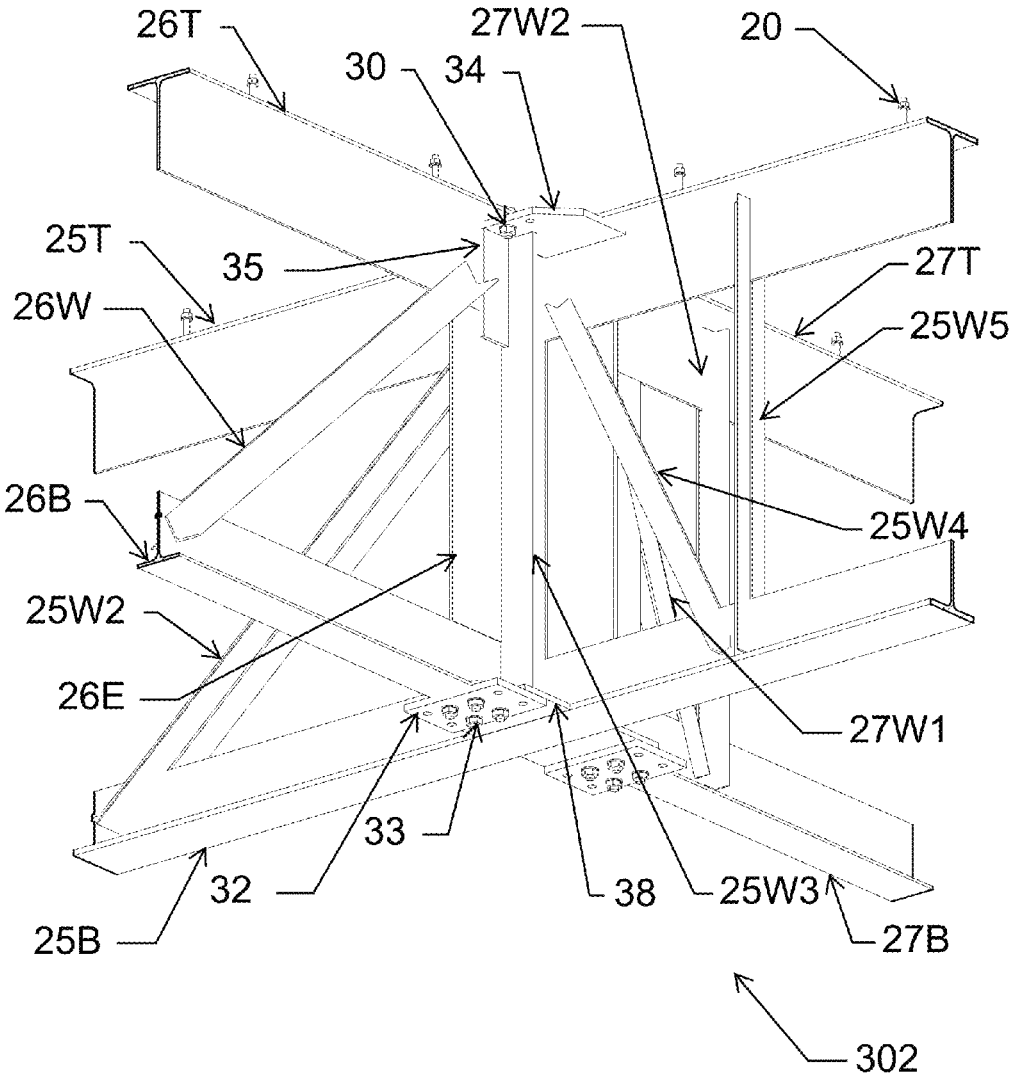
FIG. 45 is a perspective view below assembly 302, further illustrating filler truss to divider truss connection assembly.

FIG. 44 is a perspective view from the top and FIG. 45 is a perspective view from the bottom of the center filler truss connection assembly 302, as noted in FIG. 2 and FIG. 6. Each connection assembly 302 is located at a respective one-third point of the column bay (e.g., along the span of a divider truss 25) where a side filler truss 26 is connected to one side of the divider truss 25 and a center filler truss 27 is connected to the other side of the divider truss 25.

Figure 46:
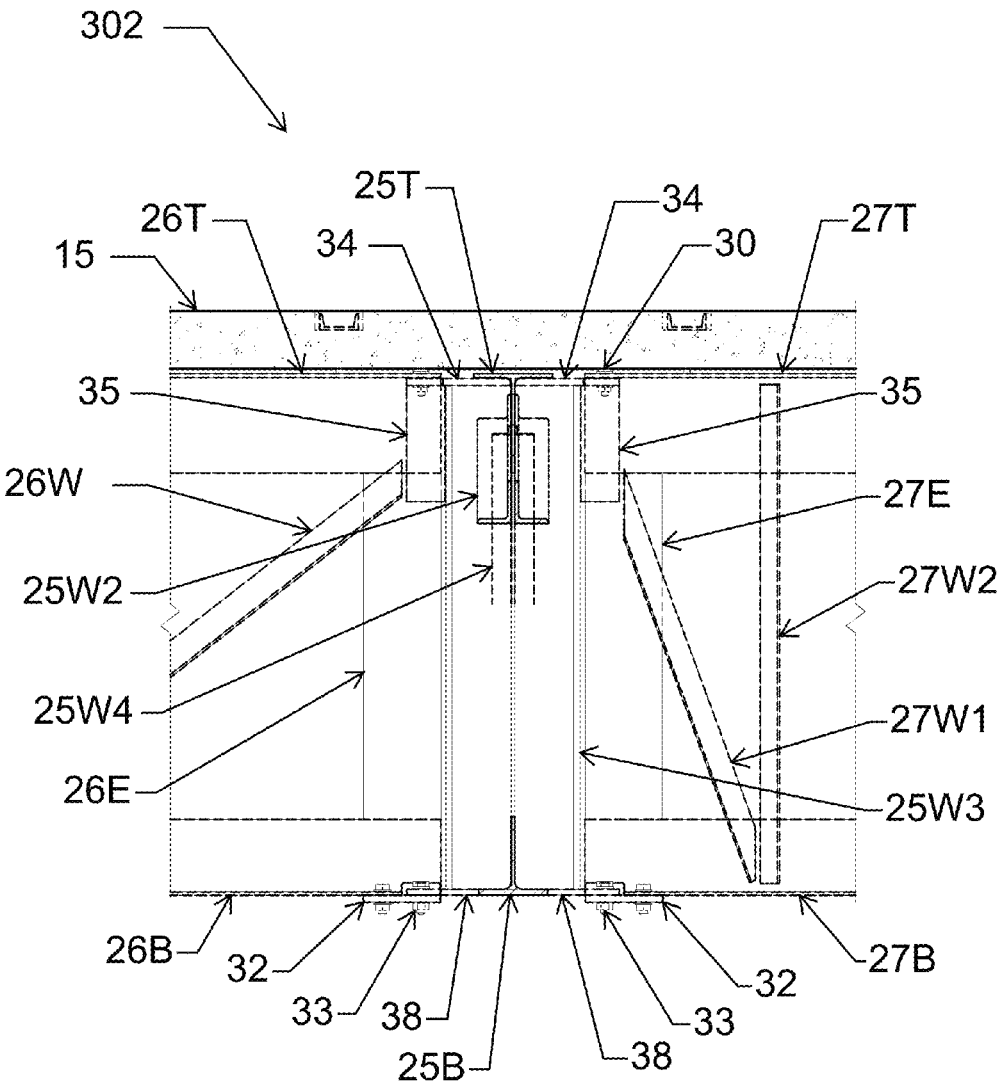
FIG. 46 is a section view of assembly 302.
Figure 47:
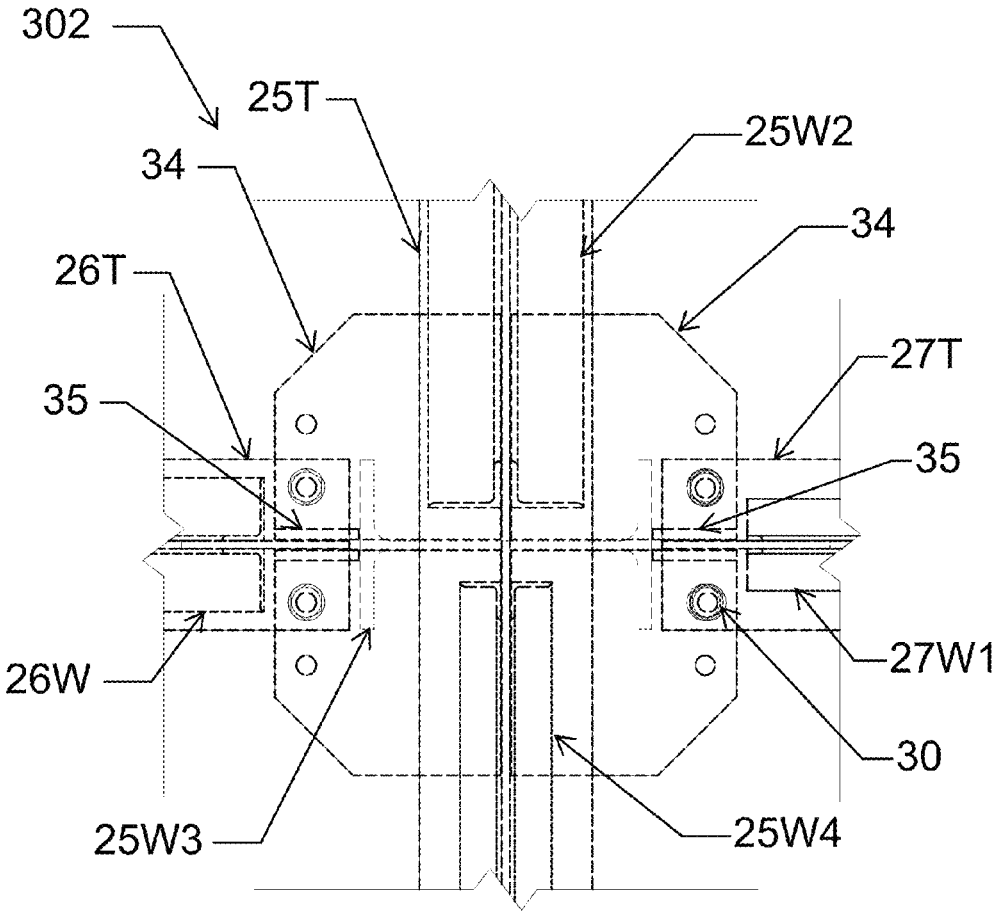
FIG. 47 is a plan view of filler truss top chord to divider truss top chord connection at assembly 302.
Figure 48:
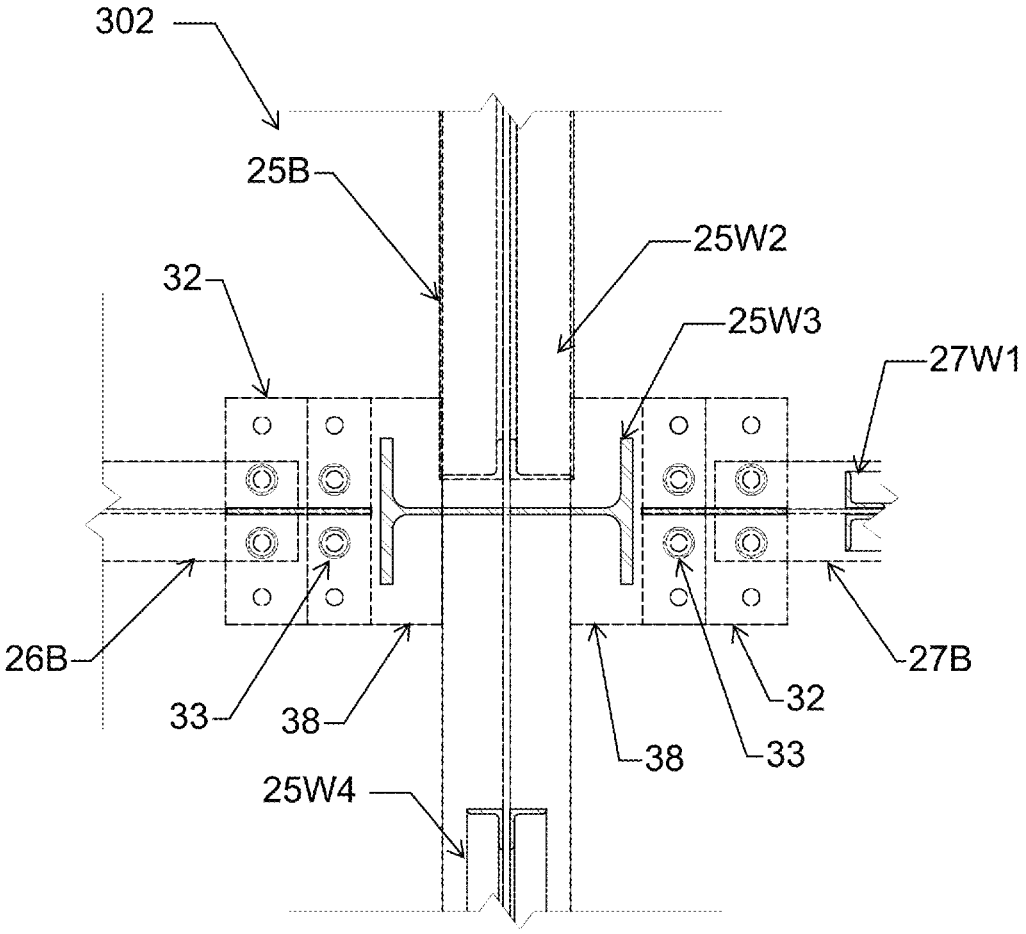
FIG. 48 is a plan view of filler truss bottom chord to divider truss bottom chord connection at assembly 302.

FIG. 46 is a section view of assembly 302 illustrating the assembly where two filler trusses 26, 27 are connected to divider truss 25. FIGS. 47 and 48 further illustrate the split seated connection at the top divider truss chord 25T and the tension splice connection at bottom divider truss chord 25B in assembly 302.

As discussed above, divider truss 25 has the same construction as girder truss 24 placed in a different location in the framework (i.e., not located along a column line). Therefore, the filler truss to divider truss connection 302 is the same as the connections along the girder trusses, such as side filler connection assembly 301. The split seated connections are welded to divider truss web member 25W3 at one-third points along the span of truss 25. Similarly, two bolts are used to fasten the top and bottom of each filler truss 26, 27 to the divider truss 25 at each connection assembly 302.

Figure 49:
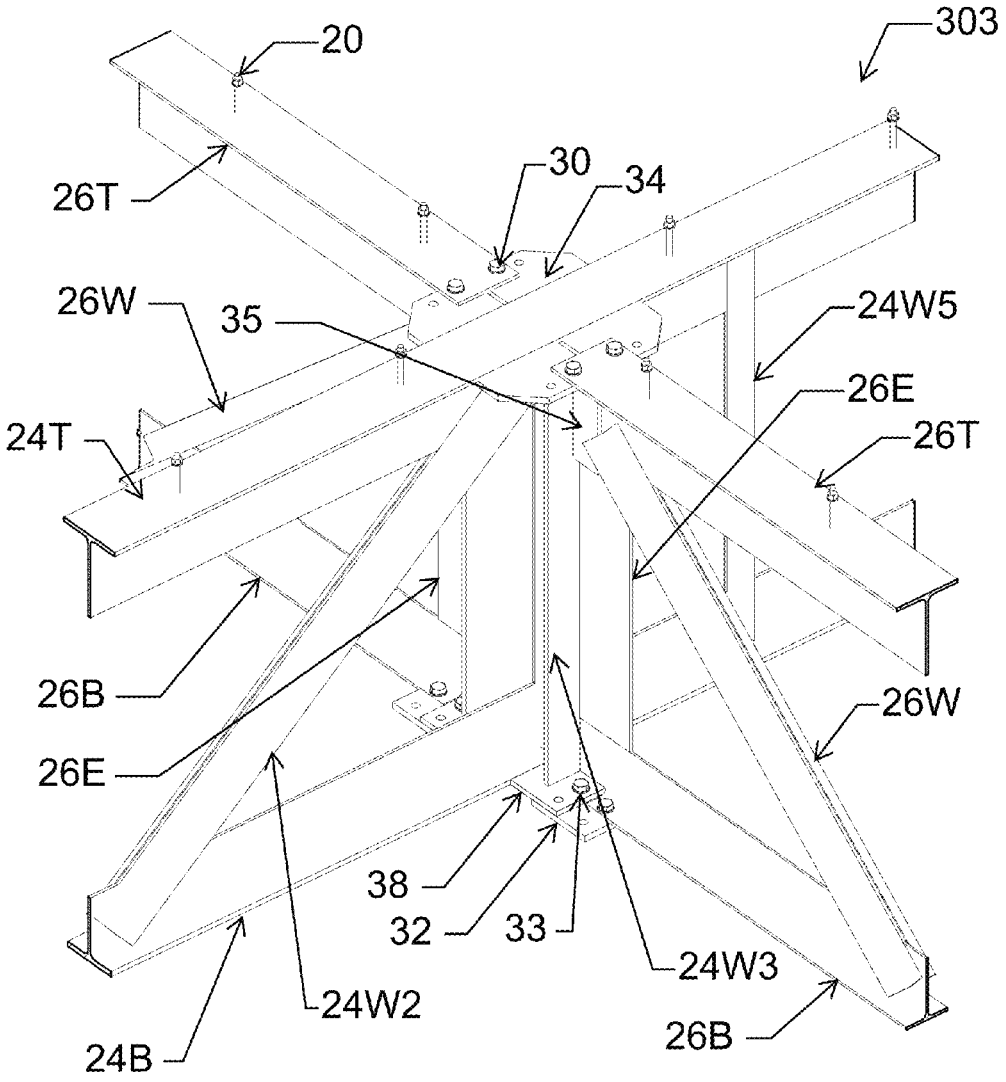
FIG. 49 is a perspective view above assembly 303 illustrating filler truss to divider truss connection assembly.
Figure 50:
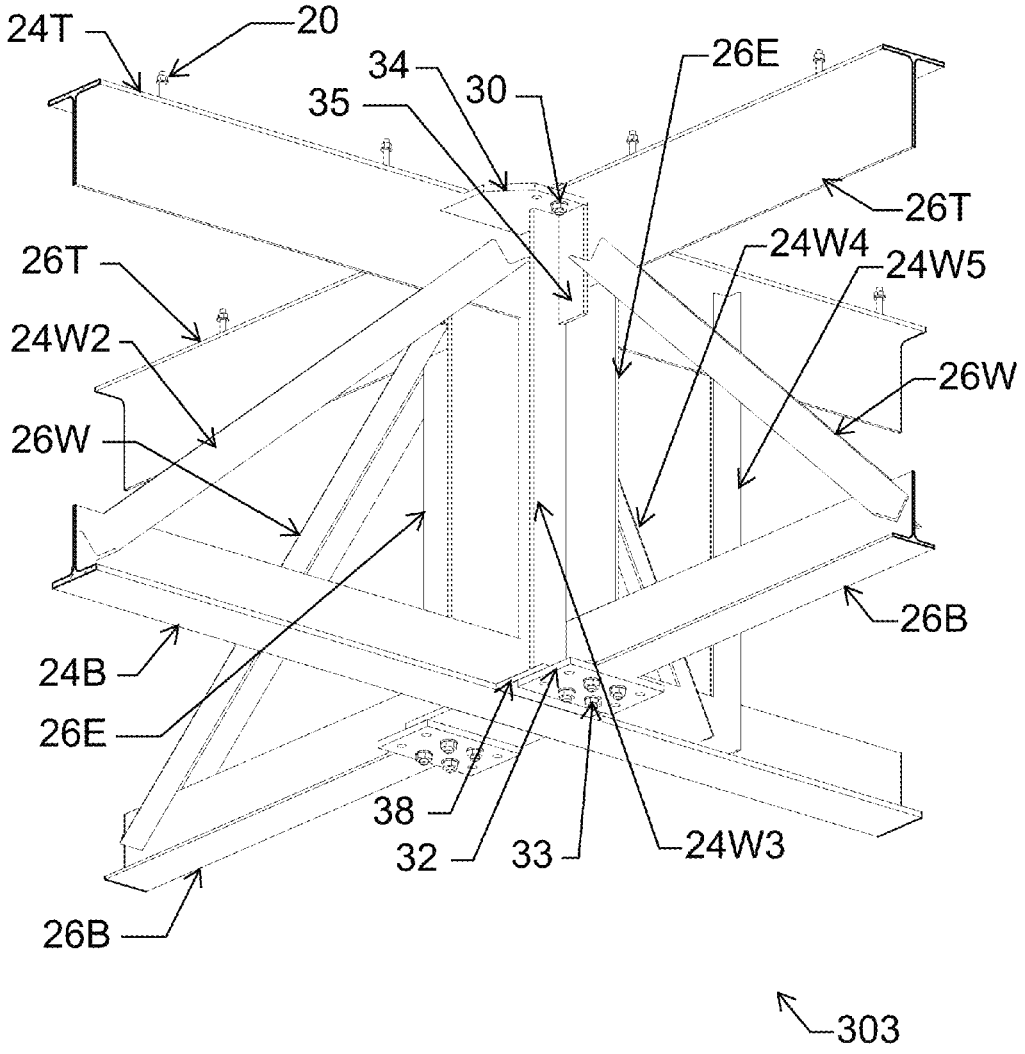
FIG. 50 is a perspective view below assembly 303, further illustrating filler truss to divider truss connection assembly.

The last type of connection is the side filler connection assembly 303 (which may, in some embodiments, be the same as the side filler connection assembly 202). FIGS. 49 and 50 are perspective views of assembly 303, one from the top and one from the bottom of the assembly. As compared with assembly 301, there are two side filler trusses 26 in assembly 303 versus one side filler truss 26 and one center filler truss 27 in assembly 301. The remaining details are the same for both assemblies.

Figure 51:
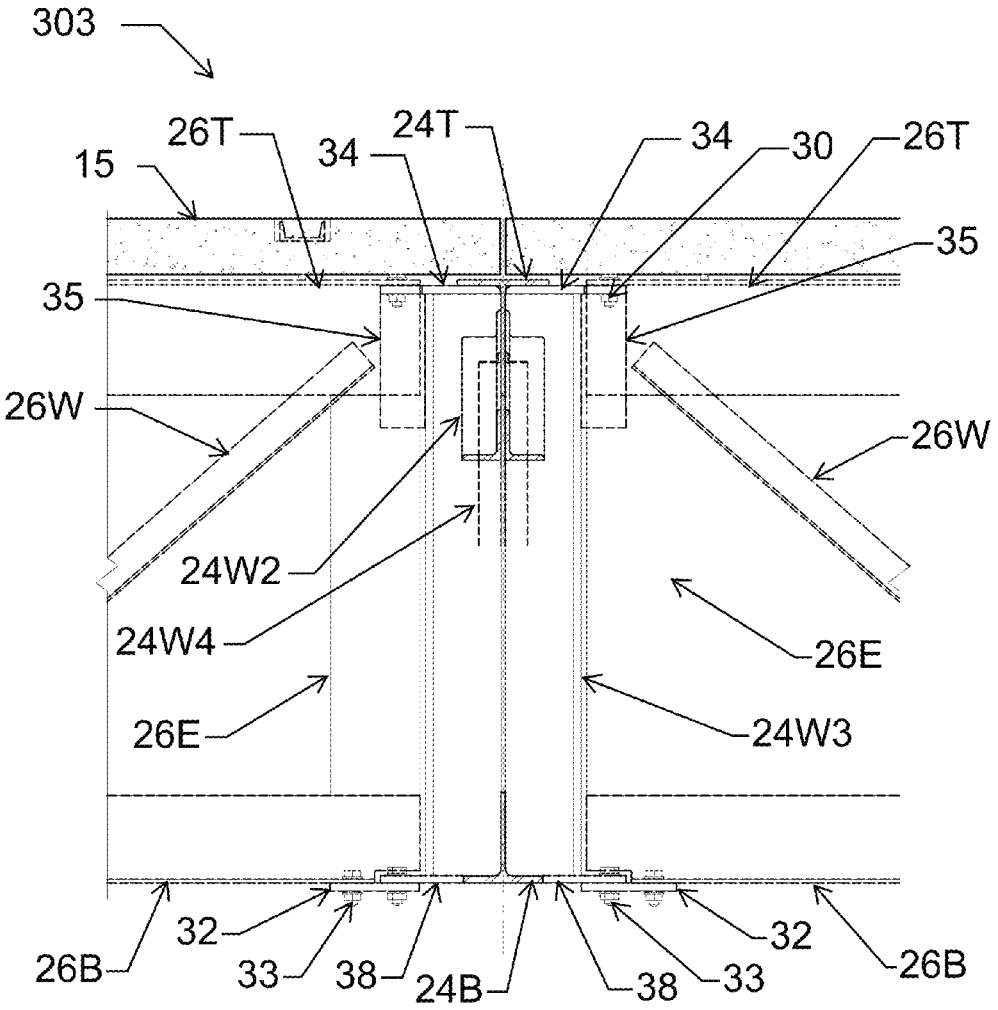
FIG. 51 is a section view of assembly 303.
Figure 52:
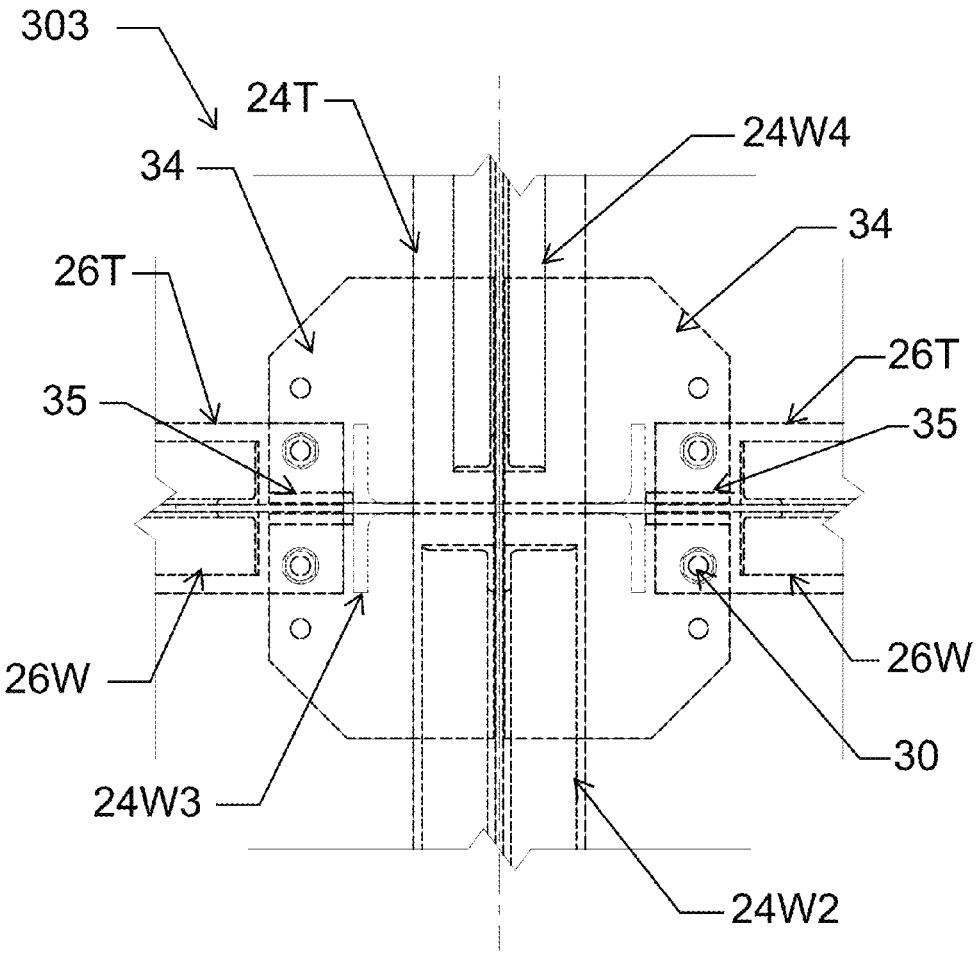
FIG. 52 is a plan view of filler truss top chords to divider truss top chord connection at assembly 303.
Figure 53:
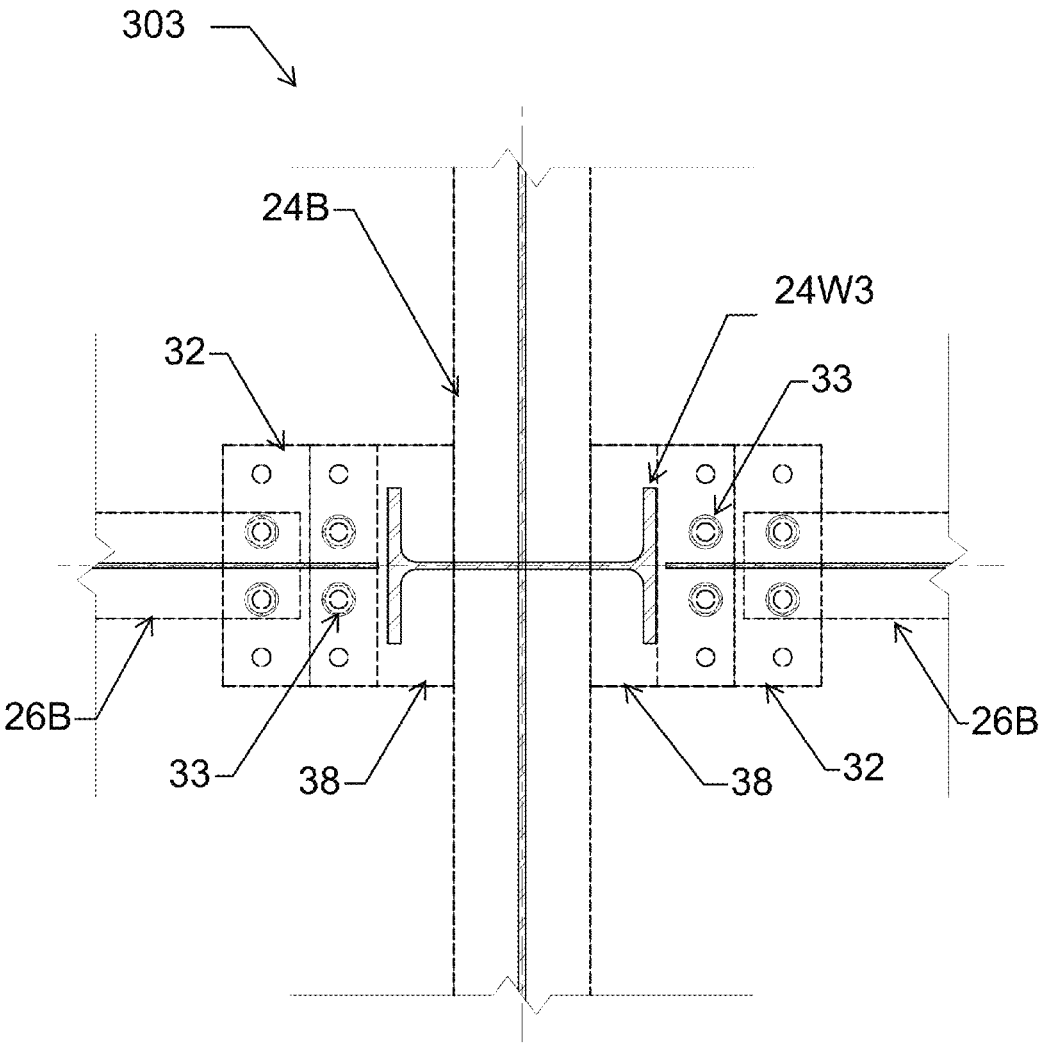
FIG. 53 is a plan view of filler truss bottom chords to divider truss bottom chord connection at assembly 303.

FIG. 51 is a section view and FIGS. 52 and 53 are plan views of assembly 303. As seen in FIG. 51, the left side of the assembly mirrors the right side of the assembly. In both FIG. 52 and FIG. 53, it can be seen that the same split seated connection with two bolts at the top chord and the same tension splice connection with two bolts at the bottom chord apply to both sides of truss 24. The assembly is suitably the same as assembly 301 as discussed above with an additional truss 26.

Accordingly it can be seen that the trusses 24, 25, 26, 27 and connection assemblies 101, 102, 103, 201, 202, 301, 302, 303 are exemplary embodiments of support members suitable for being assembled into a framework that is supported on the columns 6 at a location spaced apart above grade (e.g., a second story). As will be explained in further detail below, the assembled framework of trusses 24, 25, 26, 27 is adapted to mount a plurality of preformed floor deck planks 15 that form a floor in a multistory building. It will be understood that, by extending the heights of the columns 6, these support members can be used to form the framework of multiple, spaced apart floors in a building. As explained below, by preforming the trusses 24, 25, 26, 27 to include threaded rods 20 (e.g., welding or otherwise mounting the threaded rods on the trusses) that extend up from the top chords thereof (e.g., transverse to the support members) at spaced apart locations along the spans of the trusses, the trusses arrive on site in a ready-to-assemble form that allows simple installation of a floor upon the assembled framework of trusses.

Figure 54:
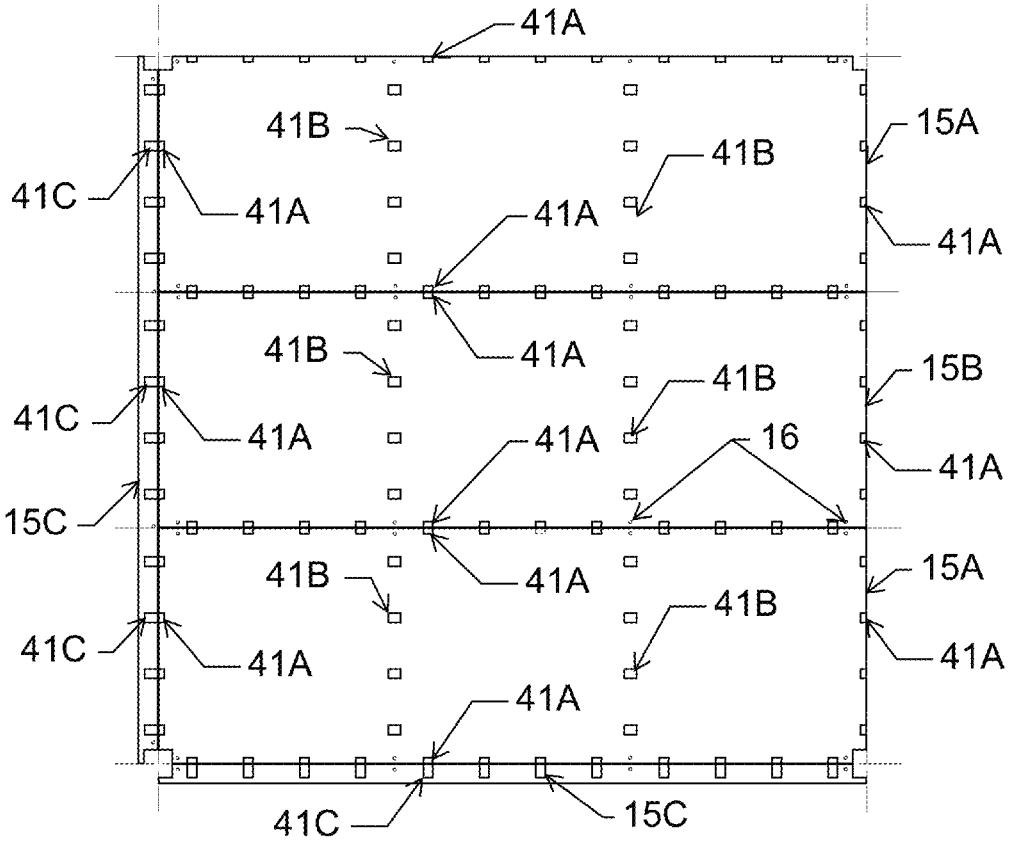
FIG. 54 is a plan view of plank layout in the present invention.

Exemplary embodiments of premanufactured floor deck planks 15 that are suitable for mounting on the assembled framework of trusses 24, 25, 26, 27 will now be briefly described. FIG. 54 illustrates one suitable arrangement of floor deck planks 15 for forming a floor supported on the arrangement of trusses 24, 25, 26, 27 in a column bay discussed above. In general, floor deck planks 15 are configured to be arranged side-by-side and mounted on the assembled framework of trusses to form a floor in the multistory building. It will be understood that flooring materials such as wood, tile, laminate, carpet, etc. may be installed over the "floor" formed by the floor deck planks 15.

In the illustrated embodiment, there are three types of floor deck planks 15, each of which is suitably formed by concrete. When the planks 15 are arranged side-by-side on the framework of trusses 24, 25, 26, 27 to form the floor, outer planks 15A span the outside ends of each column bay, an inner plank 15CB is located at between the outer planks in the column bay, and edge planks 15C extend along side edges of the column bay as shown in FIG. 54. As seen in FIG. 54, the outer planks 15A differ from the inner plank 15B by having two corner portions blocked out to form notches for receiving the columns 6.

Figure 59:
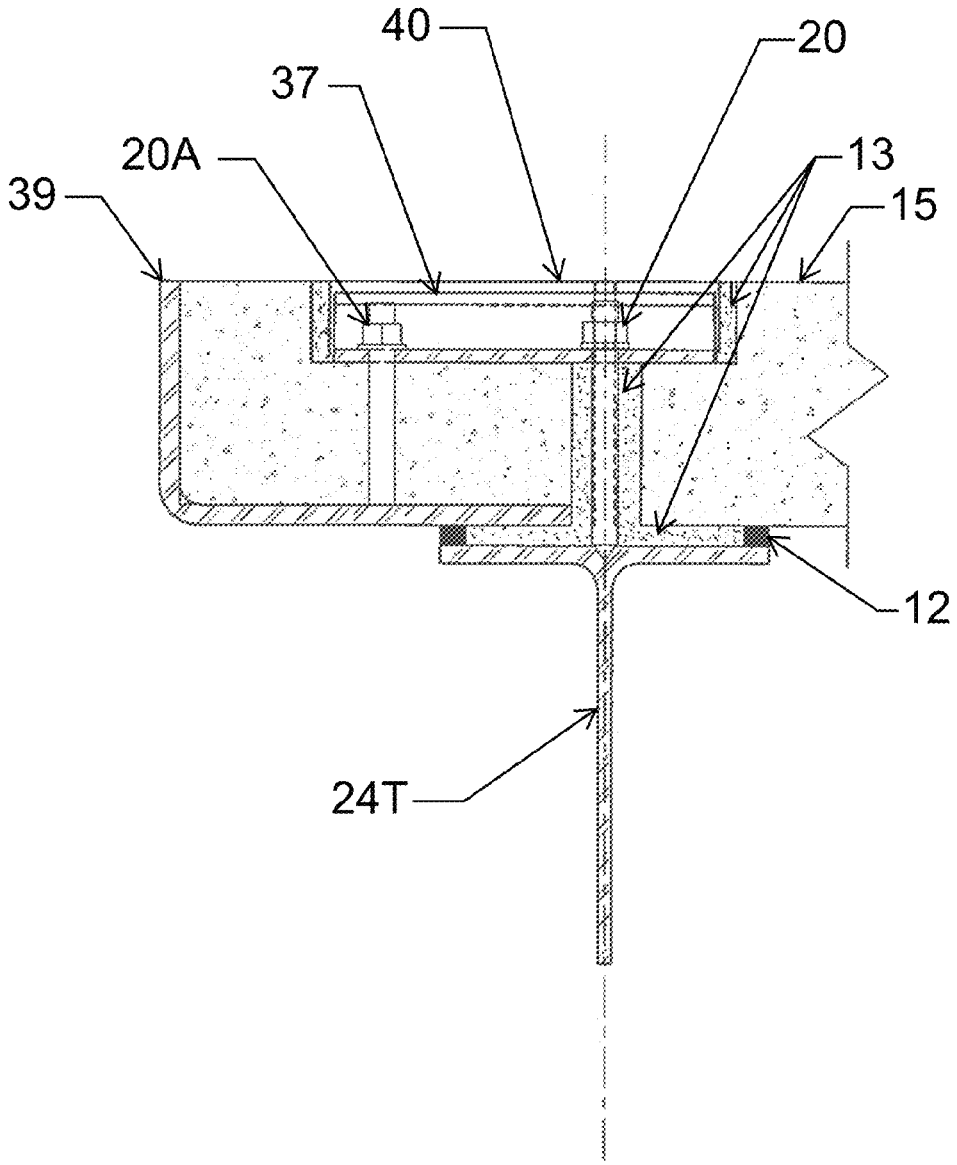
FIG. 59 is a section view of edge of floor deck plank joint detail.
Figure 60:
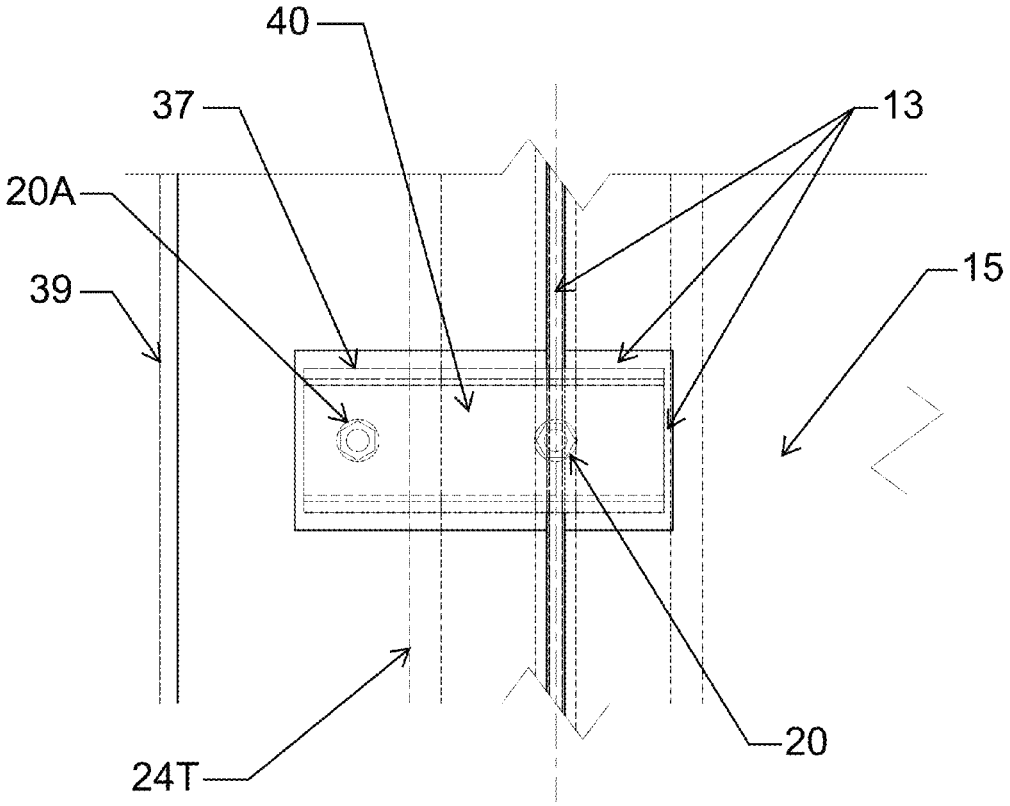
FIG. 60 is a plan view of edge of floor deck plank joint detail.

In each of the planks 15A, 15B, there are three types of recesses, noted as 41A, 41B. As explained below, these recesses form portions of clamping assembly slots that receive the threaded rods 20 of the framing trusses 24, 25, 26, 27 therein. Recesses 41A are formed at spaced apart locations along the edges of each of the planks 15A, 15B. The recesses 41A are open along the edges of the planks 15A, 15B, and the recesses 41A, 41C in the edges of adjacent planks 15A, 15B, 15C are arranged for alignment with one another to form respective clamping assembly slots. Recesses 41B are centrally located within each plank 15A, 15B and are spaced apart along the width of each plank at one-third points along the span or length of the respective plank. Each recess 41B forms a complete clamping assembly slot. Recesses 41C are formed at spaced apart locations along the inner edge of each plank 15C and, like the recesses 41A, are open at the edge of the respective plank. The recesses 41C align with the recesses 41A of adjacent planks 15A, 15B to from clamping assembly slots. The clamping assembly slots formed by the recesses 41C are larger than those formed by the other recesses as is illustrated in FIGS. 59 and 60. Coil inserts 16 of leveling assemblies are received in leveling assembly holes adjacent the side edges of each plank 15A, 15B at one-third points along the span or length of the planks as shown in FIG. 54.

In one preferred embodiment, the planks 15 are reinforced concrete planks. Reinforcing steel is not shown in the figures to avoid undue complication. Embeds and sleeves, which are typical to floor decks but not relevant to this invention, are not shown either.

Floor deck erection can, in one or more embodiment, begin after the filler trusses are erected. It can be cost prohibitive to pre-manufacture structural framing that guarantees a level floor surface without adjustment due to necessary construction/manufacturing tolerances. A slab adjusting mechanism (e.g., a leveling mechanism) is therefore employed to compensate for construction tolerance issues and level the floor deck planks 15. As illustrated below, the leveling assembly used for the floor deck planks in the higher floors in the building is the same as the leveling assembly used for the floor deck planks on grade. This allows the same floor deck materials to be used to form both on-grade and above-grade floor decks. The leveling assemblies of grade level and above grade floor deck planks could also be different without departing from the scope of the invention.

Figure 55A:
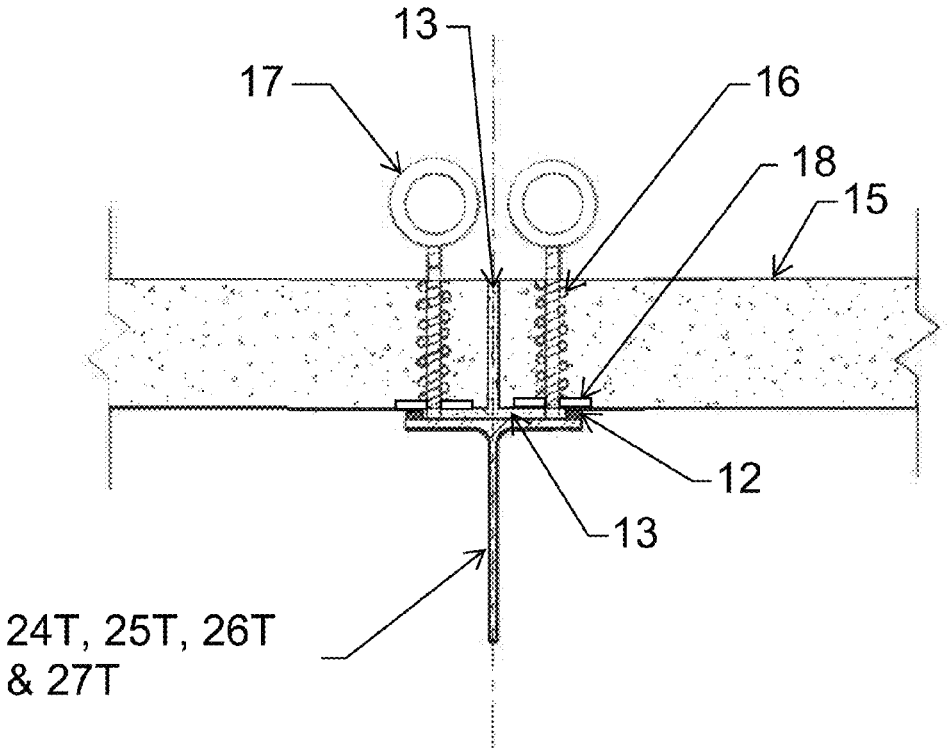
FIGS. 55A and 55B are section views of plank adjusting mechanism detail. The bolts are used for lifting in transportation and erection, and for adjusting slab levelness in installation.
Figure 55B:
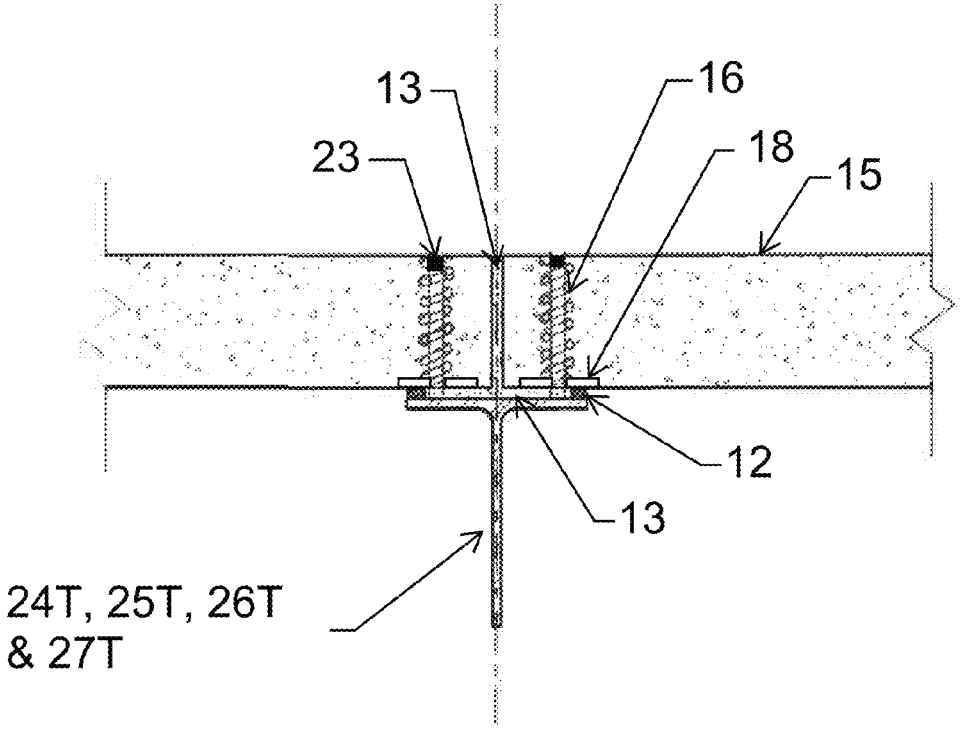

FIGS. 55A and 55B illustrate the floor elevation and levelness adjusting mechanism assembly before and after the adjusting bolts 17 are removed. It will be appreciated that the planks are positioned on the framework of trusses 24, 25, 26, 27 so that the leveling assemblies are positioned generally above the top chords 24T, 25T, 26T, 27T when the planks 15A, 15B are erected. As seen in FIG. 55A, two adjusting bolts 17, one on each side of the joint or seam between adjacent planks 15, are supported on a truss top surface (i.e., a top chord 24T, 25T, 26T, 27T). Bolt 17 is screwed through coil insert 16 so that the bottom end thereof extends about ½ inch below the bottom of the plank 15 before erection. In one or more embodiments, the bolts 17 can perform two functions, as a lifting bolt for use during transportation and erection, and as an erection and adjusting bolt or leveling bolt in final deck alignment. Since bolt 17 carries the plank weight and construction live load, a plate 18 is welded to the bottom of coil insert 16 to enlarge the plank 15 bearing area. Floor elevation and levelness can be achieved by screwing bolt 17 clockwise or counter clockwise to raise the plank up or lower the plank down. The bolt 17 engages the respective top truss chord 24T, 25T, 26T, 27T to thereby adjust the height of the top and bottom surfaces of the plank 15 as it threadably moves relative to the thickness of the plank 15. Suitably, two foam tape strips 12 are glued to the truss top surface 24T, 25T, 26T, 27T prior to erection of the floor planks 15. The tape strips 12 can be positioned outboard of where the leveling bolts 17 are to engage the truss to form a closed space or clearance channel 13 for grout injection in which the bolts are received. As discussed above, tape 12 may be closed cell foam, preventing grout from leaking through the material, and may be compressible, sealing off any uneven surfaces at the top of the trusses or the bottom of concrete planks.

Thus, it can be seen that, in one or more embodiments, a kit for constructing a multistory building includes a plurality of floor deck planks 15 configured to be arranged side-by-side on a framework of support members (e.g., trusses 24, 25, 26, 27 and connection assemblies 101, 102, 103, 201, 202, 301, 302, 303) mounted on a column 6 at a height that is spaced apart above grade to form a floor of the building. Each plank 15 can include a plank body having a top surface, a bottom surface, first and second sides, first and second ends, a thickness extending between the top and bottom surfaces, a width extending between the first and second sides, and a length extending between the first and second ends. The plank body is configured to be supported by the framework in a horizontal plane in side-by-side engagement with plank bodies of other planks 15. Certain planks 15 further include at least one (e.g., a plurality of) leveling assembly operatively connected to the plank body. The leveling assembly can include any suitable adjustment member, such as the adjustment bolt 17. The leveling assembly is suitably configured to adjust the position of the adjustment member 17 along the thickness of the plank body to engage the underlying framework or support surface and thereby adjust a distance between the support surface (e.g., the tops of the trusses 24, 25, 26, 27) and the bottom surface of the plank 15.

More specifically, the illustrated planks 15 define leveling assembly holes that extend through the thicknesses of the plank bodies and in which the leveling assemblies are received. The leveling assemblies include threaded inserts 16 that are fixed to the plank bodies in the respective leveling assembly holes, and the adjustment members 17 are threadably received in the threaded inserts. Plates 18 are attached to the threaded inserts 16 at the bottom surfaces of the plank bodies. Furthermore, the adjustment members 17 are selectively removable from the threaded inserts.

As can be seen, each of the planks 15A, 15B includes a first plurality of leveling assemblies positioned in spaced apart relationship from one another along the length of the plank body adjacent the first side of the plank and a second plurality of leveling assemblies positioned in spaced apart relationship from one another adjacent the second side. To use the leveling assemblies, the planks 15 are arranged on the framework to form the floor and the leveling assemblies are adjusted to level the planks (e.g., by adjusting the position of the adjustment member 17 relative to the thickness of the respective plank 15 to adjust a position of a bottom surface relative to a support surface defined by the framework, such as by threading the adjustment member 17 through the threaded insert 16). For example, the leveling assemblies are adjusted so that the top surfaces of each of the floor deck planks in the side-by-side arrangement of floor deck planks extends generally in the same plane. In addition filler material such as grout can be placed into a clearance channel beneath the respective plank, which is defined by spacers (e.g., tape strips 12) positioned between the plank and the support surface. As explained below, after the leveling assemblies are adjusted, the planks 15 can also be firmly secured to the framework of trusses 24, 25, 26, 27 using clamping assemblies.

Figure 56:
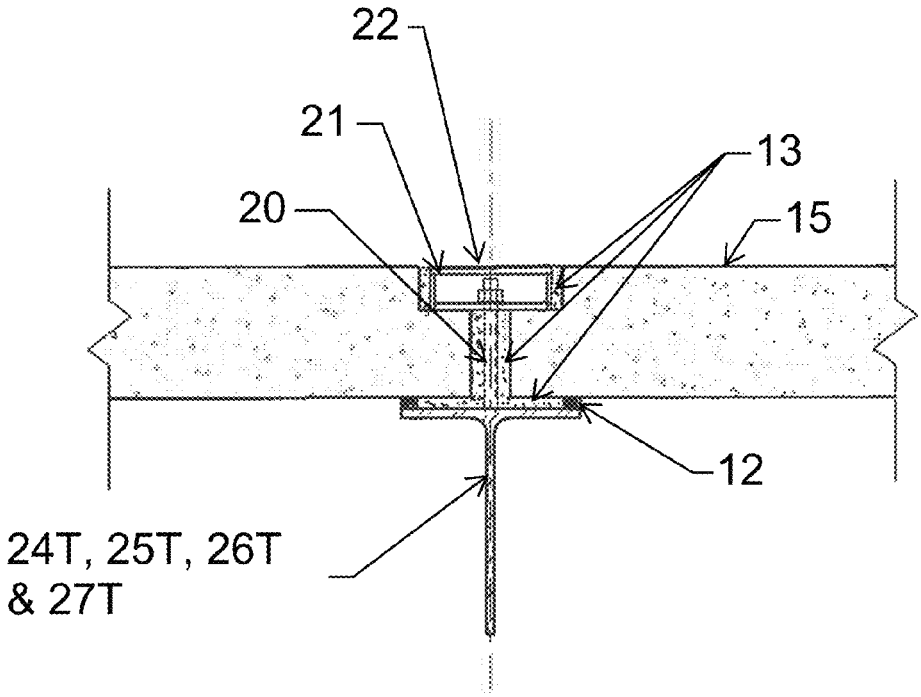
FIG. 56 is a section view of floor deck plank joint detail.
Figure 57:
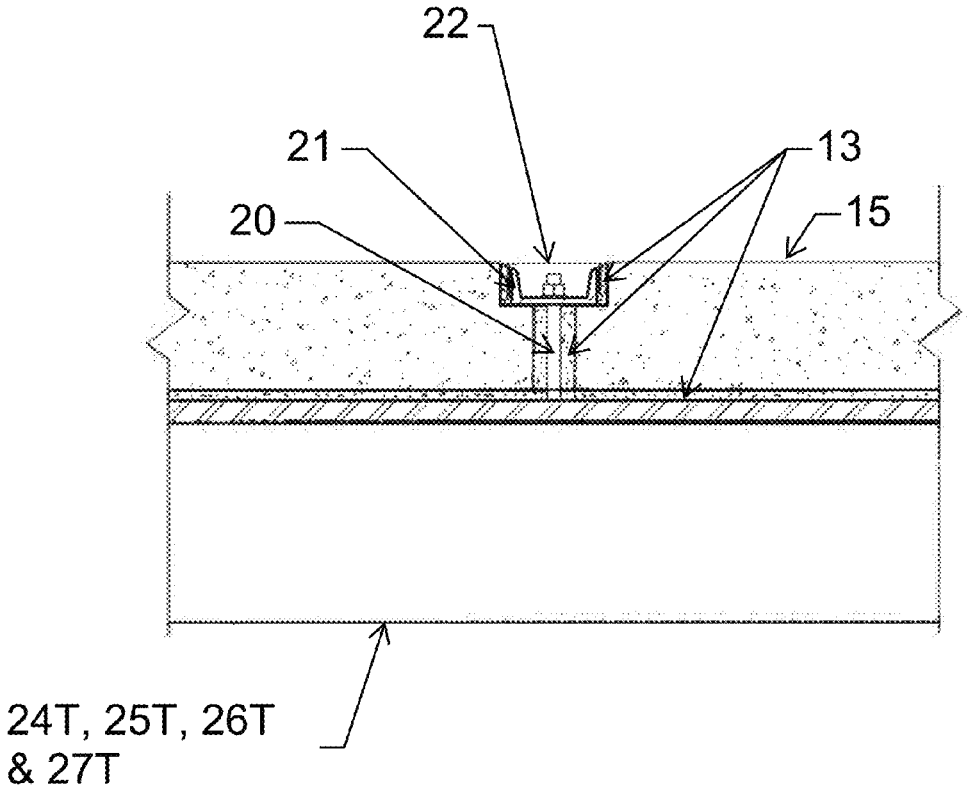
FIG. 57 is a section view of floor deck plank joint detail in the perpendicular direction.

FIGS. 56 and 57 are section views of plank to truss connection assemblies (broadly, clamping assemblies). When floor planks are adjusted to the specific elevation and leveled, as illustrated in FIGS. 56 and 57, channel washer 21 is installed in every clamping assembly slot defined by the recesses 41A, 41B and 41C as noted in FIG. 54. Bolt 20 is then tightened (e.g., using a nut). The recesses define clamping assembly slots have a lower portion and upper portion that is wider than the lower portion (i.e., the slots are countersunk) so that the slot defines an upwardly facing clamping surface between the top and bottom surfaces of the plank for engaging the respective channel washer 21. When the channel washer 21 is received in the respective clamping assembly slot, both it and the free end of the threaded rod 20 are positioned below the leveled top surfaces of the planks 15. In addition, when the clamping assemblies secure the planks 15 to the framework, the clamping assembly slots define clearance gaps 13 that extend between the threaded rod and the surrounding plank(s). The clearance gaps fluidly communicate with the clearance channels 13 beneath the planks 15 and/or the seams between adjacent planks. The clearance channels 13 can be filled by directing filler material such as grout through the clearance gaps.

To prevent grout from filling the washer space when it is supplied to the clearance channels 13, a sheet metal cap 22 is placed as a cover over each channel washer 21 before filler material is supplied. Flowable non-shrink grout is then injected into all plank joints, recesses, and spaces between the plank and steel truss. Typically, high early strength grout is preferred for fast construction speed. Once the grout gains enough strength to carry the plank load, bolt 17 is removed from the leveling assembly, as shown in FIG. 55B, and a cap 23 is screwed in coil insert 16.

Figure 58:
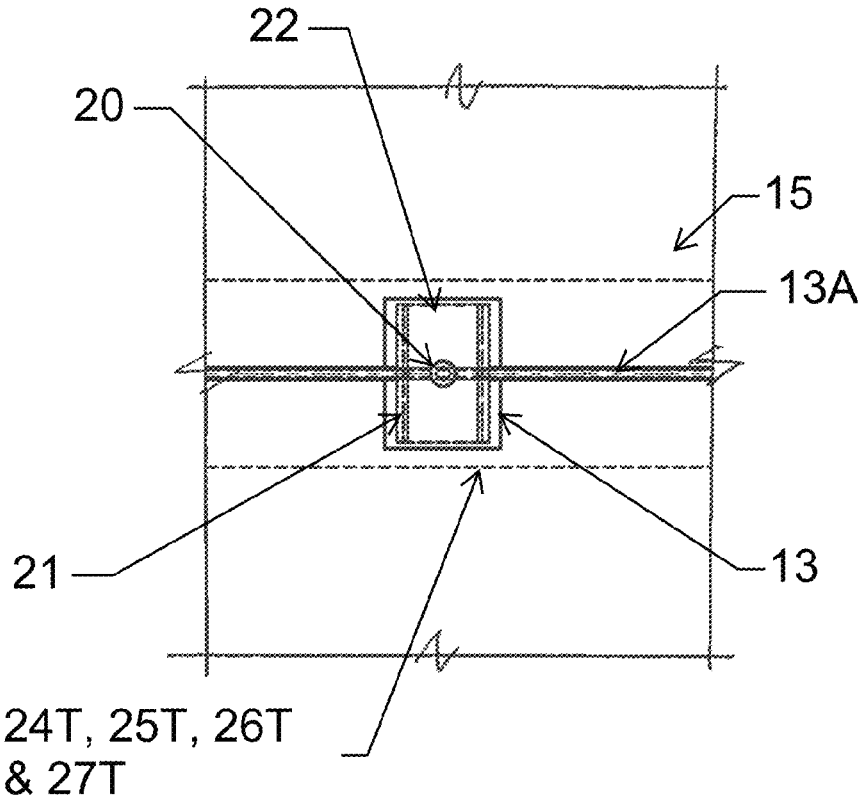
FIG. 58 is a plan view of floor deck plank joint detail.

FIG. 58 is a plan view of a plank to truss connection assembly illustrating the joints around channel washer 21 and between two planks where it occurs. Grout 13A indicates the grout at the joint or seam between two planks 15. Since there is no joint at recess 41B as shown in FIG. 54, grout 13 is injected into the joint surrounding channel washer 21 and the space between truss top and plank bottom.

For structural framing deconstruction purposes, lubricants or form release agents are applied on all surfaces in contact with grout before plank erection.

FIG. 59 is a section view of the edge plank 15C to truss connection assembly. FIG. 60 is a plan view of this clamping assembly. Edge plank 15C comprises a continuous steel bent plate 39, threaded rod 20A at each recess location, and concrete fill. The steel bent plate 39 reinforces the plank for expected bending forces during the shipping and handling process. In addition, rod 20A is welded to plate 39 to hold the edge plank in place. As seen in both figures, channel washer 37 is longer than the typical channel washer 21 and uses two bolts. Bolt 20 not only connects the planks to the truss for a composite structure, but also acts as a support to the edge plank. The construction sequence at the edge of the deck is the same as for rest of the planks as discussed above.

Thus it can be seen that, in one or more embodiments, a kit for constructing a multistory building includes preformed support members 24, 25, 26, 27 configured to be assembled into a framework for supporting a floor of the multistory building and threaded rods 20 that extend in the framework away from the support members transverse to a horizontal plane. The kit further includes preformed deck planks configured to be arranged side-by-side to form a floor supported on the framework and defining clamping assembly slots at least when arranged side-by-side to form the floor. The kit can further include clamping assemblies configured to be threadably tightened onto the threaded rods 20 to engage the floor deck planks and thereby hold the floor deck planks in position relative to the assembled framework.

In a suitable method of using the construction kit, the support members 24, 25, 26, 27 are assembled into a framework, and the floor deck planks 15 are arranged side-by-side on the framework to form the floor. After leveling the floor deck planks as described above, the clamping assemblies are threadably tightened onto the threaded rods 20 of the framework to hold the floor deck planks in position. The clearance gaps between the components of the framework and the floor are all filled with a filler material such as grout to provide further support to the floor.

It will be appreciated that various features of the components of the building construction kit used to form the on-grade floor and above grade floors are common to both aspects of the kit or kits.

FIGS. 61 and 62 illustrate the column splice assembly in elevation view and plan view. The assembly includes a lower column 6 and an upper column 36, four splice plates 8, and 24 bolts 5 at each side of the column. Plate 8 can be shop attached to the lower column for less field work. All the nuts need to be pre-welded to the inside face of plate 8 so that the bolts can be tightened properly.

It can therefore be seen that present invention includes various aspects, combinations, and permutations. For example, in one embodiment the invention is a slab on grade assembly and method with precast concrete planks employing the following elements:

Specially configured and designed precast concrete planks for slab on grade construction.

Specially created recesses along the edges of the planks and at one-third points of the plank long dimension.

An adjusting mechanism which enables adjustment of slab elevation and levelness.

A clamping connection assembly which in one preferred embodiment includes a steel plate, a bolt welded to the plate, and a steel channel washer, designed to hold adjacent planks together.

A sheet metal cap covering the steel channel washer to prevent grout from filling the channel.

A grouting assembly including foam tape and non-shrink grout to support the planks on the subgrade by filling the spaces between the bottom of plank and vapor barrier. Spacing of foam tapes is controlled by subgrade load bearing property.

In another embodiment the invention is a multistory steel framing system for building construction, and associated construction method, the framing system comprising:

Plural column bases.

Plural columns erected vertically and jointed to column bases and columns below with bolted splice connection.

Girder trusses, spanning full length between two columns with special configurations for easy mechanical ductwork passage.

Divider trusses, spanning full length between girder trusses at e.g., one-third of column spacing, Side filler trusses, spanning full length between girder truss and divider truss at e.g., one-third of column spacing.

Center filler trusses, spanning full length between divider trusses at e.g., one-third of column spacing.

Connector bolts uniformly distributed along top of trusses to join precast planks to steel trusses to form a composite floor structure.

A split seated connection at truss top chord to column connection and a bolted tension only connection at truss bottom chord to column connection.

A truss to column connection forming a three dimensional space moment frame structure.

A split seated connection at the supporting truss top chord for truss to truss top chord connection and a bolted tension only connection at truss to truss bottom chord connection.

The split seated connections enable simpler erection and meet all design load combinations required by governing building code.

The invention also encompasses a multistory structural framing system, and a method of assembling a multistory framing system comprising one or more of the following features:

A slab on grade assembly as described hereinabove.

A multistory steel framing system as described hereinable.

Plural specially configured precast concrete planks designed and reinforced as two-way slabs with pre-installed sleeves and openings for floor penetrations.

An adjusting mechanism enabling adjustment of elevation and levelness of precast concrete planks. The adjusting bolts also serve as lifting bolts for transportation and erection.

Specially created recesses along the edges of the planks and at one-third points of the plank long dimension.

A connection assembly including a bolt welded to the truss top flange, and a steel channel washer, designed to hold adjacent planks together and to connect the planks to the steel trusses for a composite structural framing.

A sheet metal cap covering the steel channel washer to prevent grout from filling the channel space.

A grout assembly including foam tapes and non-shrink grout for filling the joints between planks and the spaces between bottom of plank and top of steel truss and supporting the planks on to steel trusses on four sides for a two-way slab structure.

Bolt connection for all field connections.

A structural system without cast in place concrete above foundation.

A structure system can be deconstructed and reused.

The invention also encompasses a multistory structural framing system, and a method of assembling a multistory framing system comprising with all bolted connections in the field.

It can be seen that in another aspect the invention is directed to an integrated multistory structural framing system without cast-in-place concrete above foundation. And the invention is directed to an integrated multistory structural framing system that can be deconstructed and reused.

In view of the above, it will be seen that the several objects of the invention are achieved and other advantageous results attained in some embodiments, though not all objects are achieved in all embodiments.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above compositions and processes without departing from the scope of the invention, it is intended that all matter contained in the above description and shown in the accompanying drawings shall be interpreted as illustrative and not in a limiting sense.

What is claimed is:

1. A method of constructing a multistory building, the method comprising:

assembling preformed support members into a framework for supporting a floor of the multistory building that extends generally in a horizontal plane;

arranging preformed floor deck planks side by side on the framework to form said floor and receiving threaded rods mounted on the support members through slots defined in the side-by-side arrangement of floor deck planks; and threadably tightening clamping assemblies onto the threaded rods to engage the floor deck planks and hold the floor deck planks in position relative to the framework;

wherein the support members have the threaded rods mounted on the support members prior to said arranging of the preformed floor deck planks on the assembled framework.

2. A method as set forth in claim 1 wherein the step of threadably tightening the clamping assemblies comprises positioning the clamping assemblies in the slots below a top surface of the side-by-side arrangement of floor deck planks.

3. A method as set forth in claim 1 further comprising filling a clearance gap in at least one of said slots.

4. A method as set forth in claim 1 wherein the step of arranging the preformed floor deck planks comprises positioning at least one of the floor deck planks so that a top surface thereof is generally level and a bottom surface thereof is spaced apart from an underlying support surface to define a clearance channel.

5. A method as set forth in claim 4 further comprising filling the clearance channel with a filler material.

6. A method as set forth in claim 1 wherein the step of assembling the preformed support members into a framework comprises positioning a plurality of support plates on grade.

7. A method as set forth in claim 1 wherein the step of assembling the preformed support members into a framework comprises mounting a plurality of trusses on columns.

8. A method as set forth in claim 1 further comprising adjusting a leveling assembly on at least one of the preformed deck planks to level a top surface of said at least one of the floor deck planks.

9. A method as set forth in claim 8 wherein said step of adjusting the leveling assembly comprises adjusting a position of an adjustment member of the leveling assembly relative to a thickness of said at least one of the floor deck planks to adjust a position of a bottom surface of said at least one of the floor deck planks relative to a support surface.

10. A method as set forth in claim 9 wherein the step of adjusting the position of the adjustment member comprises threading the adjustment member through a threaded insert mounted on said one of the floor deck planks.

11. The method of claim 1 comprising welding the threaded rods to the support members prior to said assembling the preformed support members into said framework.

12. The method of claim 1 wherein the slots comprise slots defined by partial recesses in adjacent planks which are aligned to form said slots defined by partial recesses at seams between adjacent planks upon said arranging the preformed floor deck planks side by side on the framework.

13. The method of claim 12 wherein the slots further comprise slots located along widths of the planks.

14. The method of claim 5 further comprising installing a channel washer in each of said slots onto the threaded rods followed by a cap over the channel washer prior to filling the channel washer with the filler material to prevent the filler material from filling a washer space above the channel washer.

* * * * *